US011501902B2

(12) United States Patent
Whalen et al.

(10) Patent No.: US 11,501,902 B2
(45) Date of Patent: Nov. 15, 2022

(54) SYSTEM AND METHOD FOR GENERATING A MODULATED MAGNETIC FIELD

(71) Applicant: The Florida State University Research Foundation, Inc., Tallahassee, FL (US)

(72) Inventors: Jeffrey B. Whalen, Tallahassee, FL (US); Eric Lochner, Tallahassee, FL (US); Petru Andrei, Tallahassee, FL (US); Theo Siegrist, Tallahassee, FL (US); Timothy P. Murphy, Tallahassee, FL (US)

(73) Assignee: The Florida State University Research Foundation, Inc.

( * ) Notice: Subject to any disclaimer, the term of this patent is extended or adjusted under 35 U.S.C. 154(b) by 479 days.

(21) Appl. No.: 16/607,063

(22) PCT Filed: Apr. 23, 2018

(86) PCT No.: PCT/US2018/028897

§ 371 (c)(1),
(2) Date: Oct. 21, 2019

(87) PCT Pub. No.: WO2019/013853

PCT Pub. Date: Jan. 17, 2019

(65) Prior Publication Data

US 2020/0051722 A1 Feb. 13, 2020

Related U.S. Application Data

(60) Provisional application No. 62/488,138, filed on Apr. 21, 2017.

(51) Int. Cl.
*H01F 7/00* (2006.01)
*H01F 7/06* (2006.01)
(Continued)

(52) U.S. Cl.
CPC ..... *H01F 7/064* (2013.01); *H01F 7/20* (2013.01); *H01F 27/06* (2013.01); *H01F 27/24* (2013.01); *H01F 27/28* (2013.01)

(58) Field of Classification Search
None
See application file for complete search history.

(56) References Cited

U.S. PATENT DOCUMENTS 4,276,829 A * 7/1981 Chen ..... G03G 15/0266 430/48
4,815,475 A * 3/1989 Burger ..... A61N 1/08 600/554

(Continued)

FOREIGN PATENT DOCUMENTS

WO 02/04072 A1 1/2002

OTHER PUBLICATIONS

Search Report issued in PCT/US2018/028897, dated Jan. 8, 2019, 3 pages.

*Primary Examiner* — Stephen W Jackson
(74) *Attorney, Agent, or Firm* — Eversheds Sutherland (US) LLP

(57) ABSTRACT

A system comprising a solenoid electromagnet for generating a magnetic field and a driver circuit coupled to the solenoid electromagnet for modulating the magnetic field generated by the solenoid electromagnet. The magnetic field generated by the solenoid electromagnet of the present invention exhibits improved control over the direction and projection of the generated magnetic field. The generated magnetic field has the ability to detach permanent magnets from metal plates, cause motion of permanent magnets and soft magnetic materials as well as create separation between two magnetically bound permanent magnets.

15 Claims, 44 Drawing Sheets

(51) Int. Cl.

| | |
|---|---|
| ***H01F 7/20*** | (2006.01) |
| ***H01F 27/06*** | (2006.01) |
| ***H01F 27/24*** | (2006.01) |
| ***H01F 27/28*** | (2006.01) |

(56) References Cited

U.S. PATENT DOCUMENTS

| | | | | |
|---|---|---|---|---|
| 4,968,081 | A | 11/1990 | Beight et al. | |
| 9,703,295 | B1 * | 7/2017 | Neal, III | B64C 31/02 |
| 2006/0187607 | A1 | 8/2006 | Mo | |
| 2015/0022298 | A1 | 1/2015 | Fullerton | |

* cited by examiner

SYSTEM AND METHOD FOR GENERATING A MODULATED MAGNETIC FIELD

CROSS-REFERENCE TO RELATED APPLICATIONS

This application is a national stage application, filed under 35 U.S.C. § 371, of International Application No. PCT/US2018/028897, filed on Apr. 23, 2018, titled "Systems and Methods for Generating a Modulated Magnetic Field," which claims priority to U.S. Provisional Patent Application No. 62/488,138, filed on Apr. 21, 2017, the entire contents of each of which are hereby incorporated herein by reference in their entirety for all purposes.

STATEMENT OF GOVERNMENT INTEREST

This invention was made with Government support under Grant No. 227000-524-037673 awarded by the Department of Defense. The Government has certain rights in the invention

BACKGROUND OF THE INVENTION

In various fields, it is desirable to be able to remove a permanent magnet from a metal surface without physically contacting the magnet itself. While it is known that heating the magnet to a critical temperature will cause the magnet to lose its magnetic properties and thereby remove the magnet from the metal surface, the critical temperatures required are very high and as such, are not a practical solution that can be used across various fields.

Additionally, it may also be desirable in various fields to effect movement of an object containing a piece of metal, without physically contacting the object.

Accordingly, what is needed in the art is a system and method for effecting movement of an object containing a piece of metal and in particular, for removing a permanent magnet from a metal surface.

SUMMARY OF INVENTION

In various embodiments, the present invention provides a system comprising a solenoid-based electromagnet for generating a magnetic field and a driver circuit coupled to the solenoid electromagnet for modulating the magnetic field generated by the electromagnet. The modulated magnetic field generated by the electromagnet and driver circuit of the present invention exhibits improved control over the direction and projection of the generated magnetic field.

In one embodiment, the present invention provides a system for generating a modulated electromagnetic field, the device comprising at least one electromagnetic device, a charge/discharge circuit coupled to the electromagnetic device and a modulation control circuit coupled to the charge/discharge circuit to control the charging and discharging of the electromagnetic device to generate a modulated electromagnetic field. The electromagnetic device includes at least one solenoid coil and the charge/discharge circuit is coupled to at least one solenoid coil.

The electromagnetic device may include a magnetic core. In one embodiment, the magnetic core may be substantially straight. In an additional embodiment, the magnetic core may be trapezoid shaped or any other of various shapes wherein the magnetic core comprises a first end and a second end and is shaped to position the first end in close proximity to the second end. In another embodiment, the electromagnetic system may include a plurality of electromagnetic devices configured in an array.

The electromagnetic system of the present invention may be used to effect change in the location or position of a permanent magnet or of an object containing a metal portion. In one embodiment, the present invention may be used generate a modulated magnetic field by charging and discharging the electromagnetic device to generate a modulated electromagnetic field.

In one embodiment, the present invention provides a method for removing a permanent magnet from a metal surface, which includes, positioning an electromagnetic system comprising at least one electromagnetic device, a charge/discharge circuit coupled to the electromagnetic device and a modulation control circuit coupled to the charge/discharge circuit in close proximity to a permanent magnet and activating the modulation control circuit to control the charging and discharging of the electromagnetic device to generate a modulated electromagnetic field, wherein the modulated electromagnetic field is sufficient to detach the permanent magnet from the metal surface.

In another embodiment, the present invention provides a method for moving an object containing a metal element, which includes, positioning an electromagnetic system comprising at least one electromagnetic device, a charge/discharge circuit coupled to the electromagnetic device and a modulation control circuit coupled to the charge/discharge circuit in close proximity to an object containing a metal element and activating the modulation control circuit to control the charging and discharging of the electromagnetic device to generate a modulated electromagnetic field, wherein the modulated electromagnetic field is sufficient to move the object containing the metal element.

In an additional embodiment, the present invention provides a method for separating two permanent magnets that are magnetically attracted and bound to each other, which includes, positioning an electromagnetic system, comprising a charge/discharge circuit coupled to the electromagnetic device and a modulation control circuit coupled to the charge/discharge circuit in close proximity to the two magnetically bound permanent magnets and activating the modulation control circuit to control the charging and discharging of the electromagnetic device to generate a modulated electromagnetic field, wherein the modulated electromagnetic field is sufficient to separate the two magnetically bound permanent magnets.

BRIEF DESCRIPTION OF THE DRAWINGS

The present invention will be better understood from the following detailed description of the invention, taken in conjunction with the accompanying drawings, in which.

DETAILED DESCRIPTION OF THE INVENTION

Figure 1A:
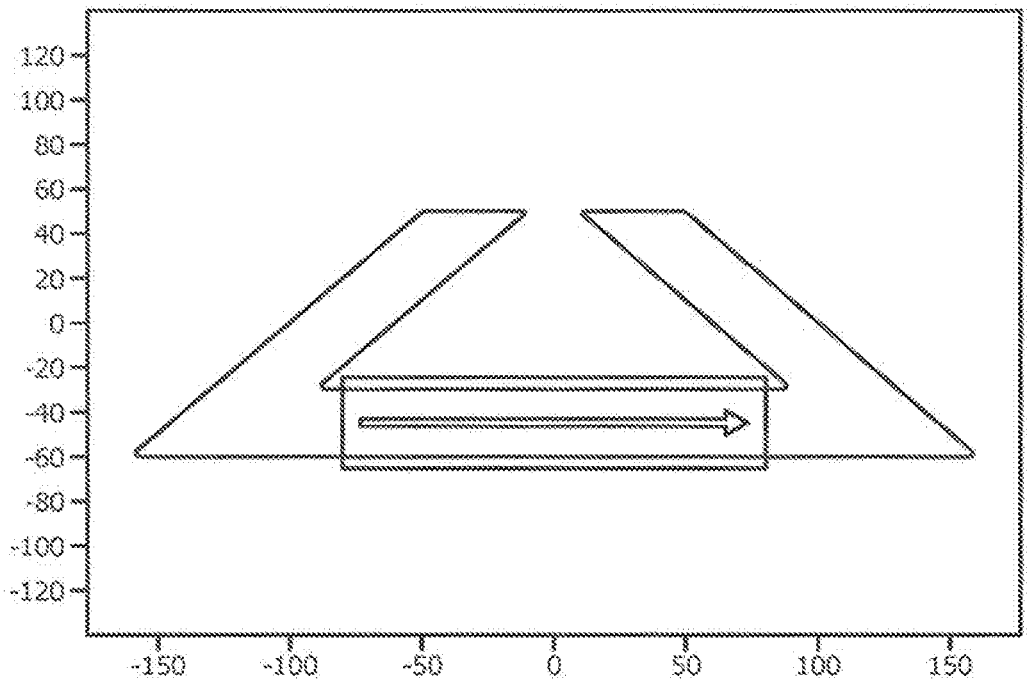
FIG. 1A is an illustration of a trapezoidal-shaped electromagnet having a single solenoid, in accordance with an embodiment of the present invention.

An electromagnet is a type of magnet wherein a magnetic field is produced by an electric current and the generated magnetic field is discontinued when the electric current is removed. Solenoid electromagnets may consist of a conductive wire wound into a helical coil, but other embodiments exist such as foil-wound and pancake (uni- and multi-filar) electromagnets. Applying a voltage to the wire results in a current through the wire, which produces a controlled magnetic field that is concentrated along the length of the interior of the coiled wire. The strength of the magnetic field is proportionate to the amount of current flowing in the coiled wire. Commonly, the turns of wire forming the coil are wound around a ferromagnetic core, such as iron. The ferromagnetic core serves to concentrate the magnetic flux of the magnetic field, thereby increasing the strength of the electromagnet.

In various embodiments, the present invention provides an electromagnetic device for directing a modulated magnetic field to interrupt an existing static magnetic field. The device includes at least one electromagnetic device, a charge/discharge circuit coupled to the electromagnetic device and a modulation control circuit coupled to the charge/discharge circuit to control the charging and discharging of the electromagnetic device to generate a modulated electromagnetic field. The electromagnetic device includes at least one solenoid coil and the charge/discharge circuit is coupled to the at least one solenoid coil.

In one embodiment, the electromagnetic device generates a modulated magnetic field that is sufficient to interrupt the static magnetic field of a permanent magnet that is attractively secured to a metal plate. In this embodiment, the magnetic field generated by the electromagnetic device is modulated and directed such that it oscillates in a way that creates a large alternating direction torque force on the permanent magnet attached to the metal plate. The modulated magnetic field generated by the electromagnetic device is effective in interrupting the magnetostatic attraction between the permanent magnet and the metal plate such that the attractive forces are no longer perpendicular (i.e. normal) to the face of the metal plate and as such, gravitational forces are capable of overwhelming the permanent magnet, resulting in detachment of the permanent magnet from the metal plate. As such, in this embodiment, the modulated field generated by the electromagnetic device results in a torque force that is sufficient to create a gap between the magnet and the metal plate which results in detachment of the magnet due to the force of gravity acting on the mass of the permanent magnet. As such, the permanent magnet's magnetostatic attraction to the metal plate is interrupted by the modulated field generated by the electromagnetic device of the present invention.

In anther embodiment, the electromagnetic of the present invention is effective in separating two or more permanent magnets that are magnetically bound to each other. In this embodiment, the modulated magnetic field created by the electromagnetic device charges and discharges the electromagnetic which is placed in close proximity to the two or more magnetically bound permanent magnets and is effective in separating the two or more magnetically bound permanent magnets.

In an additional embodiment, the electromagnetic of the present invention is effective in causing movement of an object containing a piece of metal, such as iron, or any other known magnetic or polarizable metal or metal alloy. In this embodiment, the modulated magnetic field created by the electromagnetic device incites movement of the object containing the piece of metal due to the alternating direction of the magnetic field which results in the generation of a torque force on the object containing the metal piece which causes the object to rock back and forth, ultimately falling over due to gravitational forces.

As shown in FIG. 1-FIG. 8, FIG. 12, FIG. 13 FIG. 16 and FIG. 32 and FIG. 33, the magnetic core of the electromagnet may be formed into a novel geometry wherein the magnetic core is a trapezoid shape and wherein the ends of the trapezoid legs have an acute angle with respect to the base of the trapezoid. This geometry results in a magnetic dipole wherein magnetic flux is directed out of one leg end and into the other leg end. Modeling and experiments performed on the trapezoidal-shaped electromagnets show that this dipole shape projects a stronger magnetic flux further from the dipole ends, as compared to straight solenoids, where the ends of the straight solenoid are positioned at 180 degrees on either side of a straight core. The results of the bending of the straight solenoid core into a trapezoid shape, such that the legs have an acute angle to the base, creates a higher field strength at the same distance of a straight solenoid, in any orientation. The numerical simulations of the magnetic flux lines and field gradients for the straight solenoids versus the trapezoidal-shaped solenoids illustrate that the flux density is much higher for the case of the trapezoidal-shape at the same proximity, as indicated by lighter shades of blue extending further from the leg ends, compared to the darker shades of blue extending from the ends of the straight solenoid. The absolute field strength, shown on the right side of the simulations, demonstrates that the flux density is larger for the trapezoidal-shaped core at any given point extending from the solenoid ends, when compared to the straight core solenoids.

Figure 1B:
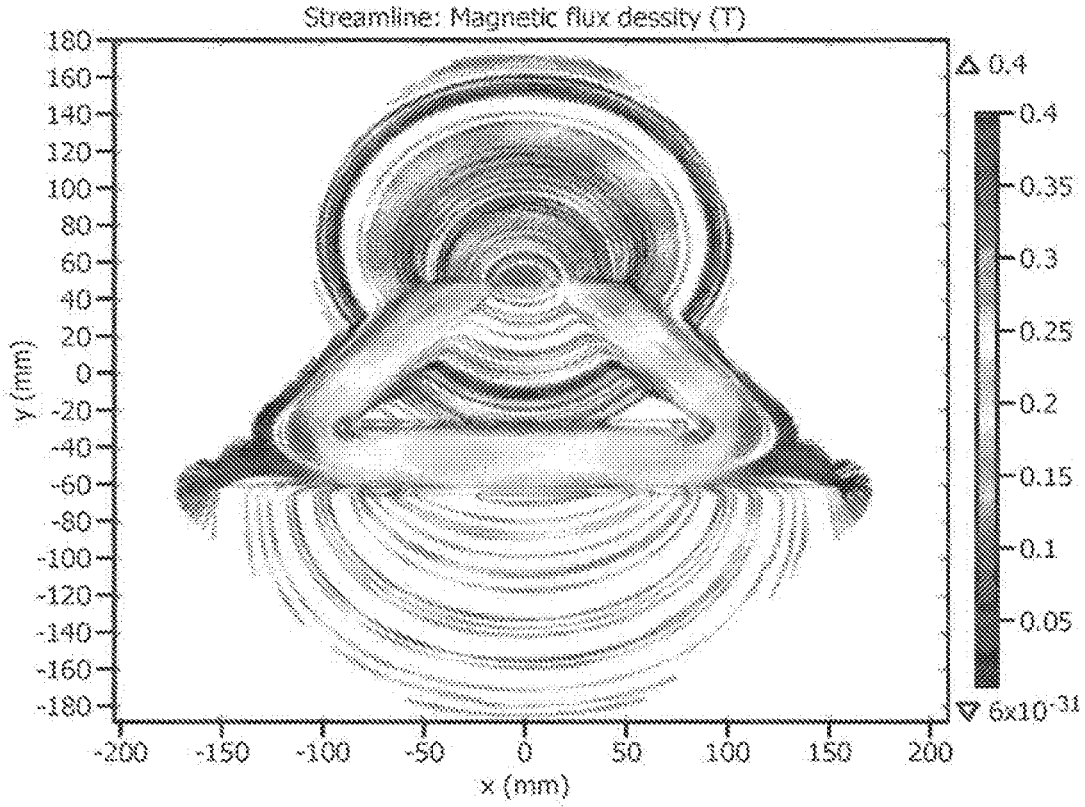
FIG. 1B is an illustration of the magnetic flux density generated by the electromagnet of FIG. 1A, in accordance with an embodiment of the present invention.
Figure 2A:
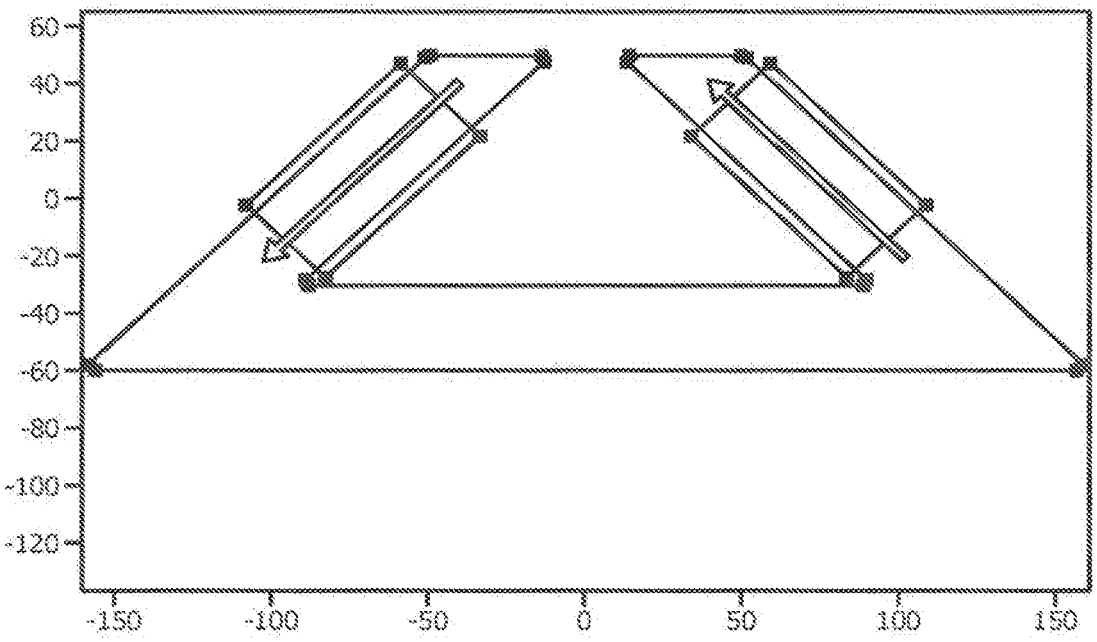
FIG. 2A is an illustration of a trapezoidal-shaped electromagnet having two solenoids in accordance with an embodiment of the present invention.
Figure 2B:
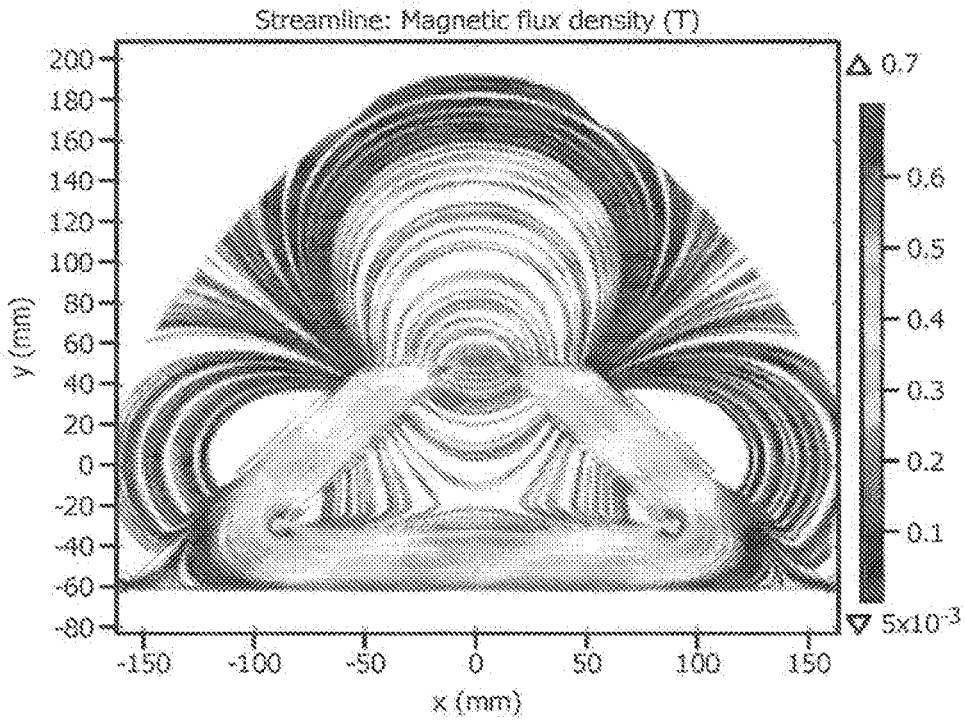
FIG. 2B is an illustration of the magnetic flux density generated by the electromagnet of FIG. 2A, in accordance with an embodiment of the present invention.
Figure 3A:
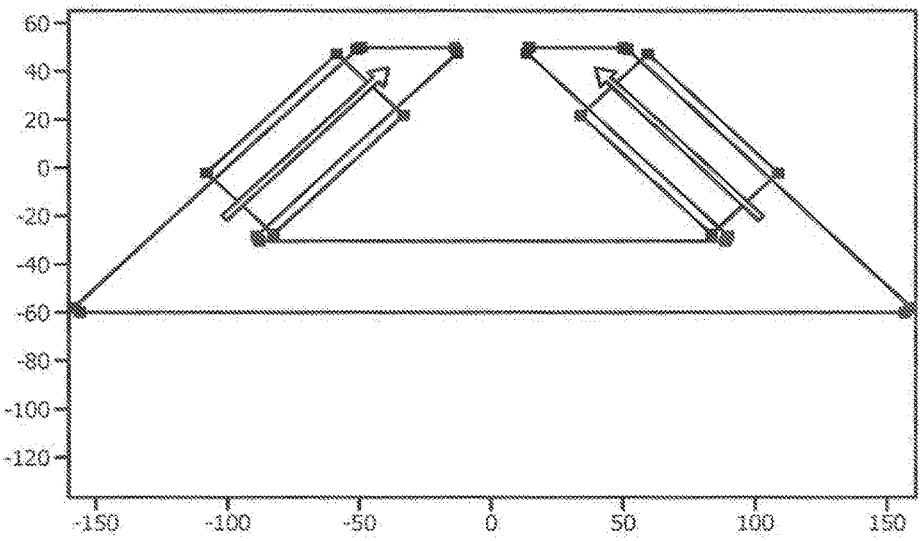
FIG. 3A is an illustration of a trapezoidal-shaped electromagnet having two solenoids in accordance with an embodiment of the present invention.
Figure 3B:
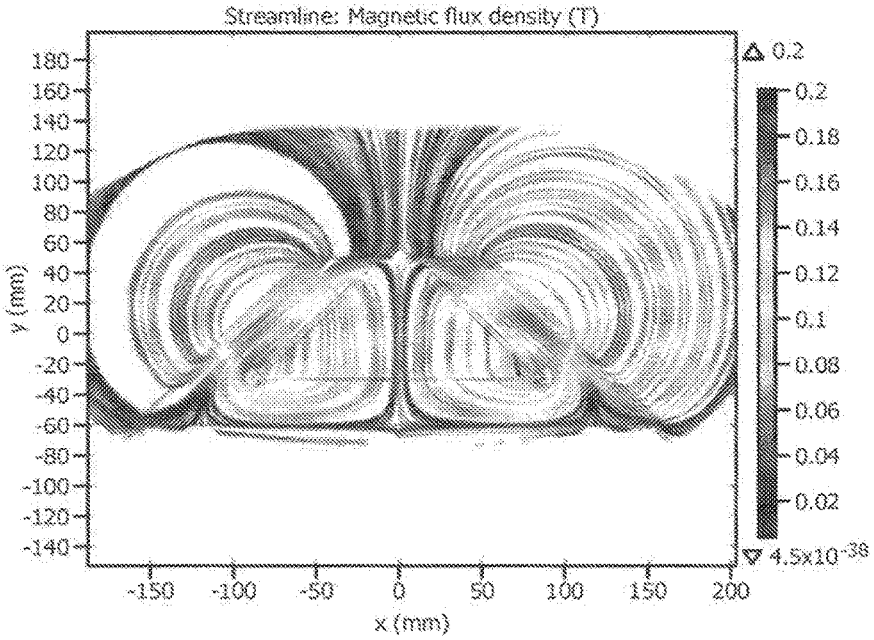
FIG. 3B is an illustration of the magnetic flux density generated by the electromagnet of FIG. 3A, in accordance with an embodiment of the present invention.
Figure 4A:
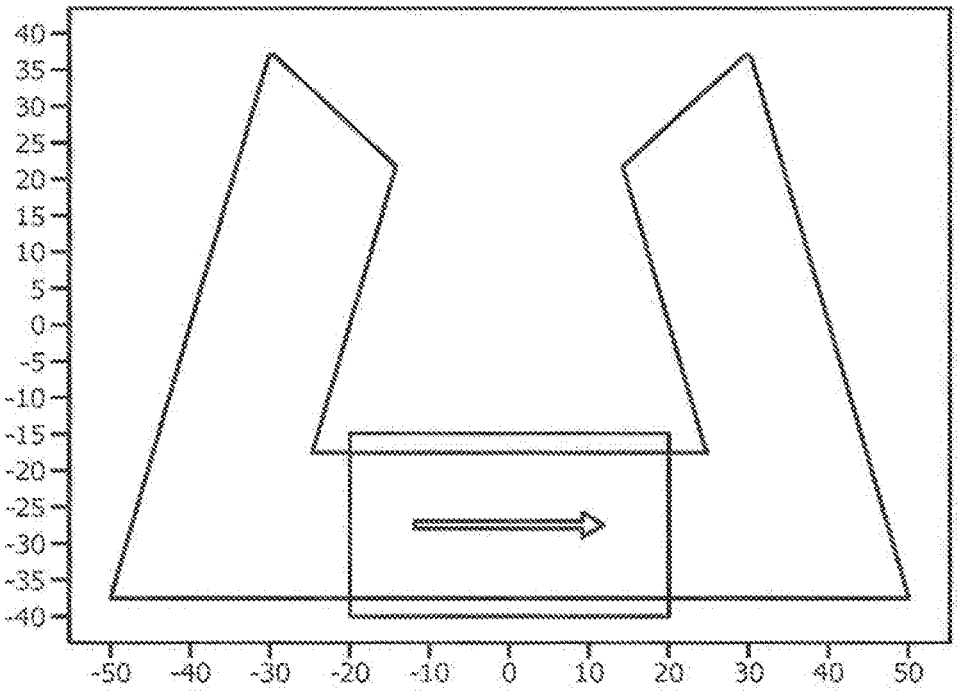
FIG. 4A is an illustration of a trapezoidal-shaped electromagnet having a single solenoid, sharp corners and radial cut ends, in accordance with an embodiment of the present invention.
Figure 4B:
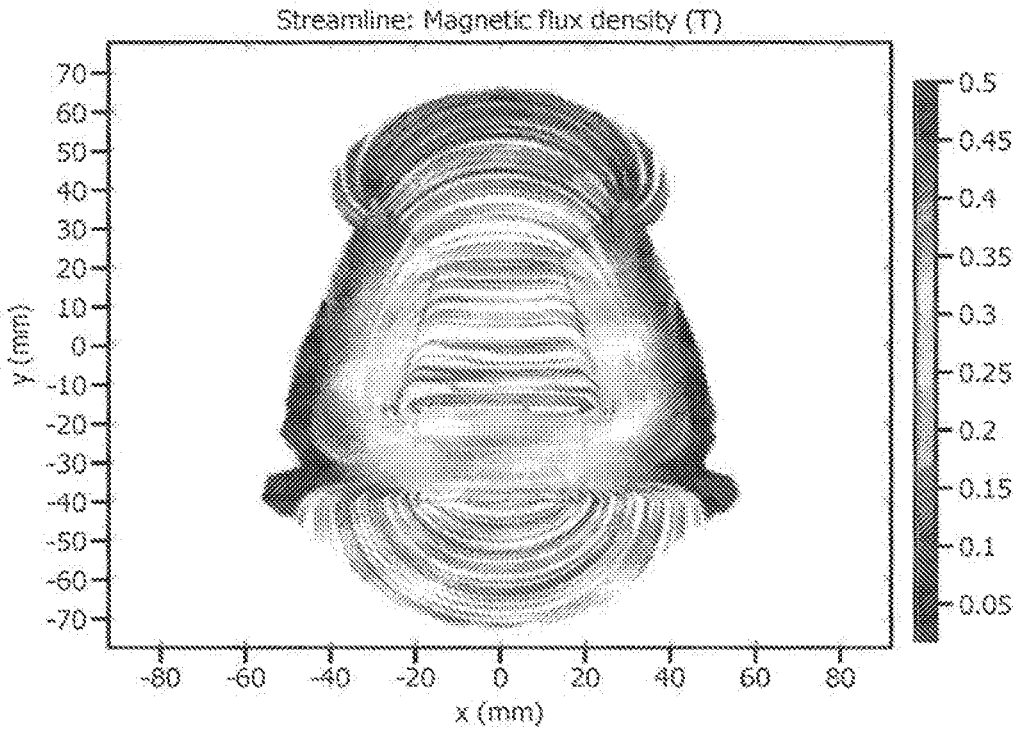
FIG. 4B is an illustration of the magnetic flux density generated by the electromagnet of FIG. 4A, in accordance with an embodiment of the present invention.
Figure 5A:
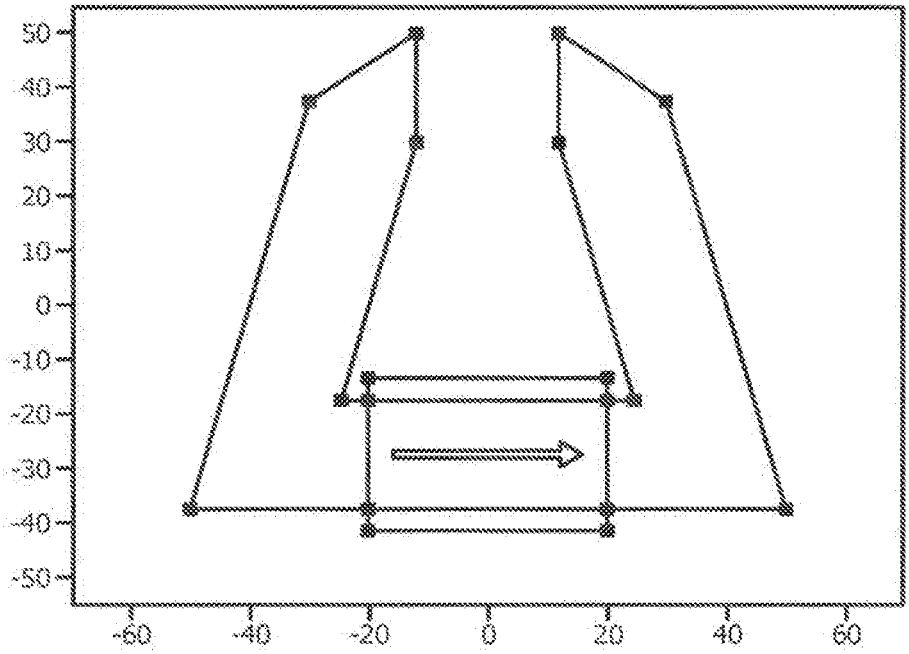
FIG. 5A is an illustration of a trapezoidal-shaped electromagnet having a single solenoid, sharp corners and conical cut ends, in accordance with an embodiment of the present invention.
Figure 5B:
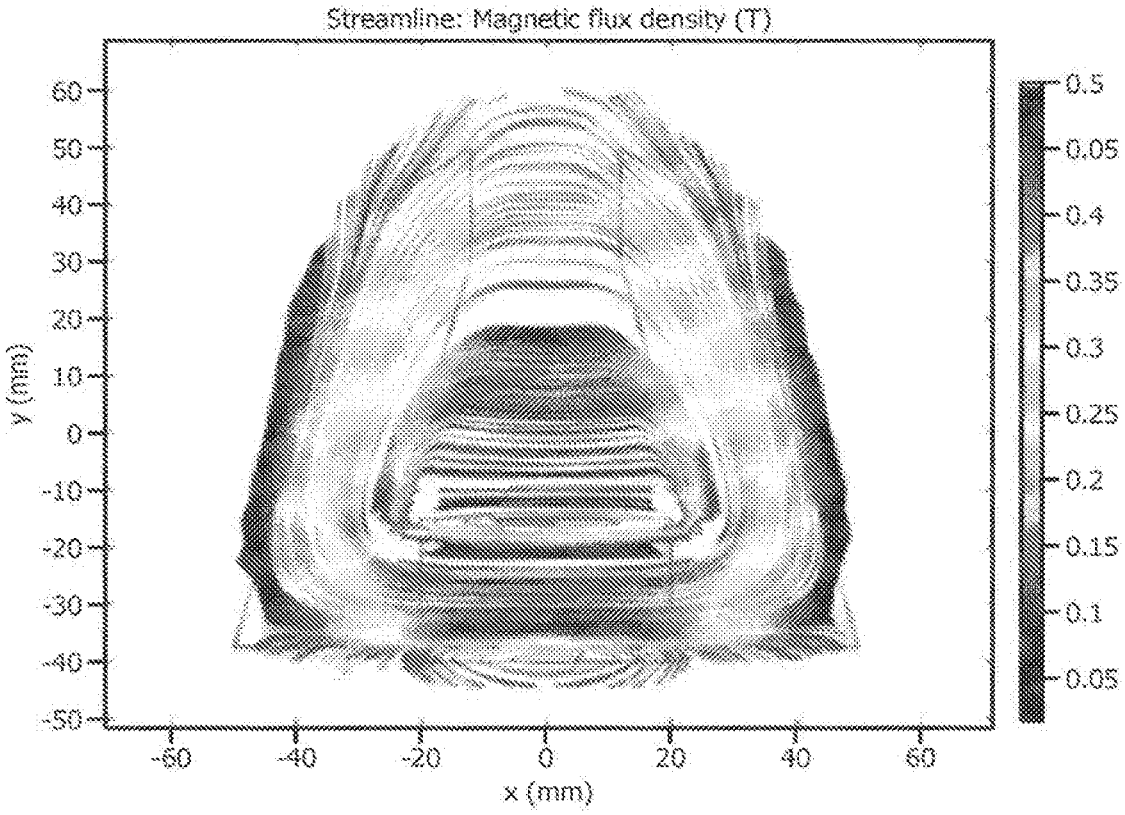
FIG. 5B is an illustration of the magnetic flux density generated by the electromagnet of FIG. 5A, in accordance with an embodiment of the present invention.
Figure 6A:
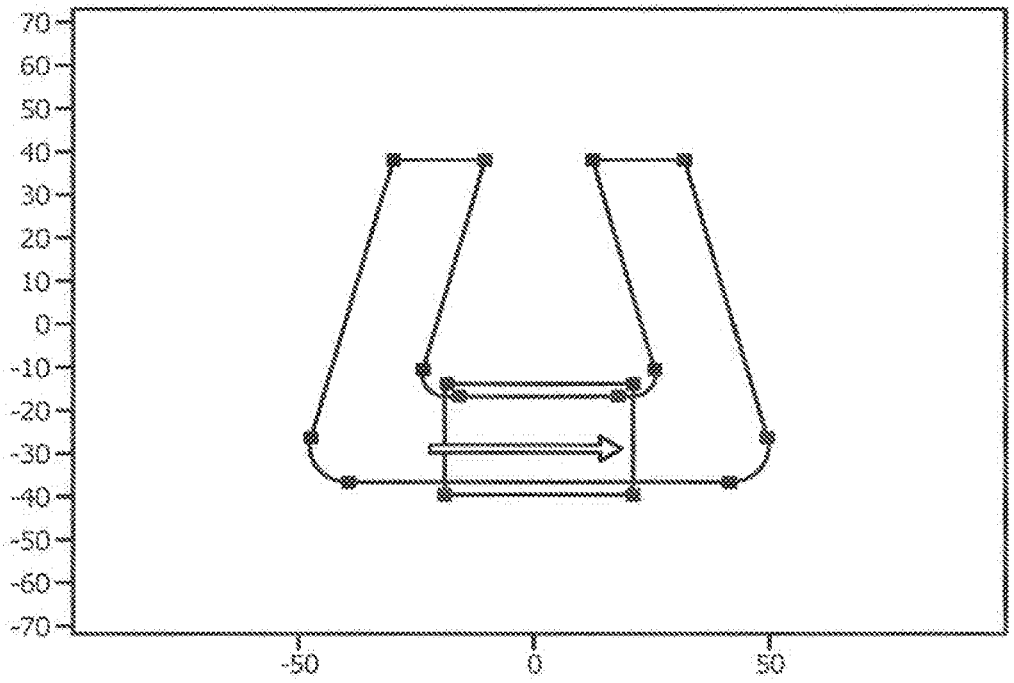
FIG. 6A is an illustration of a trapezoidal-shaped electromagnet having a single solenoid, radial corners and cord cut ends, in accordance with an embodiment of the present invention.
Figure 6B:
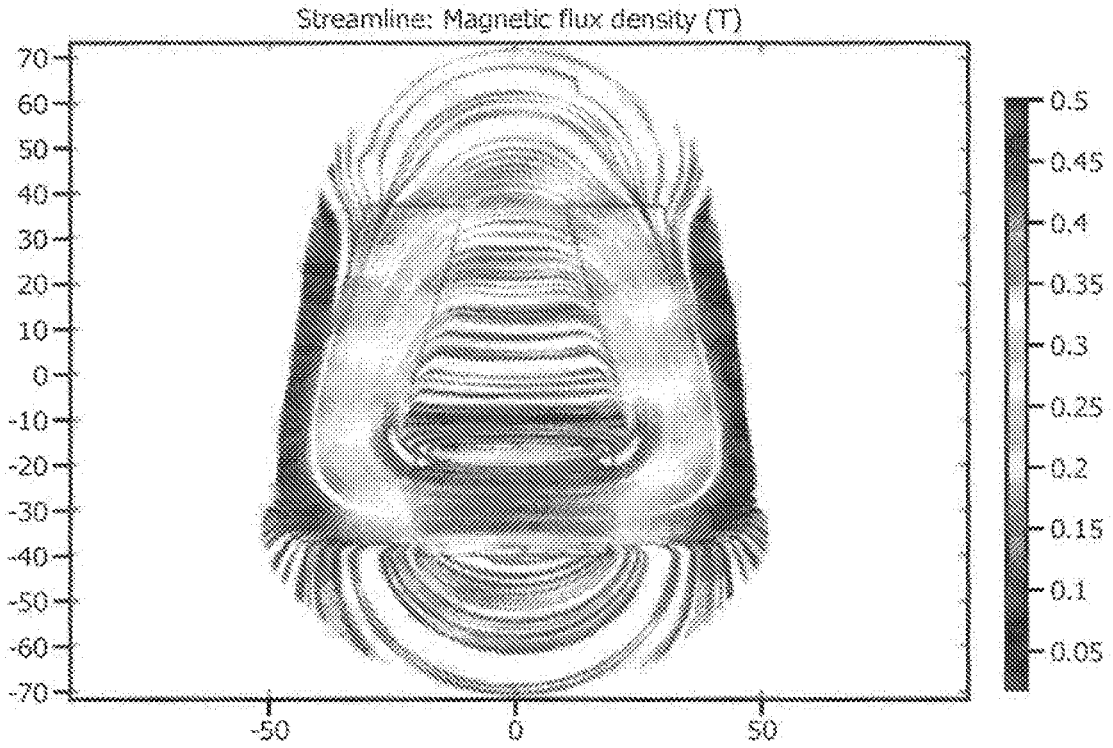
FIG. 6B is an illustration of the magnetic flux density generated by the electromagnet of FIG. 6A, in accordance with an embodiment of the present invention.
Figure 7A:
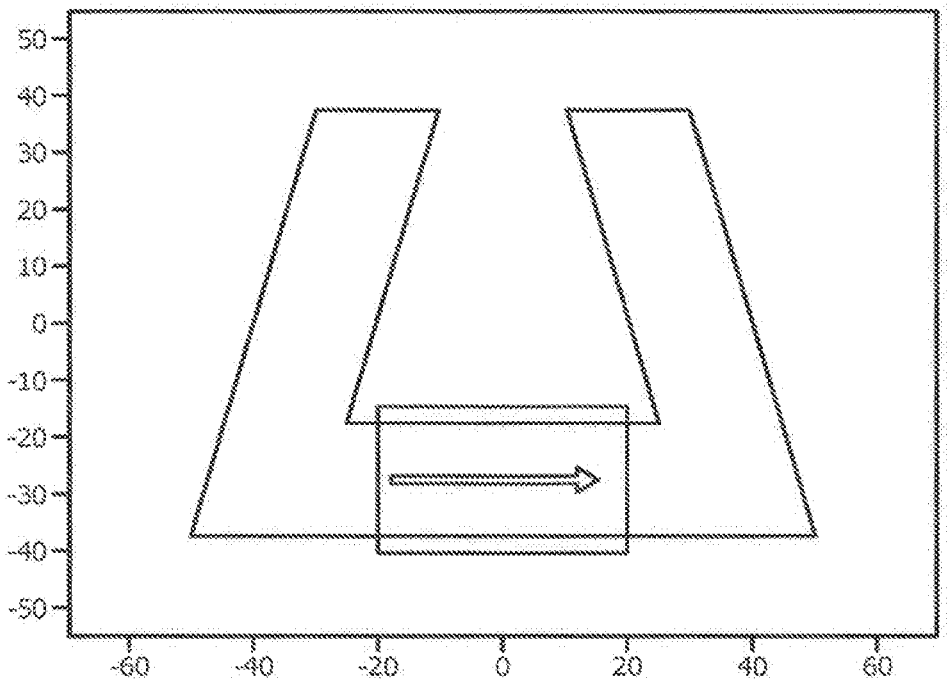
FIG. 7A is an illustration of a trapezoidal-shaped electromagnet having a single solenoid, sharp corners and cord cut ends, in accordance with an embodiment of the present invention.
Figure 7B:
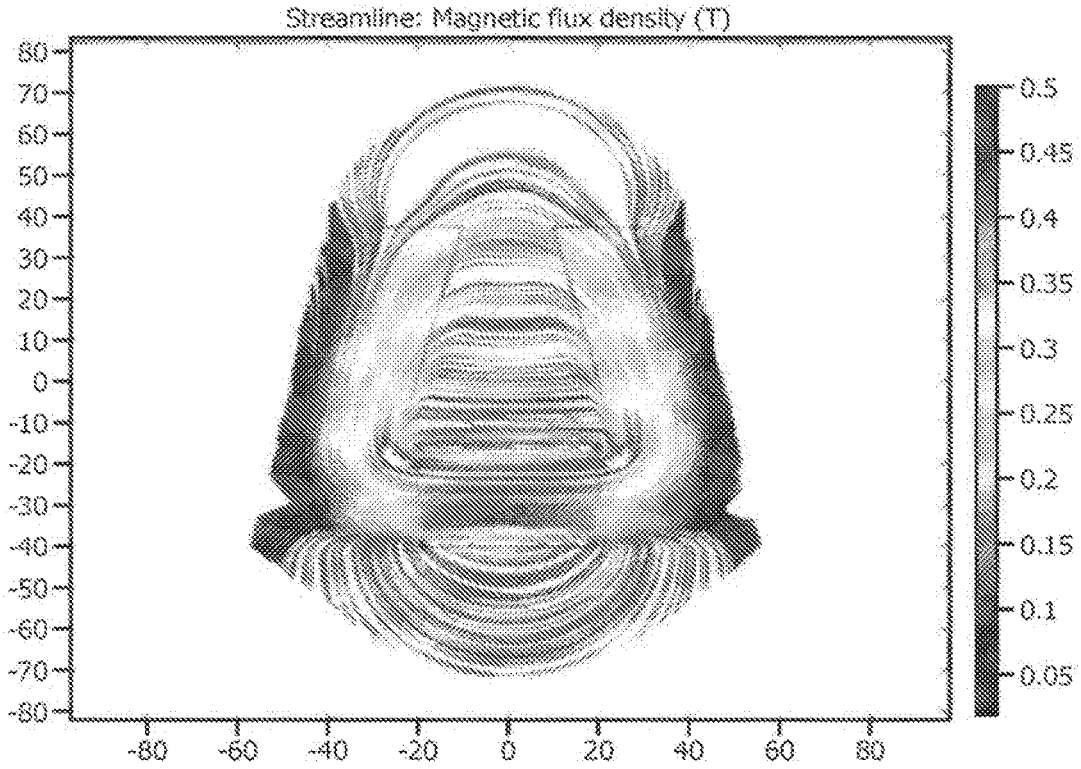
FIG. 7B is an illustration of the magnetic flux density generated by the electromagnet of FIG. 7A, in accordance with an embodiment of the present invention.
Figure 8A:
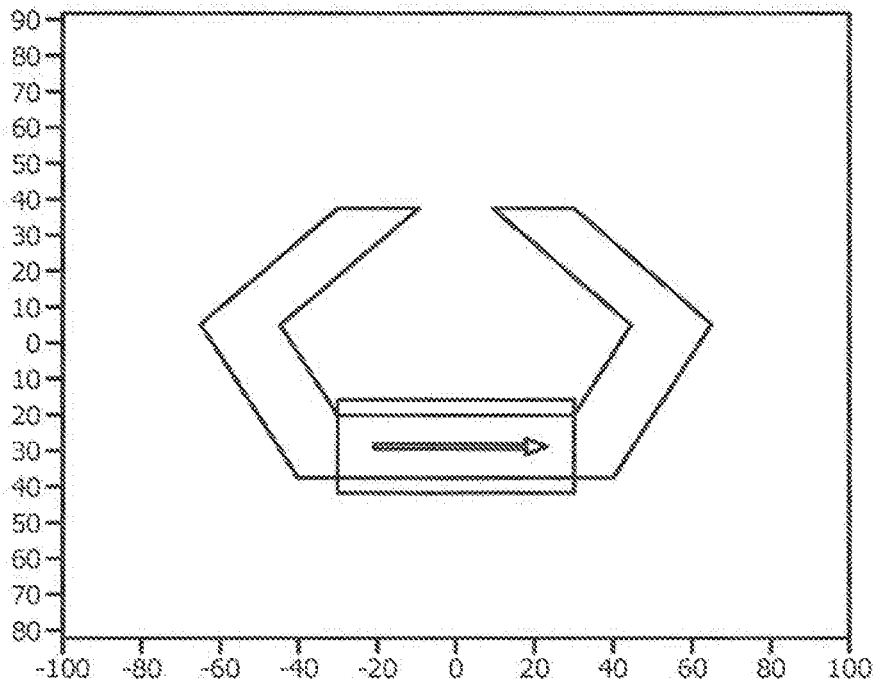
FIG. 8A is an illustration of a hexagonal-shaped electromagnet having a single solenoid, sharp corners and cord cut ends, in accordance with an embodiment of the present invention.
Figure 8B:
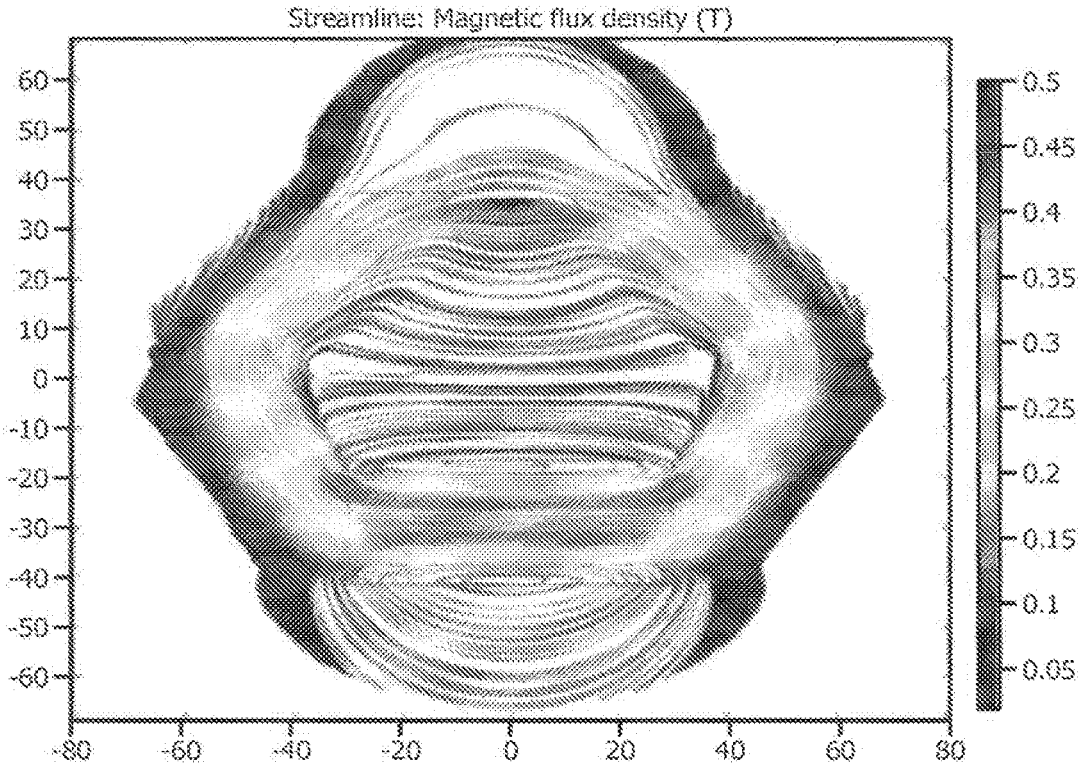
FIG. 8B is an illustration of the magnetic flux density generated by the electromagnet of FIG. 8A, in accordance with an embodiment of the present invention.
Figure 9A:
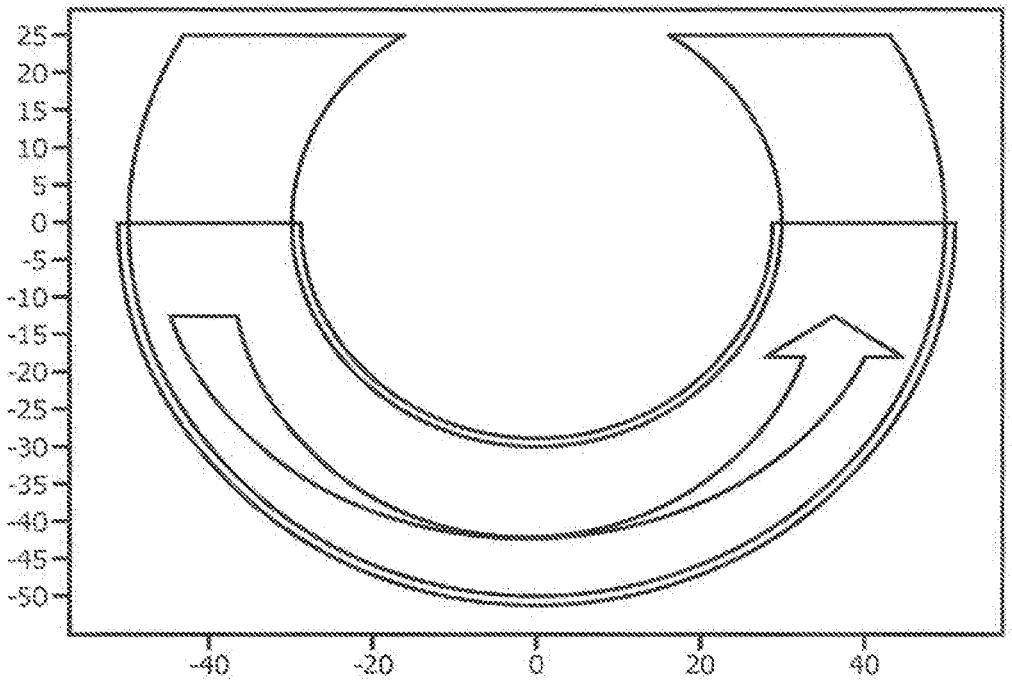
FIG. 9A is an illustration of a circular-shaped electromagnet having a single solenoid and cord cut ends, in accordance with an embodiment of the present invention.
Figure 9B:
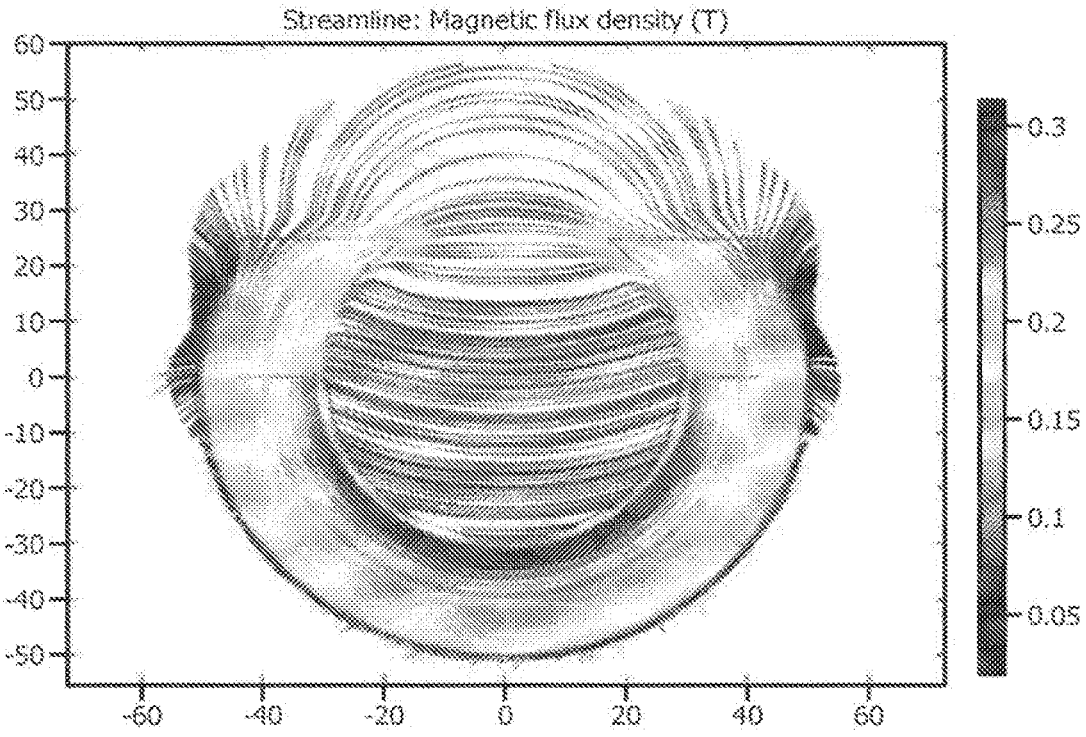
FIG. 9B is an illustration of the magnetic flux density generated by the electromagnet of FIG. 9A, in accordance with an embodiment of the present invention.
Figure 10A:
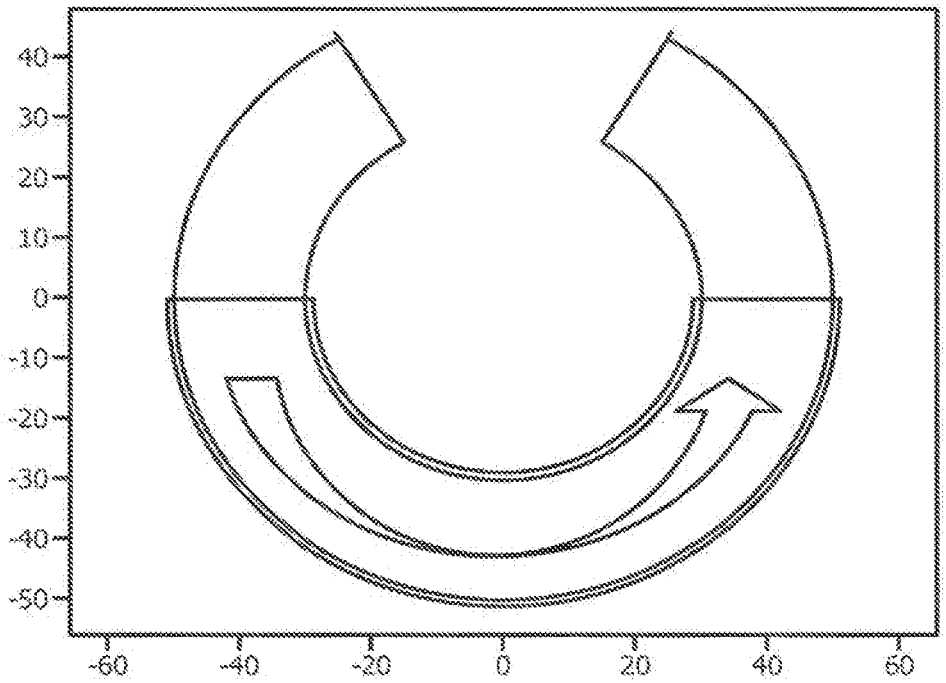
FIG. 10A is an illustration of a circular-shaped electromagnet having a single solenoid and radial cut ends, in accordance with an embodiment of the present invention.
Figure 10B:
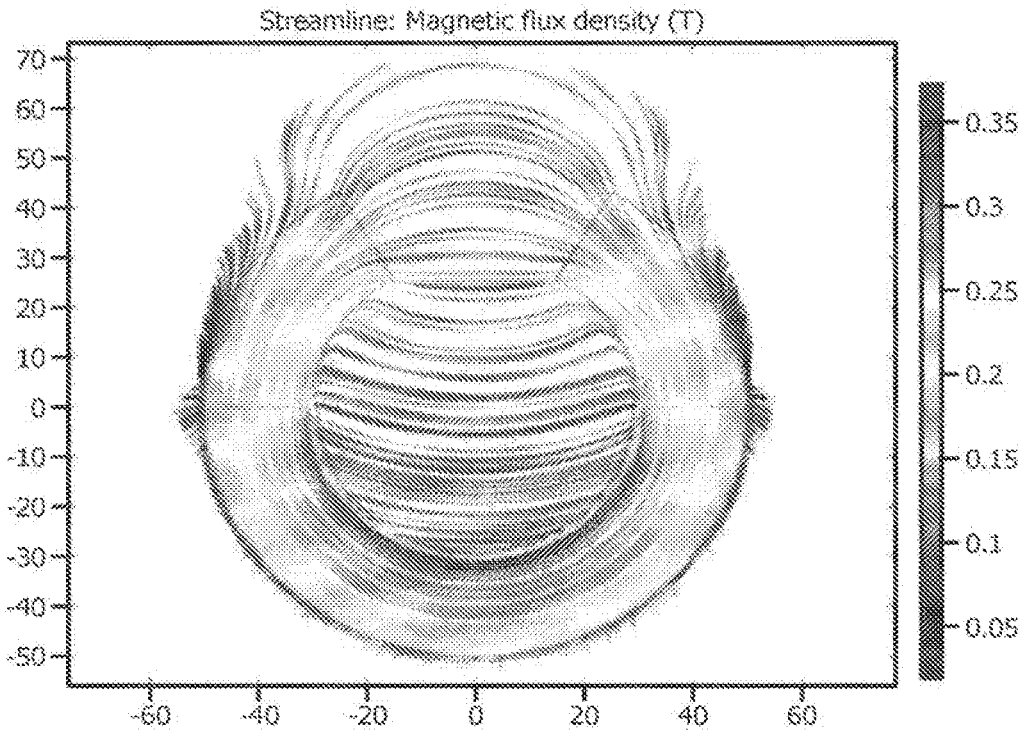
FIG. 10B is an illustration of the magnetic flux density generated by the electromagnet of FIG. 10A, in accordance with an embodiment of the present invention.
Figure 11A:
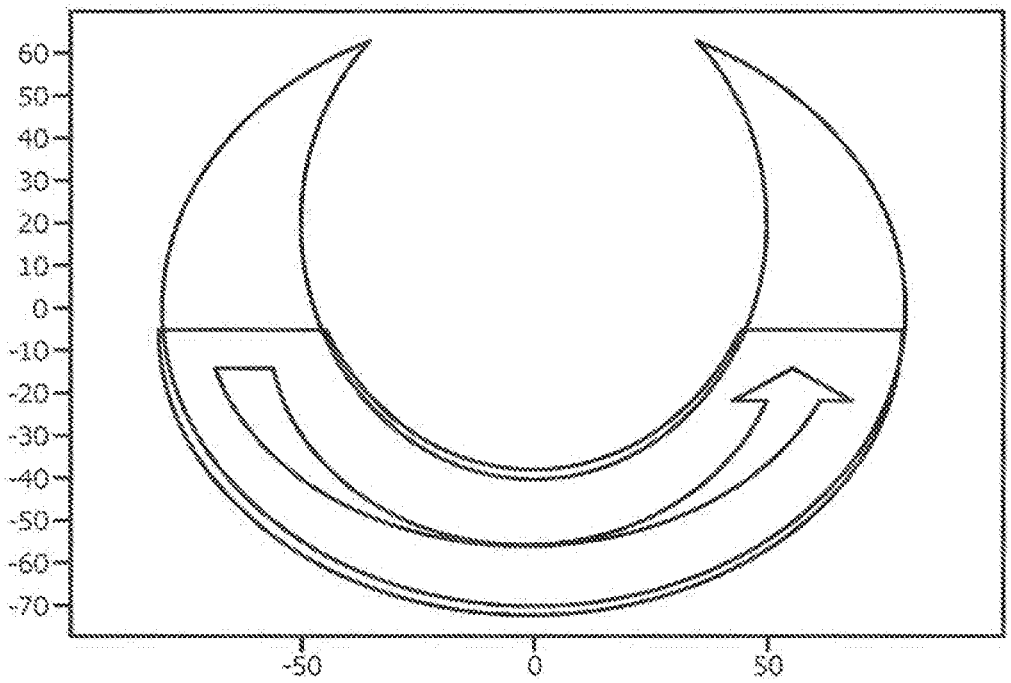
FIG. 11A is an illustration of a circular-shaped electromagnet having a single solenoid and pointed ends, in accordance with an embodiment of the present invention.
Figure 11B:
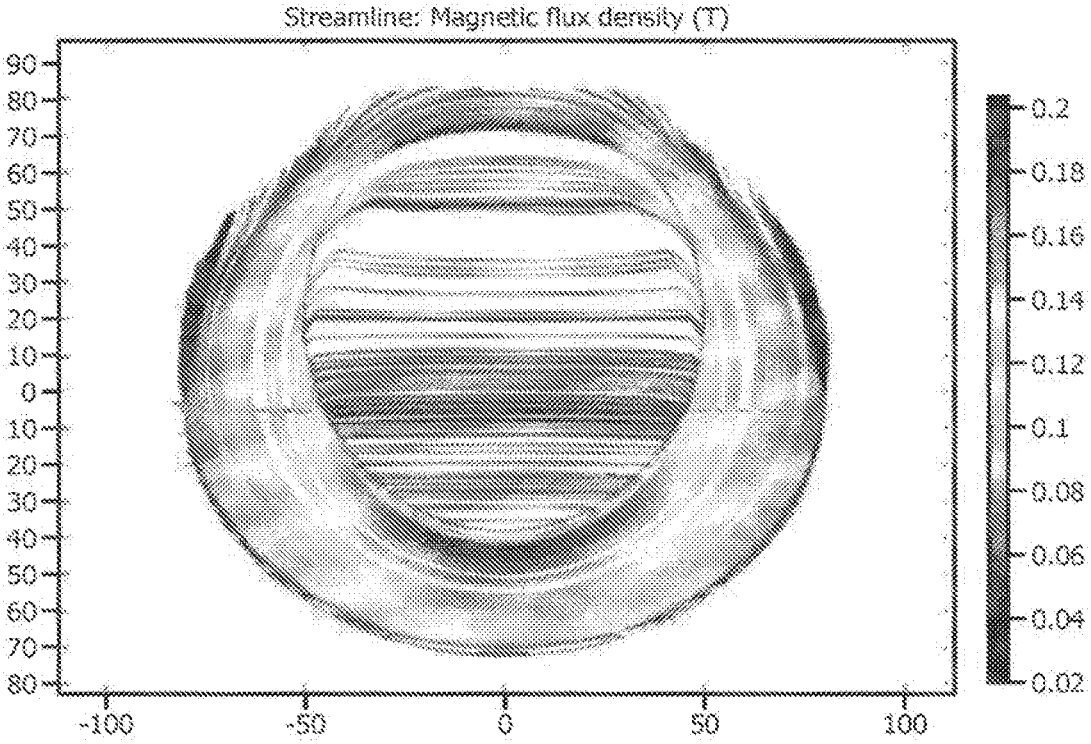
FIG. 11B is an illustration of the magnetic flux density generated by the electromagnet of FIG. 11A, in accordance with an embodiment of the present invention.
Figure 12A:
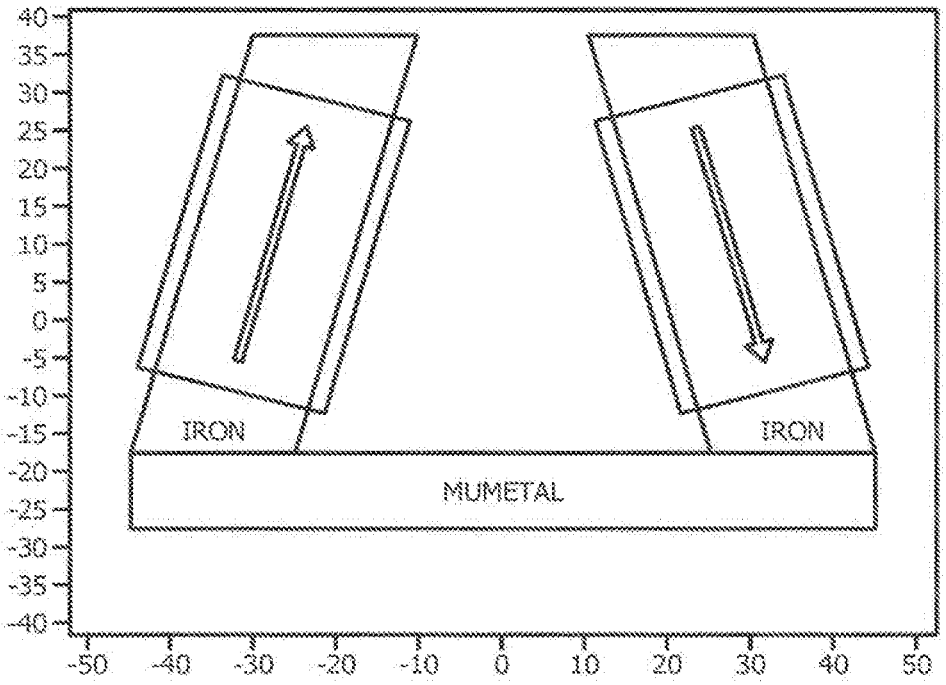
FIG. 12A is an illustration of a trapezoidal-shaped electromagnet having a single solenoid, cord cut ends and a Mu-Metal base, in accordance with an embodiment of the present invention.
Figure 12B:
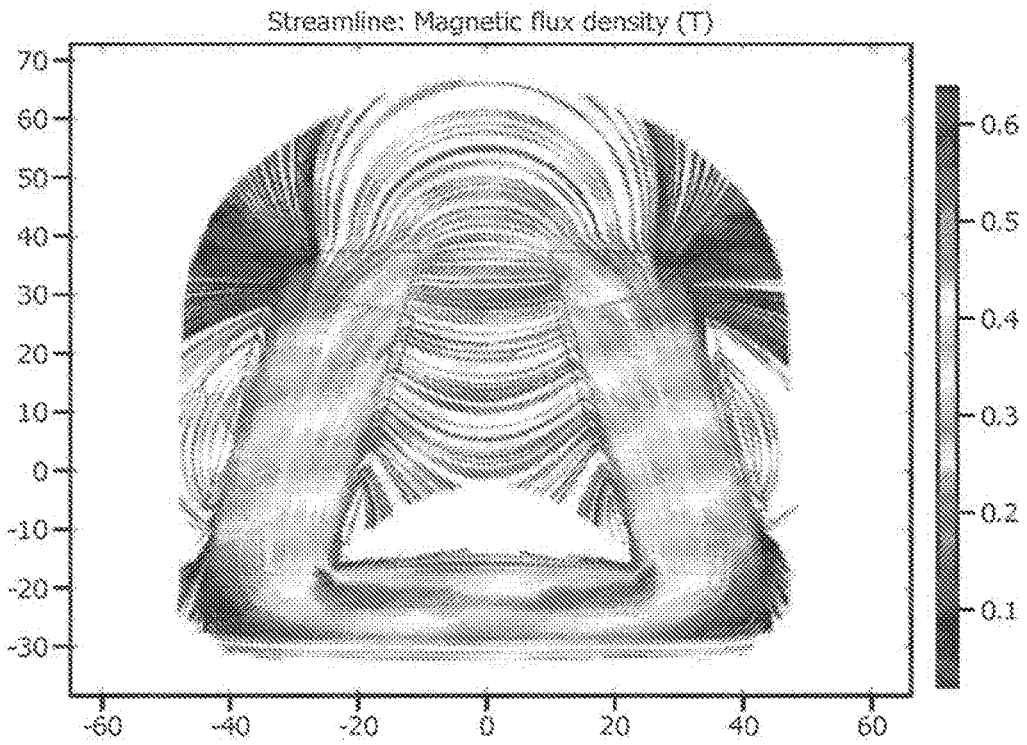
FIG. 12B is an illustration of the magnetic flux density generated by the electromagnet of FIG. 12A, in accordance with an embodiment of the present invention.
Figure 13A:
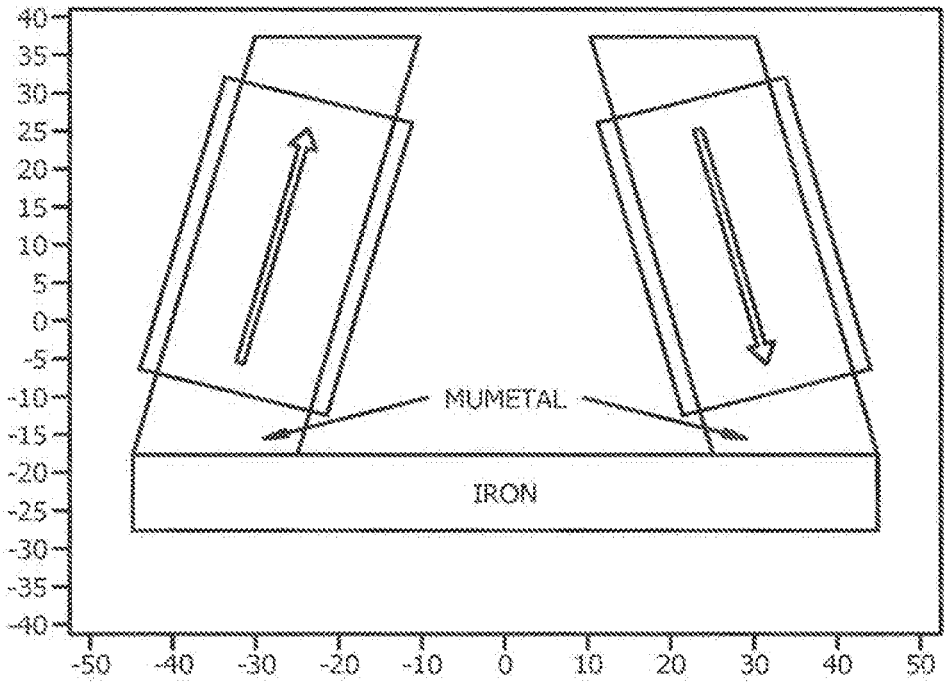
FIG. 13A is an illustration of a trapezoidal-shaped electromagnet having a single solenoid, cord cut ends and two Mu-Metal legs, in accordance with an embodiment of the present invention.
Figure 13B:
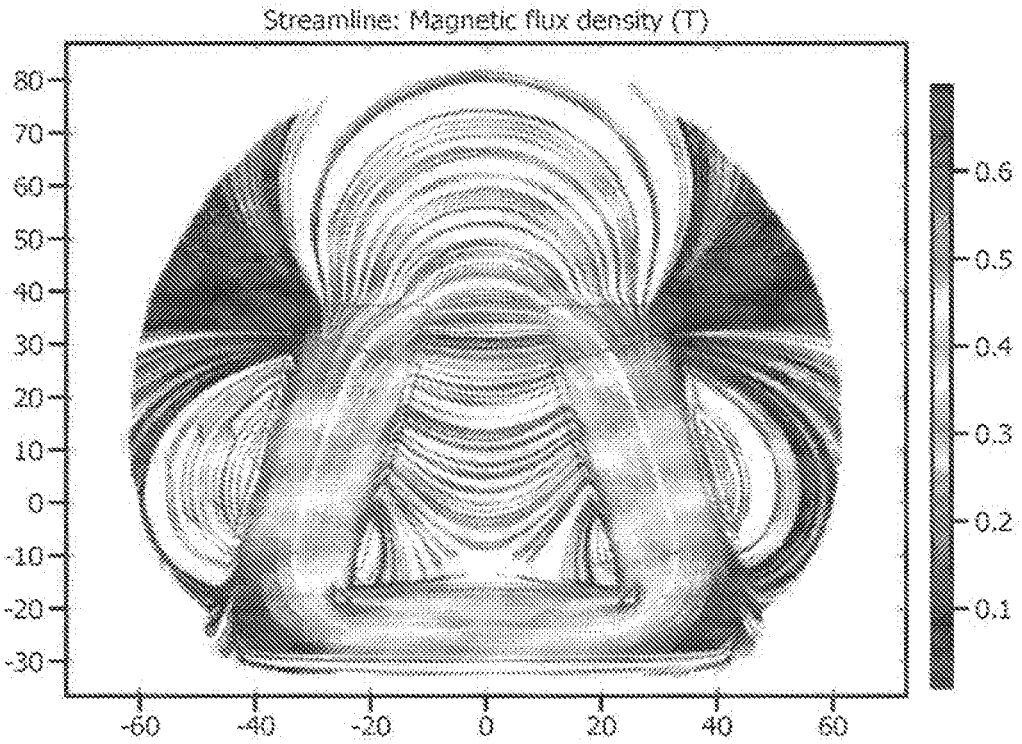
FIG. 13B is an illustration of the magnetic flux density generated by the electromagnet of FIG. 13A, in accordance with an embodiment of the present invention.
Figure 16A:
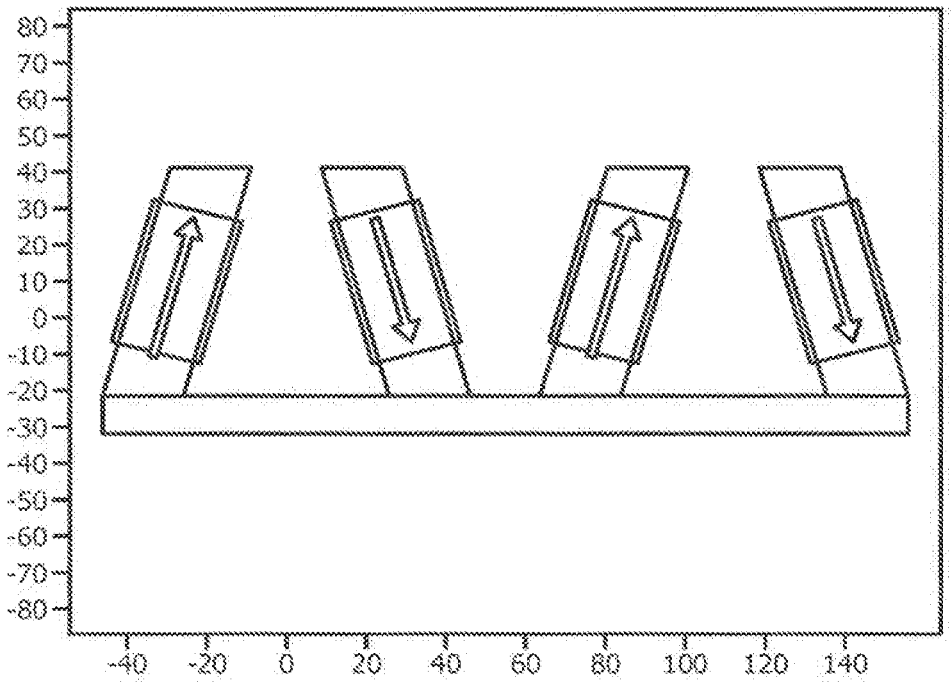
FIG. 16A is an illustration of an array of trapezoidal-shaped electromagnets having a common base, in accordance with an embodiment of the present invention.
Figure 16B:
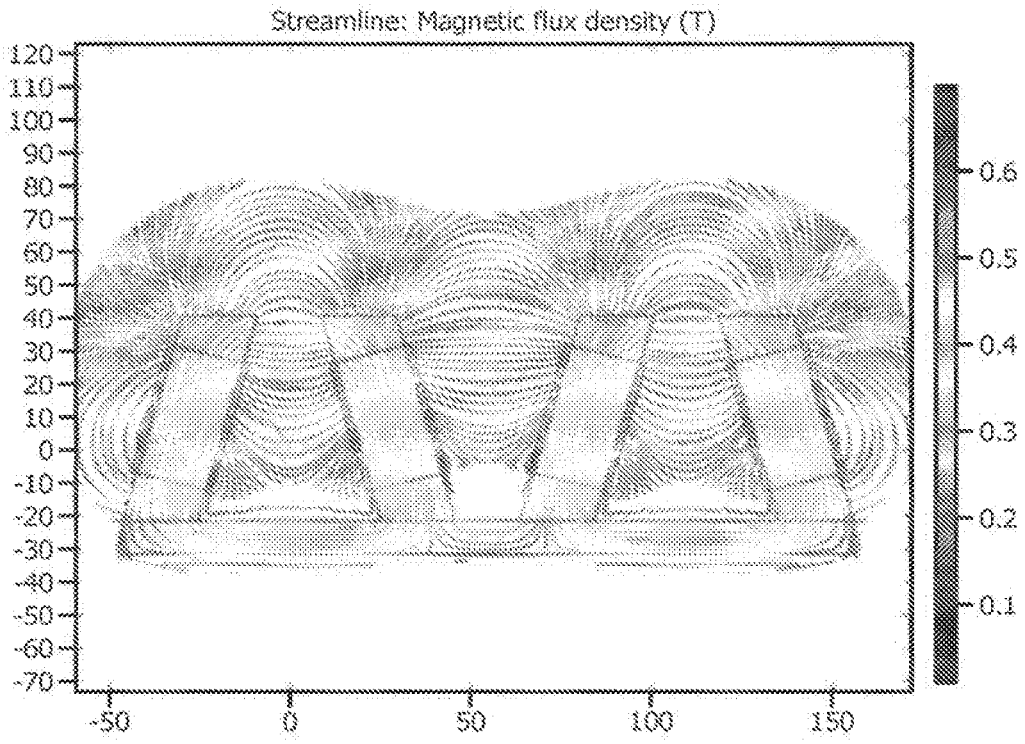
FIG. 16B is an illustration of the magnetic flux density generated by the array of electromagnets of FIG. 16A, in accordance with an embodiment of the present invention.
Figure 17A:
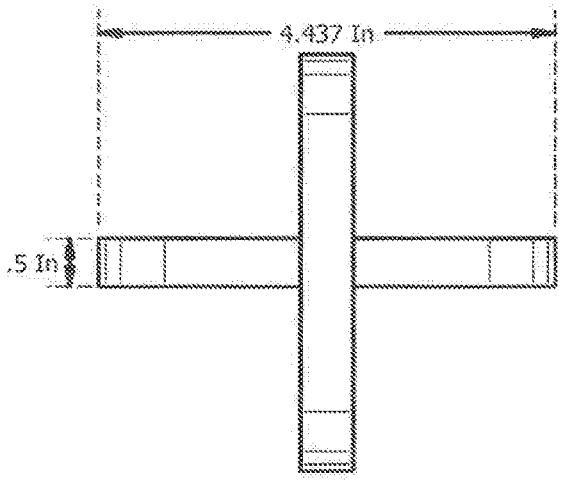
FIG. 17 is an illustration of exemplary embodiments of various shapes of the magnetic core of the electromagnet, in accordance with the present invention.
Figure 17B:
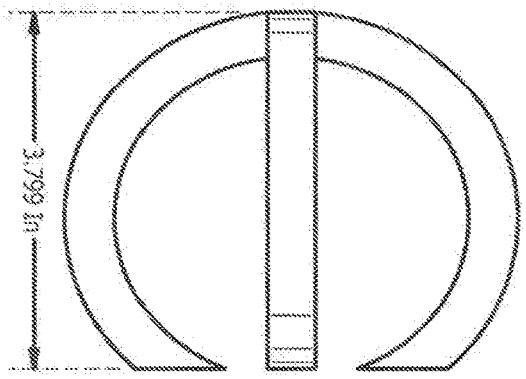
Figure 17C:
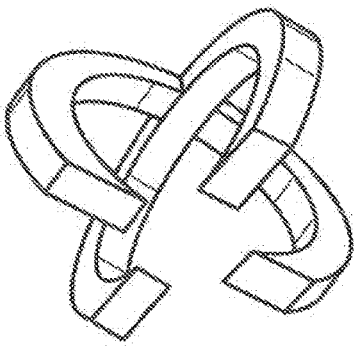
Figure 17D:
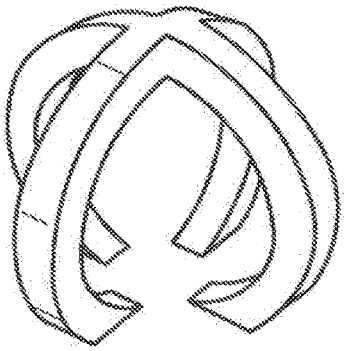
Figure 32A:
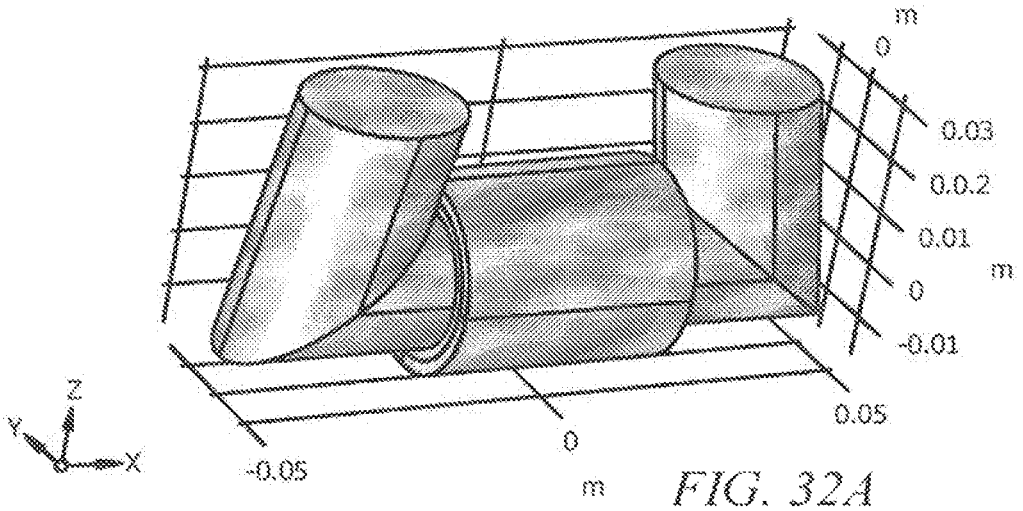
FIG. 32A is an illustration of an electromagnet formed by a one inch outside diameter trapezoid core with legs of 80 degrees, in accordance with an embodiment of the present invention.
Figure 32B:
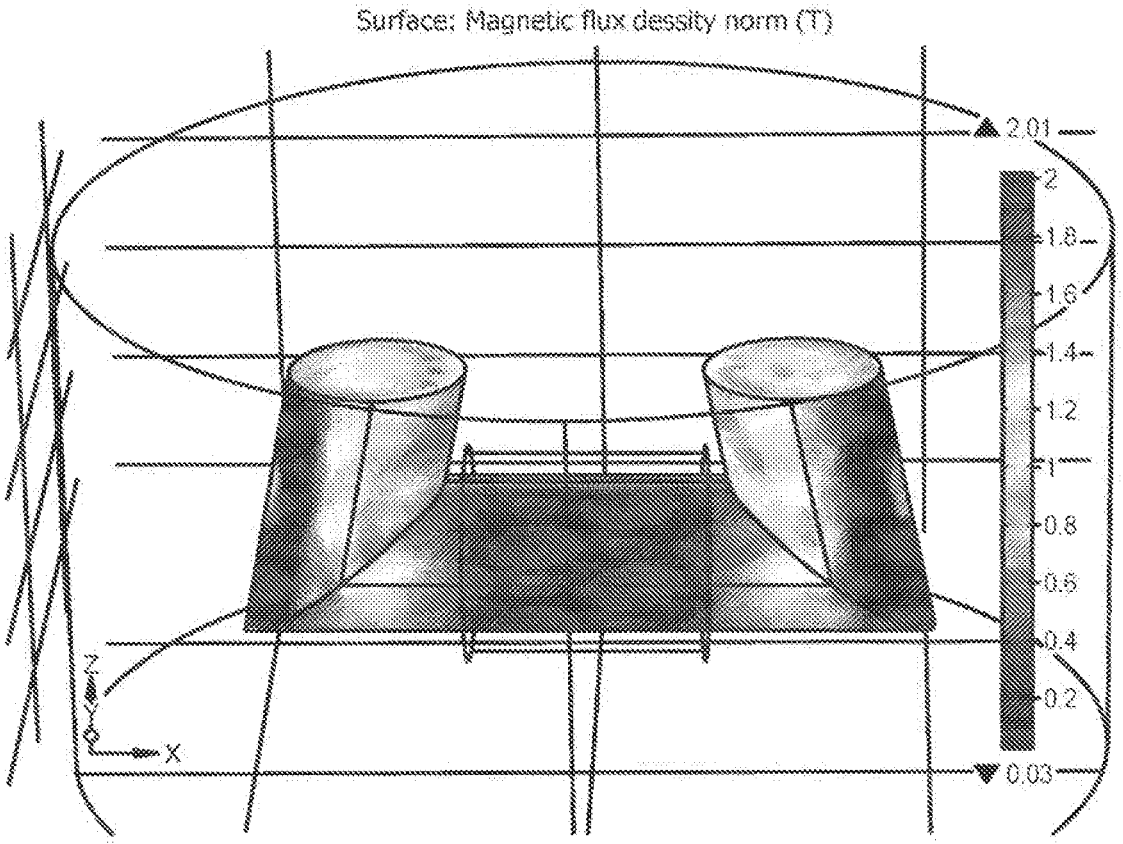
FIG. 32B is an illustration of the magnetic flux density generated by the electromagnet of FIG. 32A, in accordance with an embodiment of the present invention.
Figure 33A:
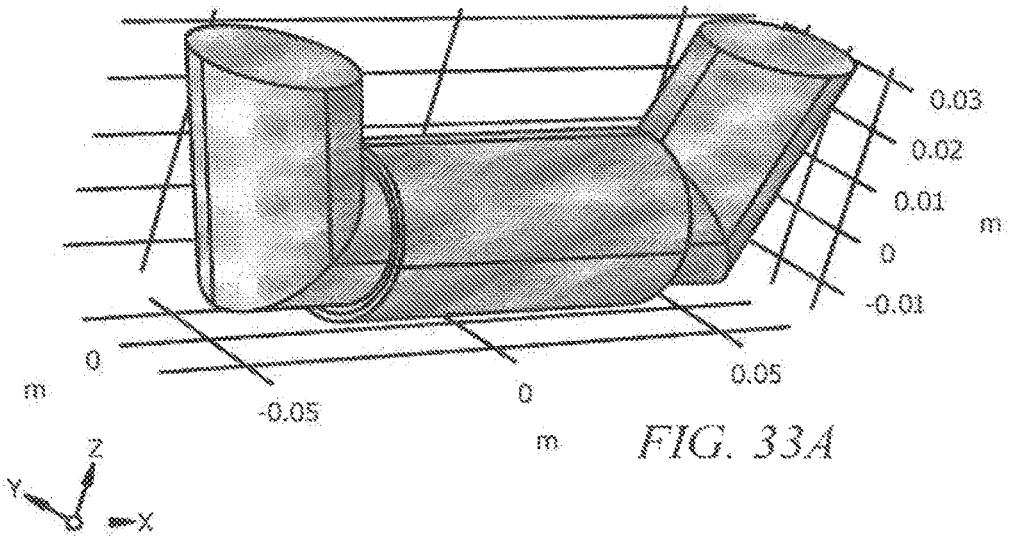
FIG. 33A is an illustration of an electromagnet formed by a one inch outside diameter trapezoid core with legs of 100 degrees, in accordance with an embodiment of the present invention.
Figure 33B:
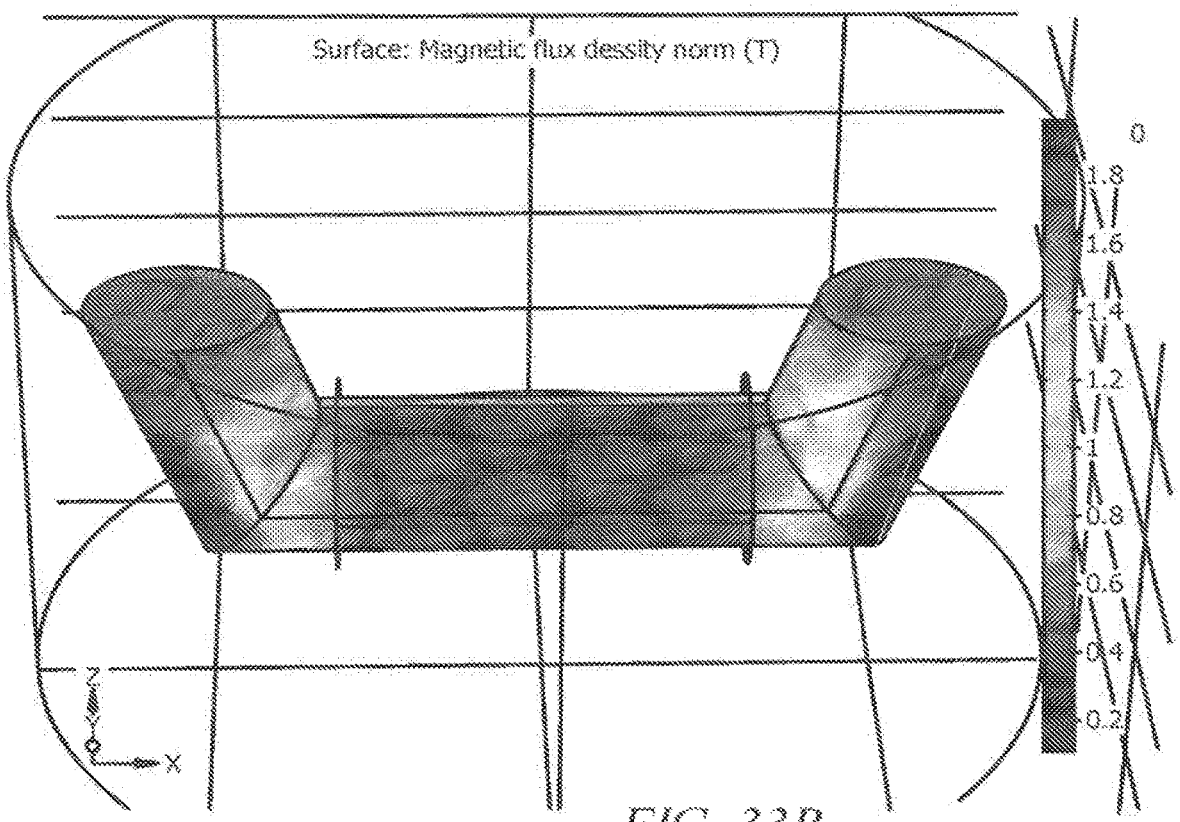
FIG. 33B is an illustration of the magnetic flux density generated by the electromagnet of FIG. 33A, in accordance with an embodiment of the present invention.

FIG. 1A illustrates a trapezoidal-shaped electromagnet having a single solenoid and the FIG. 1B illustrates the magnetic flux density generated by electromagnet of FIG. 1A. FIG. 2A illustrates a trapezoidal-shaped electromagnet having two solenoids and FIG. 2B illustrates the magnetic flux density generated by the electromagnet of FIG. 2A. FIG. 3A illustrates a trapezoidal-shaped electromagnet having two solenoids and FIG. 3B illustrates the magnetic flux density generated by electromagnet of FIG. 3A. FIG. 4A illustrates a trapezoidal-shaped electromagnet having a single solenoid, sharp corners and radial cut ends and FIG. 4B illustrates the magnetic flux density generated by the electromagnet of FIG. 4A. FIG. 5A illustrates a trapezoidal-shaped electromagnet having a single solenoid, sharp corners and conical cut ends and FIG. 5B illustrates the magnetic flux density generated by the electromagnet of FIG. 5A. FIG. 6A illustrates a trapezoidal-shaped electromagnet having a single solenoid, radial corners and cord cut ends and FIG. 6B illustrates the magnetic flux density generated by the electromagnet of FIG. 6A. FIG. 7A illustrates a trapezoidal-shaped electromagnet having a single solenoid, sharp corners and cord cut ends and FIG. 7B illustrates the magnetic flux density generated by the electromagnet of FIG. 7A. FIG. 12A illustrates a trapezoidal-shaped electromagnet having a single solenoid, cord cut ends and a Mu-metal base and FIG. 12B illustrates the magnetic flux density generated by the electromagnet of FIG. 12A. FIG. 13A illustrates a trapezoidal-shaped electromagnet having a single solenoid, cord cut ends and two Mu-metal legs and FIG. 13B illustrates the magnetic flux density generated by the electromagnet of FIG. 13A. FIG. 16A illustrates an array of trapezoidal-shaped electromagnets having a common base and FIG. 16B illustrates the magnetic flux density generated by the array of electromagnets of FIG. 16A. FIG. 32A illustrates an electromagnet formed by a one inch outside diameter trapezoid core with legs of 80 degrees and FIG. 32B illustrates the magnetic flux density generated by the electromagnet of FIG. 32A. FIG. 33A illustrates an electromagnet formed by a one inch outside diameter trapezoid core with legs of 100 degrees and FIG. 33B illustrates the magnetic flux density generated by the electromagnet of FIG. 33A. In additional embodiments, other bent solenoid designs, such as semi-circles and other geometries are within the scope of the present invention. For example, FIG. 8A illustrates a hexagonal-shaped electromagnet having a single solenoid, sharp corners and cord cut ends and FIG. 8B illustrates the magnetic flux density generated by the electromagnet of FIG. 8A. FIG. 9A illustrates a circular-shaped electromagnet having a single solenoid and cord cut ends and FIG. 9B illustrates the magnetic flux density generated by the electromagnet of FIG. 9A. FIG. 10A illustrates a circular-shaped electromagnet having a single solenoid and radial cut ends and FIG. 10B illustrates the magnetic flux density generated by the electromagnet of FIG. 10A. FIG. 11A illustrates a circular-shaped electromagnet having a single solenoid and pointed ends and the FIG. 11B illustrates the magnetic flux density generated by the electromagnet of FIG. 11A.

Figure 14A:
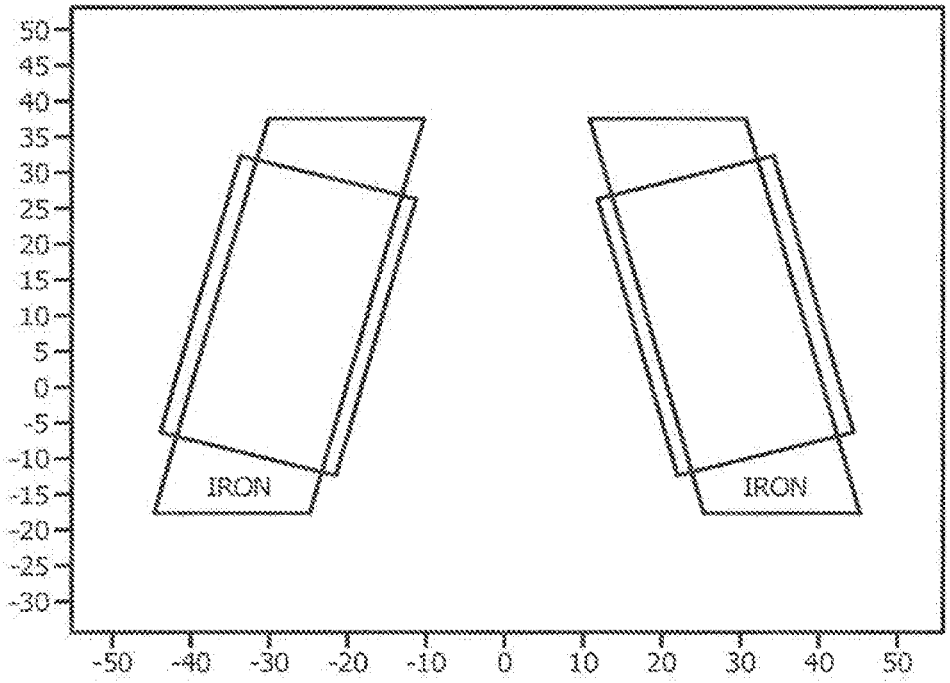
FIG. 14A is an illustration of two separate solenoids positioned to have one end in close proximity to the other, in accordance with an embodiment of the present invention.
Figure 14B:
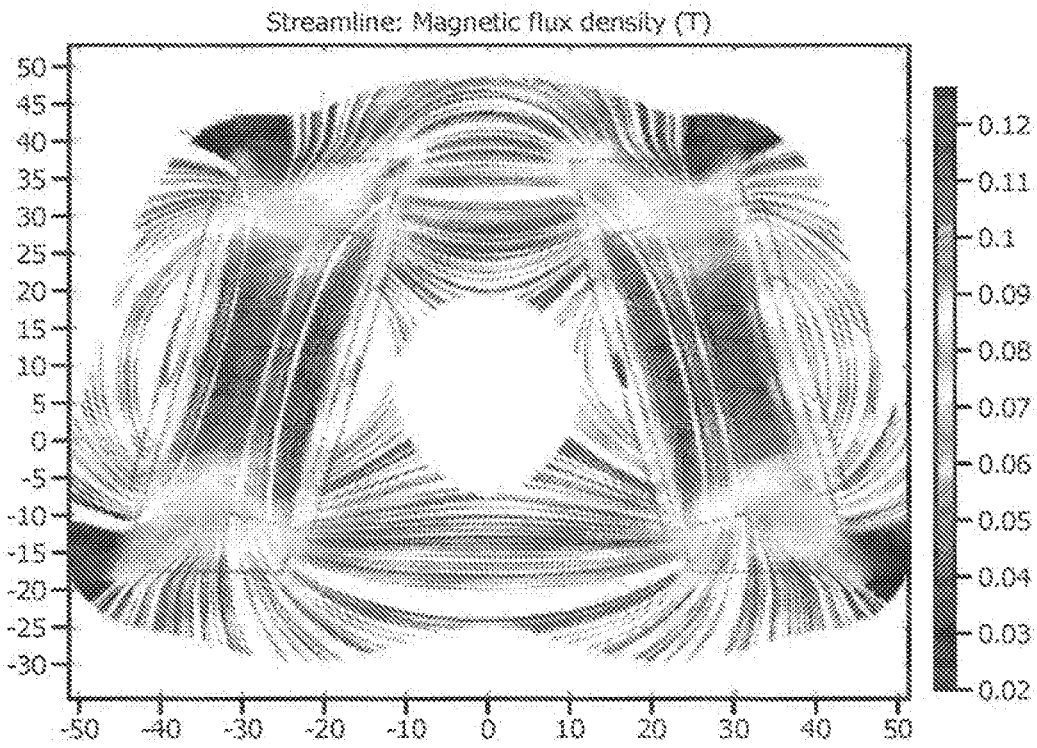
FIG. 14B is an illustration of the magnetic flux density generated by the two solenoids of FIG. 14A, in accordance with an embodiment of the present invention.
Figure 15A:
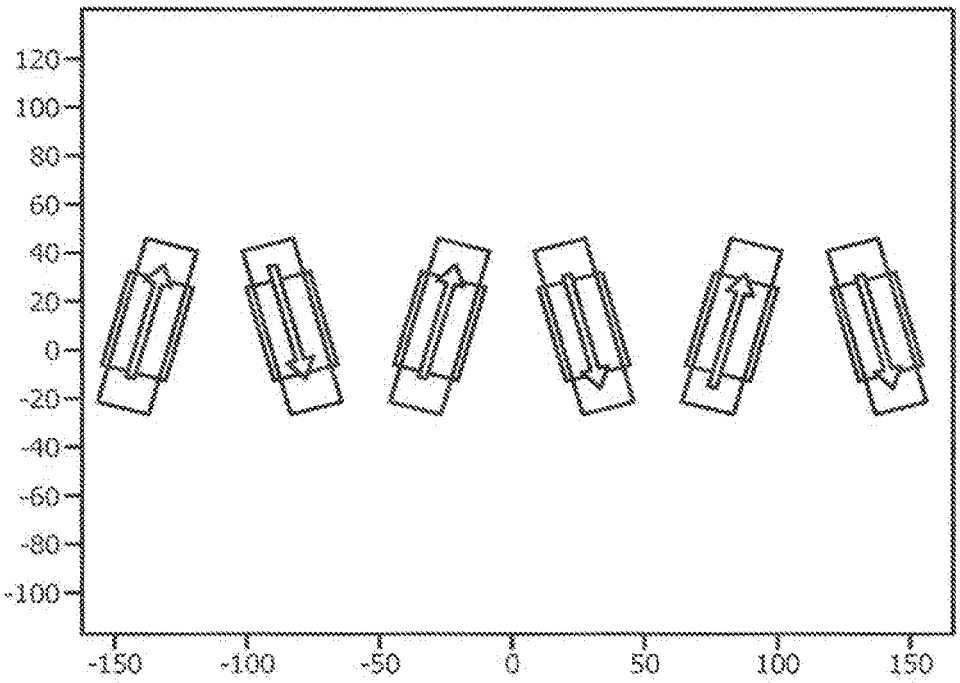
FIG. 15A is an illustration of an array of separate solenoids, wherein pairs of solenoids are positioned to have one end in close proximity to one other solenoid, in accordance with an embodiment of the present invention.
Figure 15B:
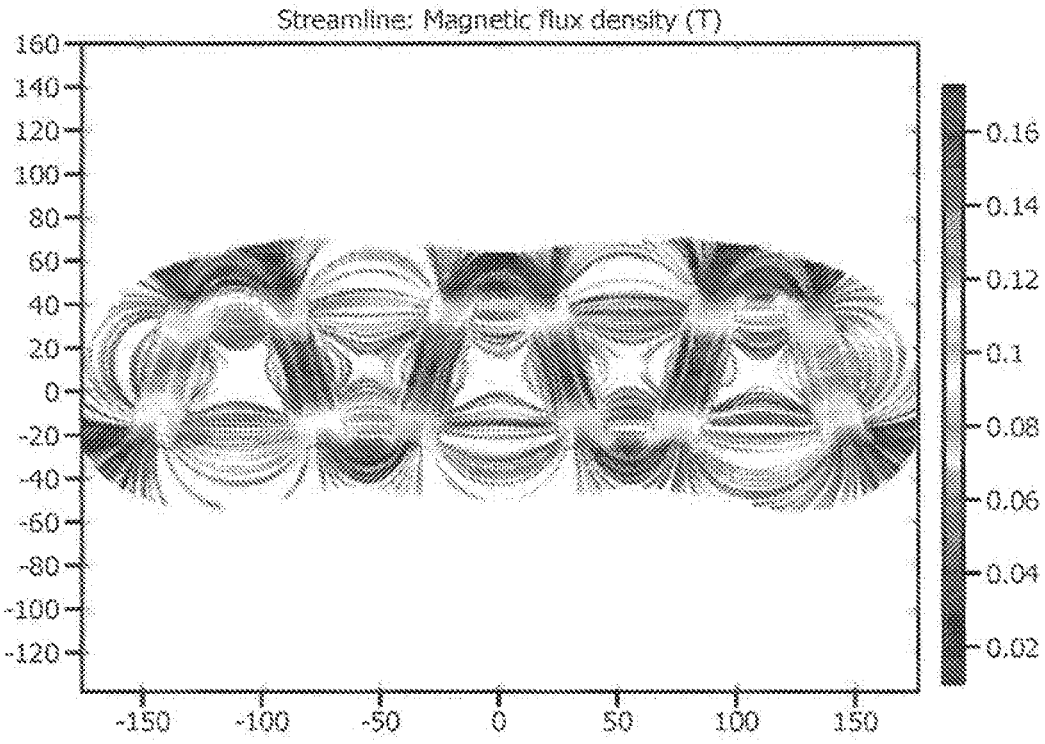
FIG. 15B is an illustration of the magnetic flux density generated by the solenoids of the array of FIG. 15A, in accordance with an embodiment of the present invention.
Figure 23:
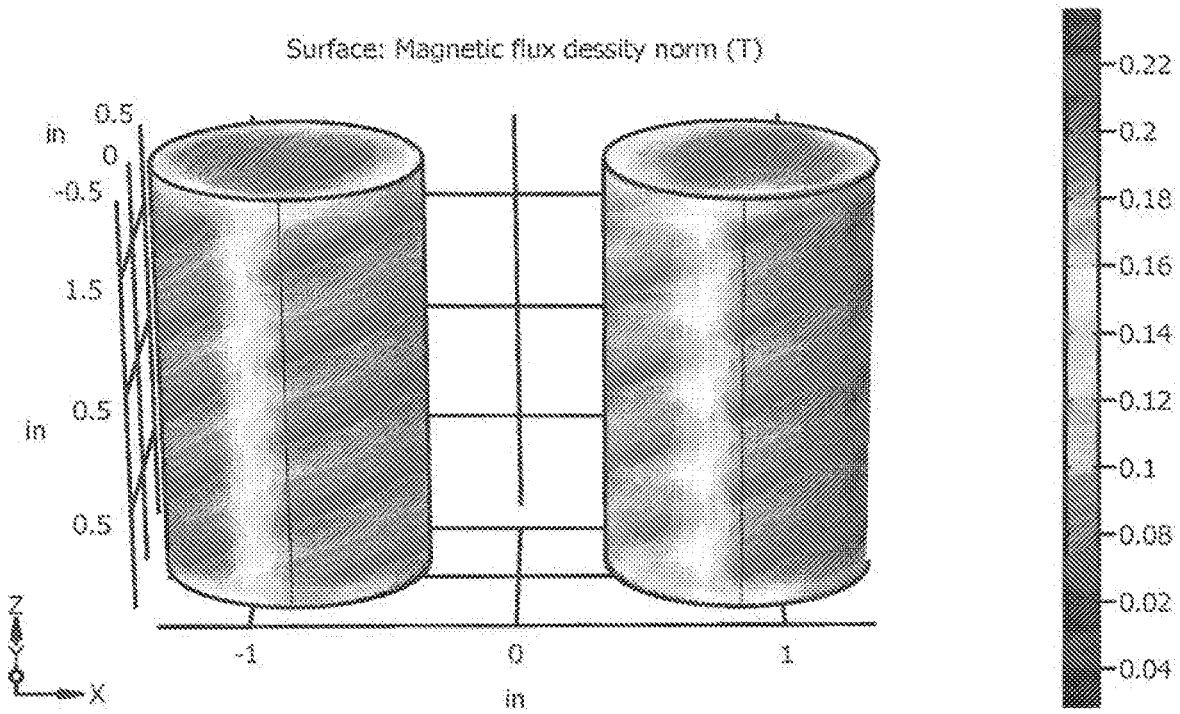
FIG. 23 is an illustration of an electromagnet formed by two straight cores with no backplate, and the magnetic flux density generated by the electromagnet, in accordance with an embodiment of the present invention.
Figure 24A:
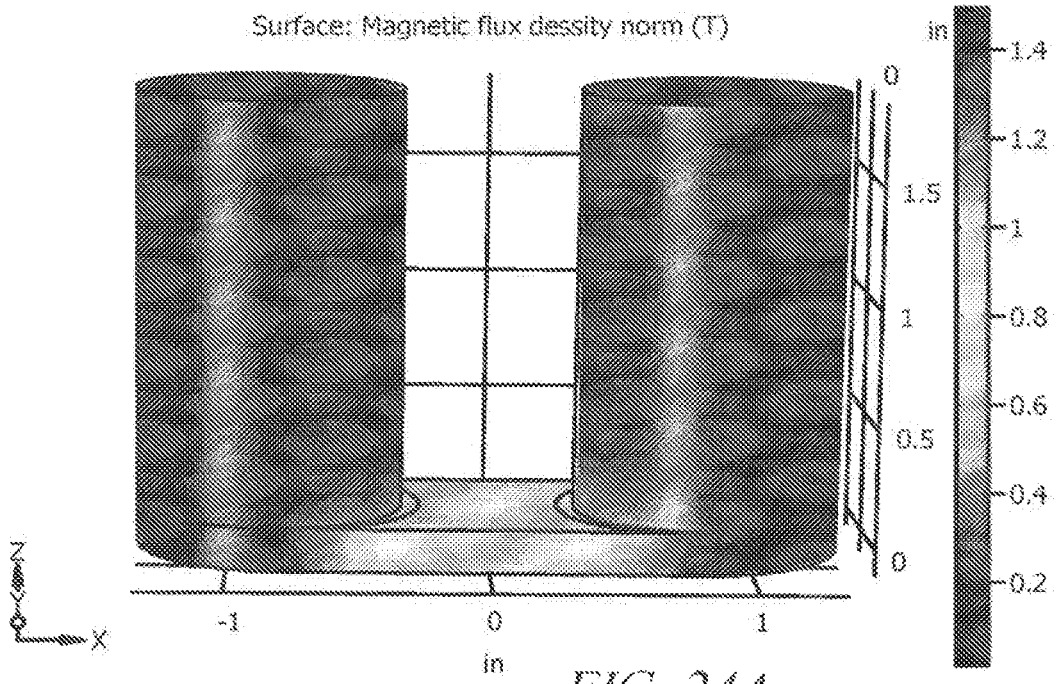
FIG. 24A is an illustration of an electromagnet formed by two straight cores with a backplate, and the magnetic flux density generated by the electromagnet with no field limitation, in accordance with an embodiment of the present invention.
Figure 24B:
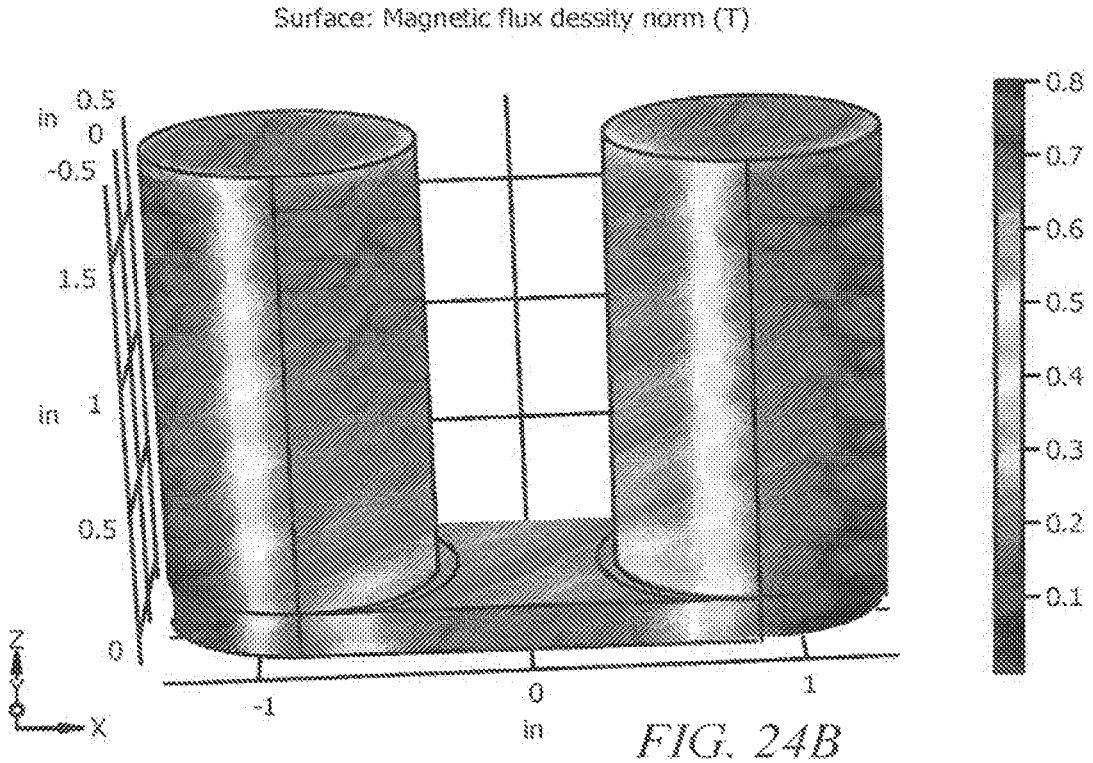
FIG. 24B is an illustration of an electromagnet formed by two straight cores with a backplate and the magnetic flux density generated by the electromagnet with a field limitation of 0.8 T, in accordance with an embodiment of the present invention.
Figure 25A:
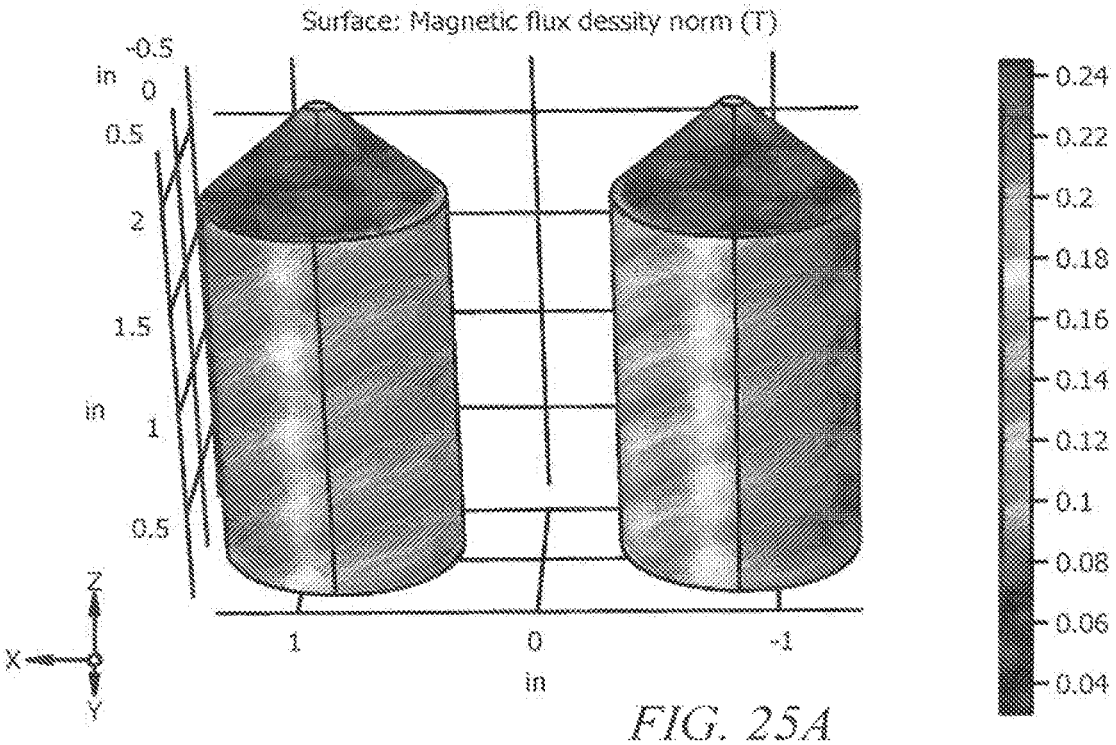
FIG. 25A is an illustration of a first perspective of an electromagnet formed by two straight cores, with convex conical tip cores and no backplate, and the magnetic flux density generated by the electromagnet with no field limitation, in accordance with an embodiment of the present invention.
Figure 25B:
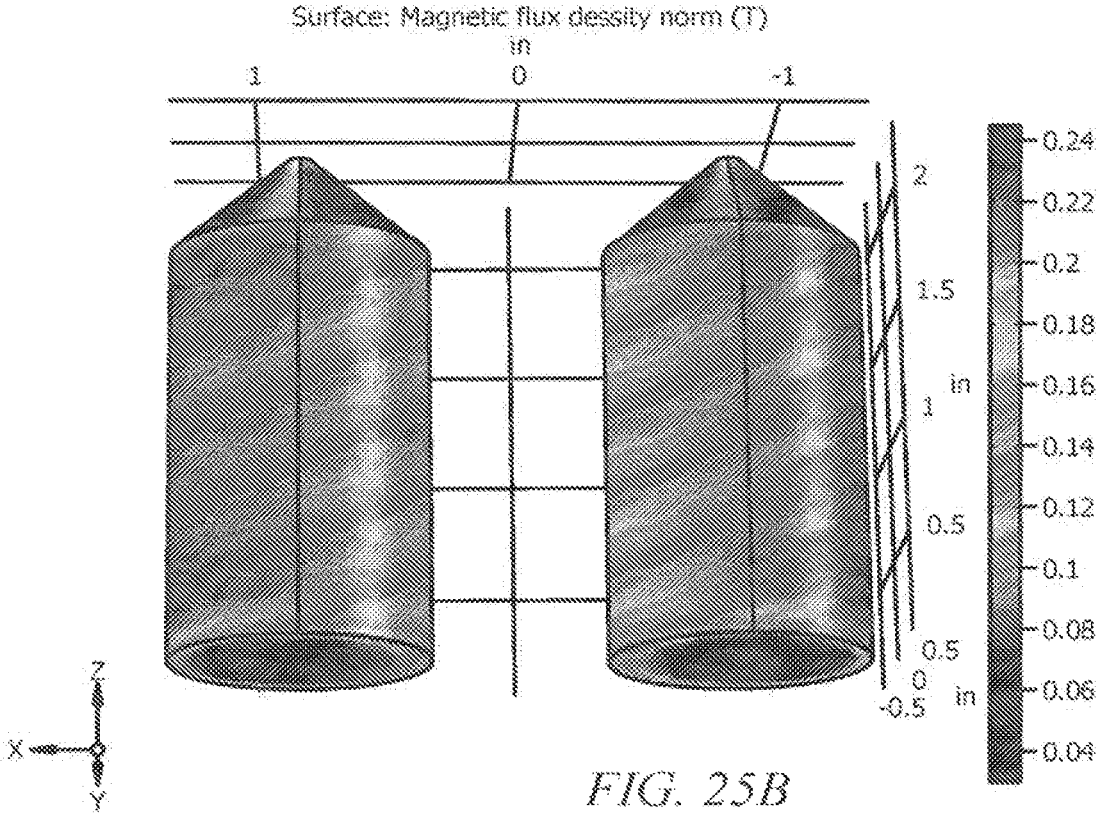
FIG. 25B is an illustration of a second perspective of an electromagnet formed by two straight cores with convex conical tip cores and no backplate and the magnetic flux density generated by the electromagnet with no field limitation, in accordance with an embodiment of the present invention.
Figure 26A:
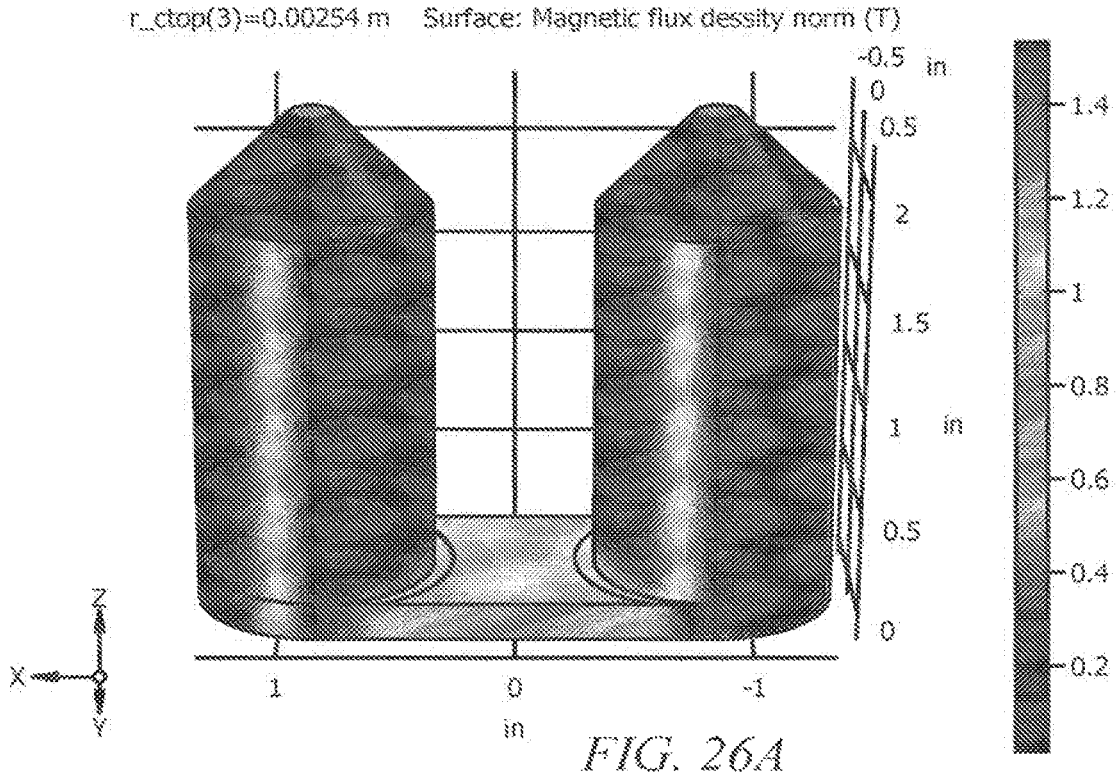
FIG. 26A is an illustration of a first perspective of an electromagnet formed by two straight cores, with convex conical tip cores and a backplate, and the magnetic flux density generated by the electromagnet with no field limitation, in accordance with an embodiment of the present invention.
Figure 26B:
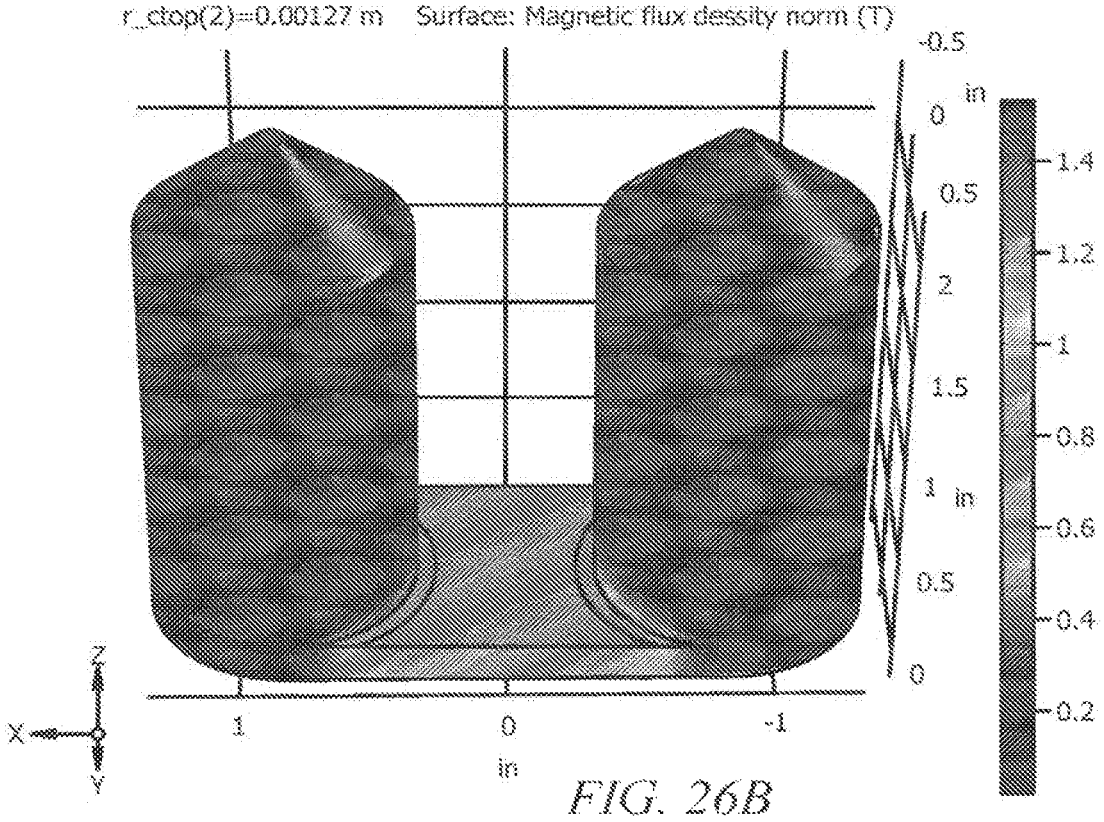
FIG. 26B is an illustration of a second perspective of an electromagnet formed by two straight cores, with convex conical tip cores and with a backplate, and the magnetic flux density generated by the electromagnet with no field limitation, in accordance with an embodiment of the present invention.
Figure 27A:
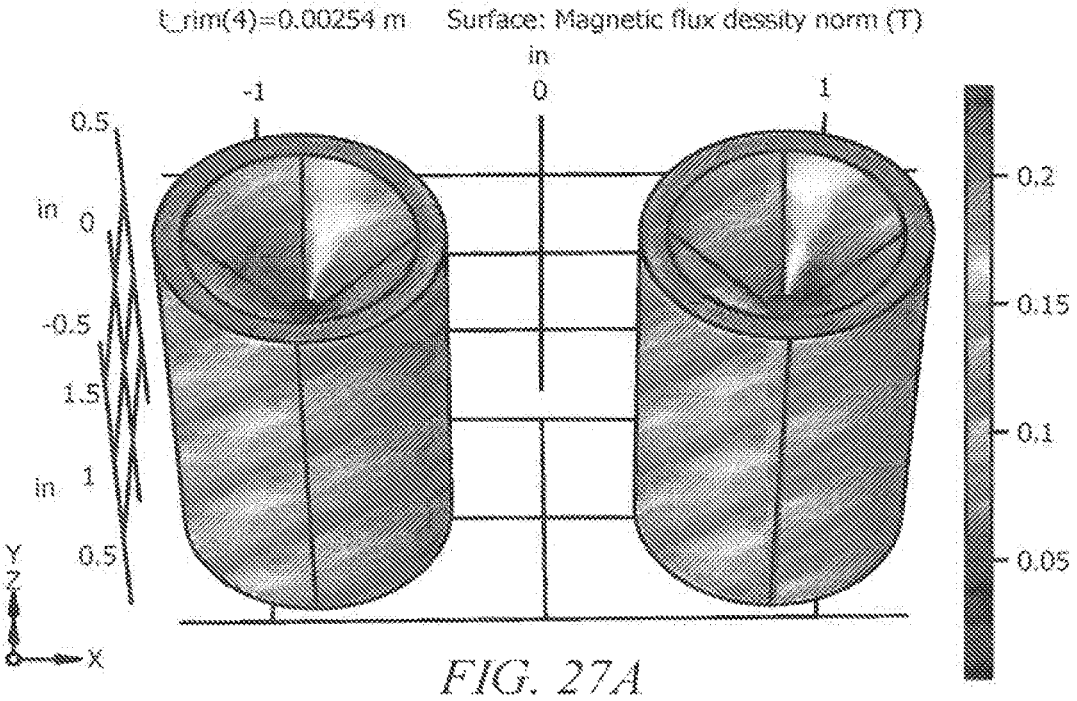
FIG. 27A is an illustration of an electromagnet formed by two straight cores, with concave conical tip cores and no backplate, and the magnetic flux density generated by the electromagnet with a rim width of 2.54 mm, in accordance with an embodiment of the present invention.
Figure 27B:
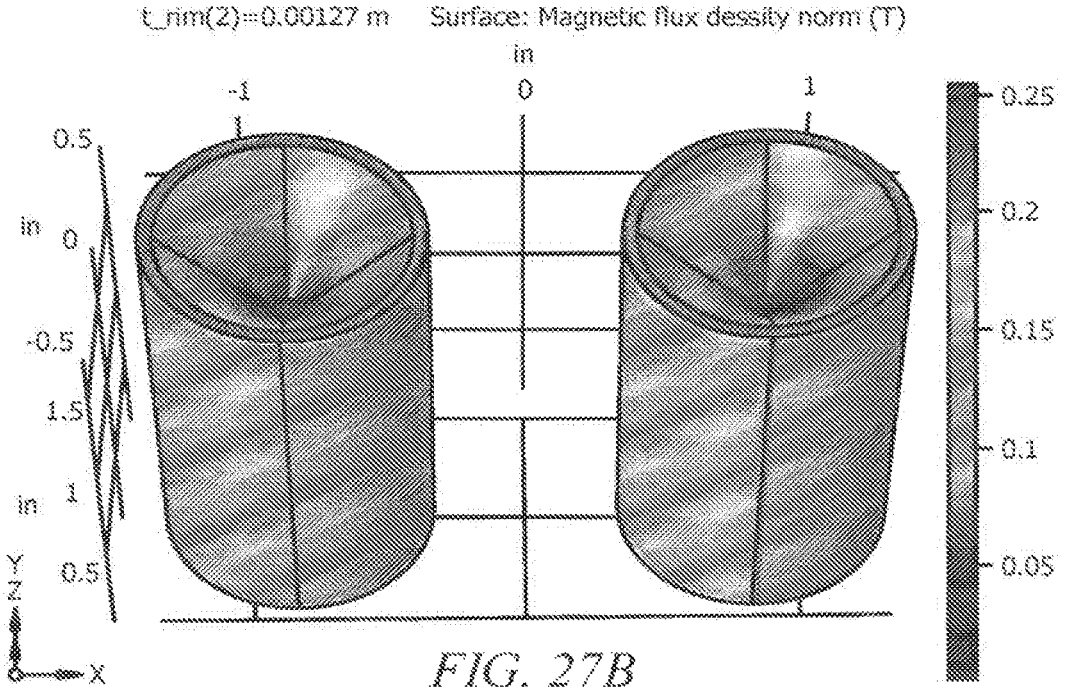
FIG. 27B is an illustration of an electromagnet formed by two straight cores, with concave conical tip cores and no backplate, and the magnetic flux density generated by the electromagnet with a rim width of 1.27 mm, in accordance with an embodiment of the present invention.
Figure 27C:
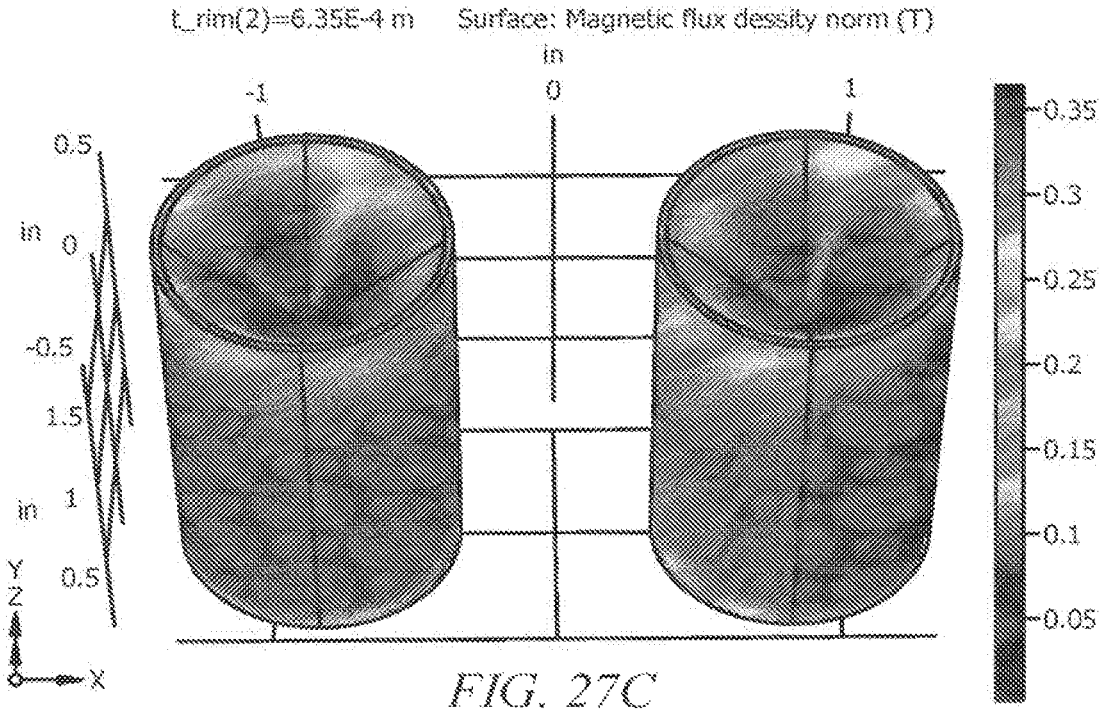
FIG. 27C is an illustration of an electromagnet formed by two straight cores, with concave conical tip cores and no backplate, and the magnetic flux density generated by the electromagnet with a rim width of 0.635 mm, in accordance with an embodiment of the present invention.
Figure 27D:
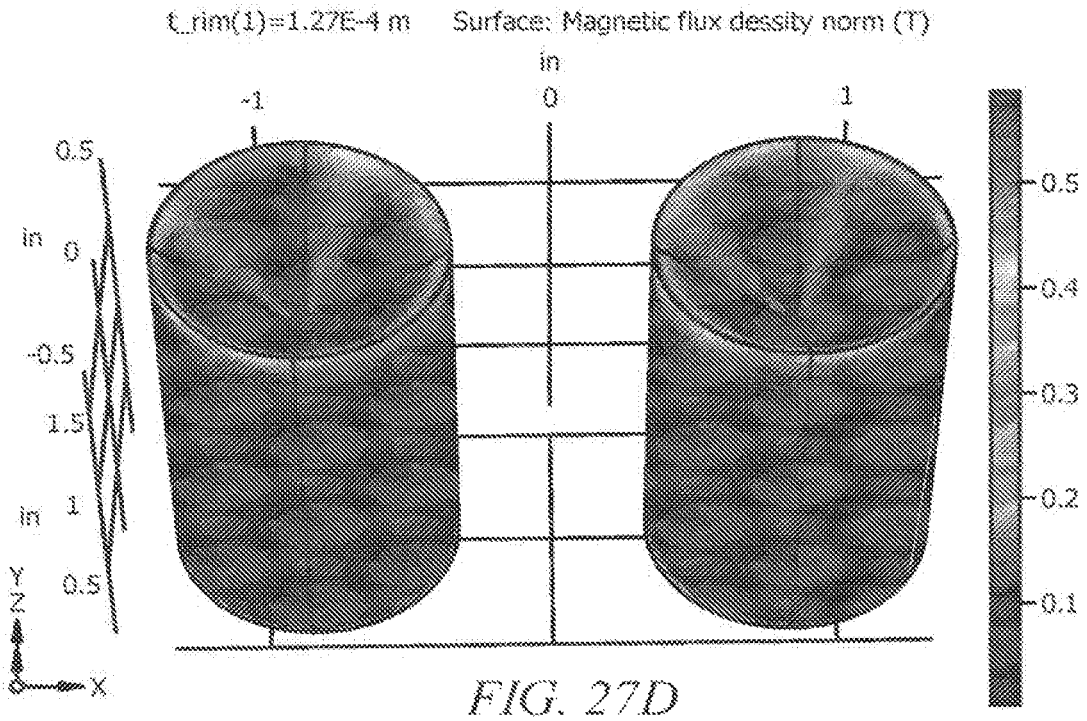
FIG. 27D is an illustration of an electromagnet formed by two straight cores, with concave conical tip cores and no backplate, and the magnetic flux density generated by the electromagnet with a rim width of 0.27 mm, in accordance with an embodiment of the present invention.
Figure 28A:
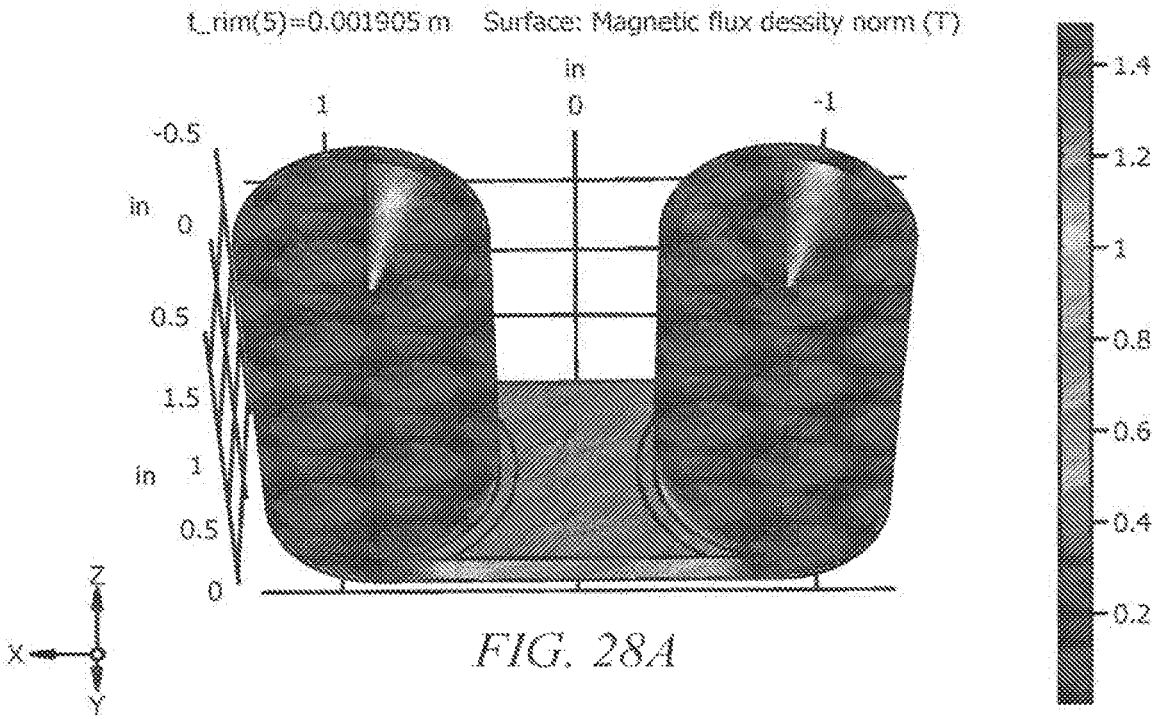
FIG. 28A is an illustration of an electromagnet formed by two straight cores, with concave conical tip cores and with a backplate, and the magnetic flux density generated by the electromagnet with a rim width of 1.91 mm, in accordance with an embodiment of the present invention.
Figure 28B:
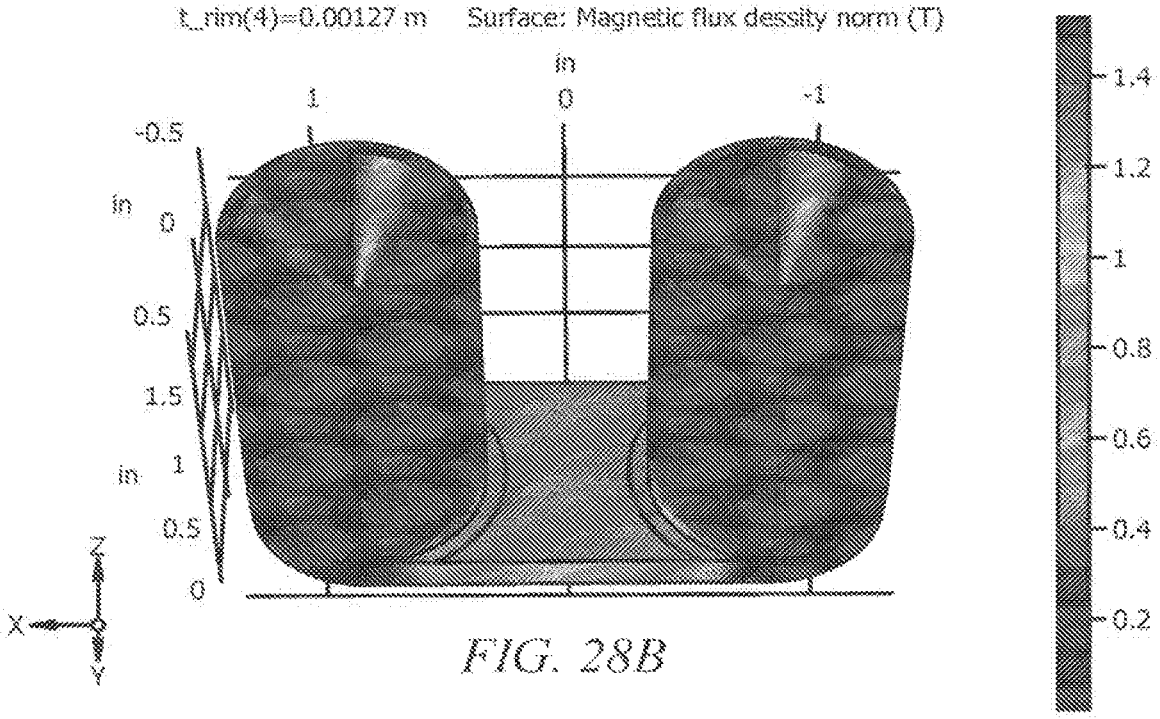
FIG. 28B is an illustration of an electromagnet formed by two straight cores, with concave conical tip cores and with a backplate, and the magnetic flux density generated by the electromagnet with a rim width of 1.27 mm, in accordance with an embodiment of the present invention.
Figure 28C:
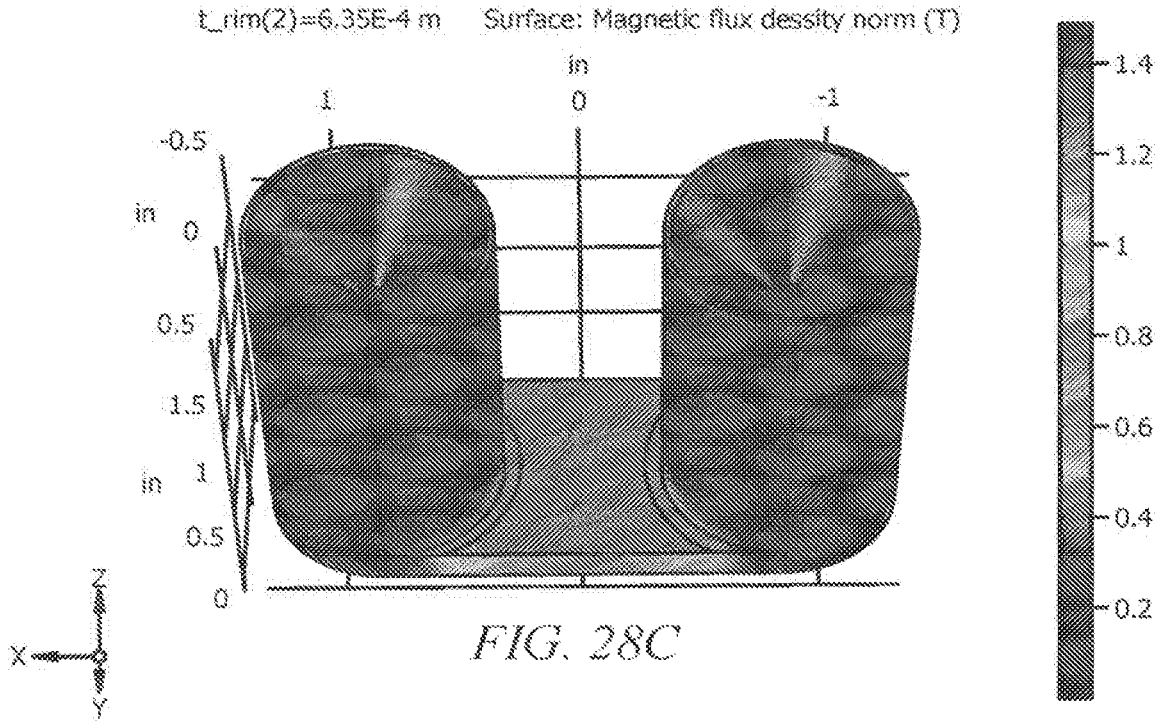
FIG. 28C is an illustration of an electromagnet formed by two straight cores, with concave conical tip cores and with a backplate, and the magnetic flux density generated by the electromagnet with a rim width of 0.635 mm, in accordance with an embodiment of the present invention.
Figure 28D:
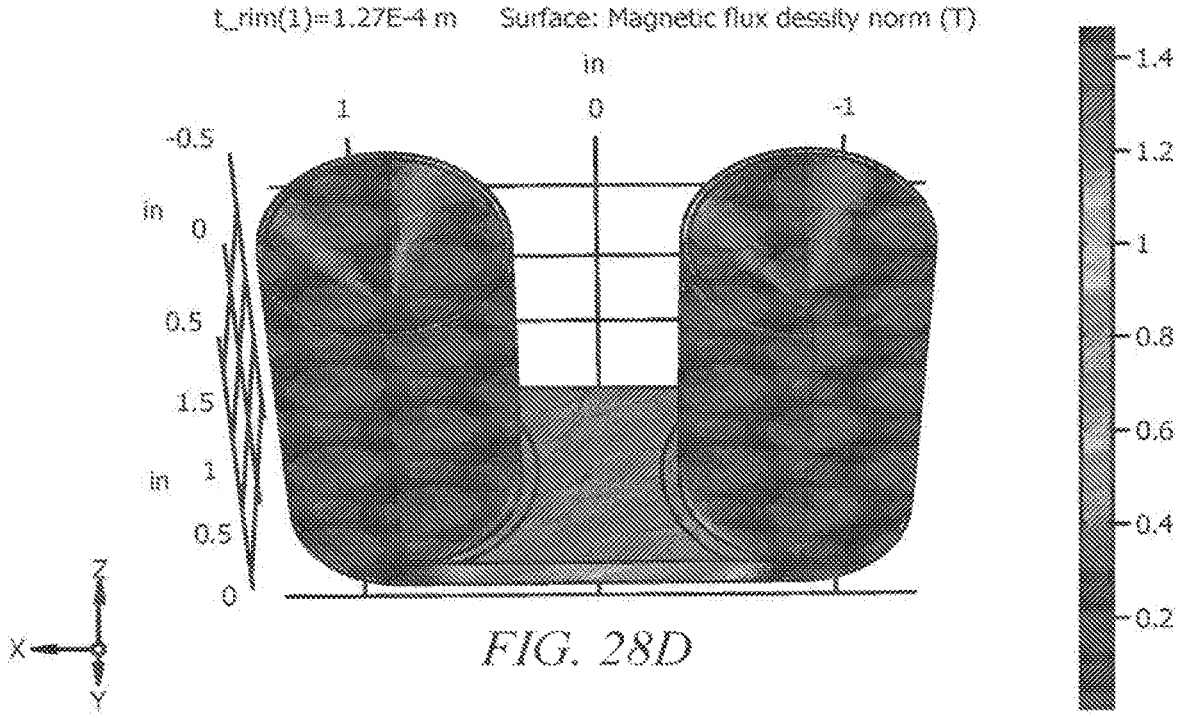
FIG. 28D is an illustration of an electromagnet formed by two straight cores, with concave conical tip cores and with a backplate, and the magnetic flux density generated by the electromagnet with a rim width of 0.127 mm, in accordance with an embodiment of the present invention.
Figure 29A:
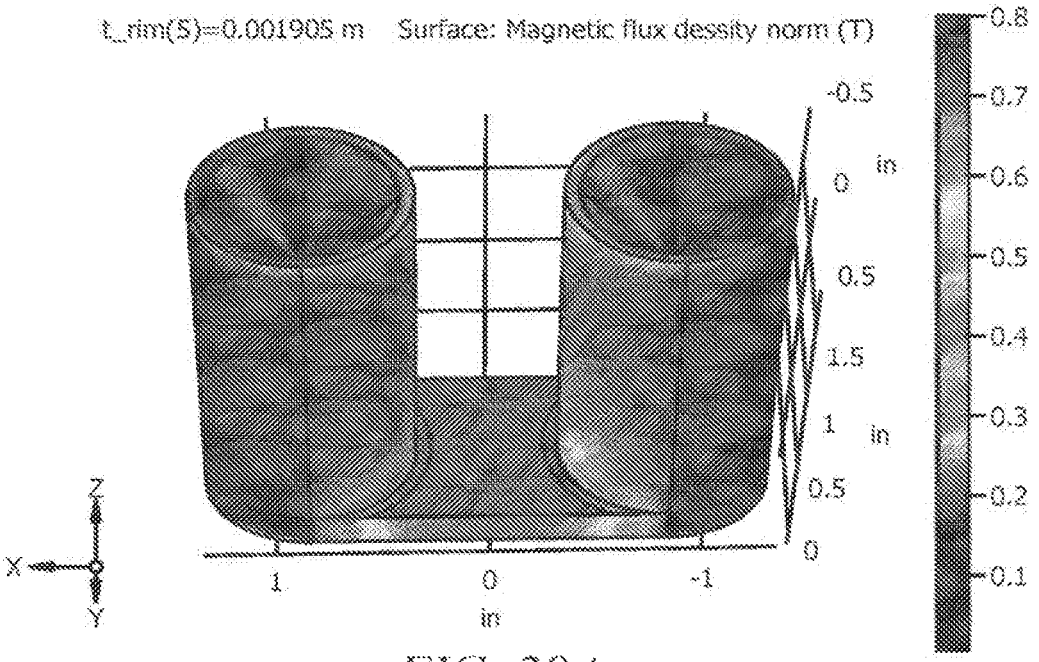
FIG. 29A is an illustration of an electromagnet formed by two straight cores, with concave conical tip cores and with a backplate, and the magnetic flux density generated by the electromagnet with a rim width of 1.91 mm and field limited to 0.8 T, in accordance with an embodiment of the present invention.
Figure 29B:
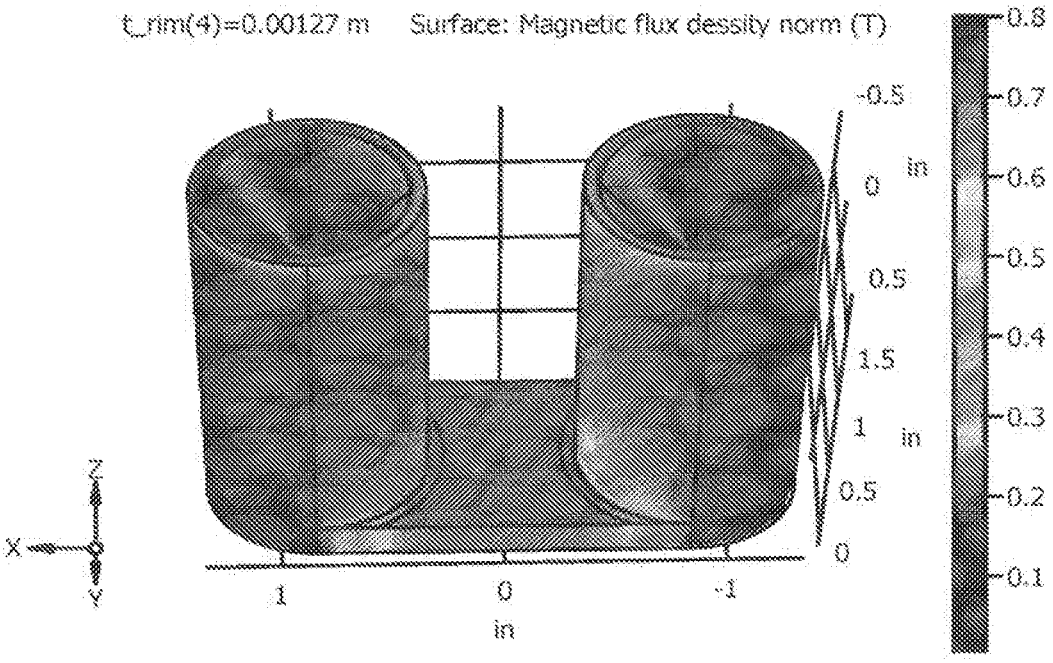
FIG. 29B is an illustration of an electromagnet formed by two straight cores, with concave conical tip cores and with a backplate, and the magnetic flux density generated by the electromagnet with a rim width of 1.27 mm and field limited to 0.8 T, in accordance with an embodiment of the present invention.
Figure 29C:
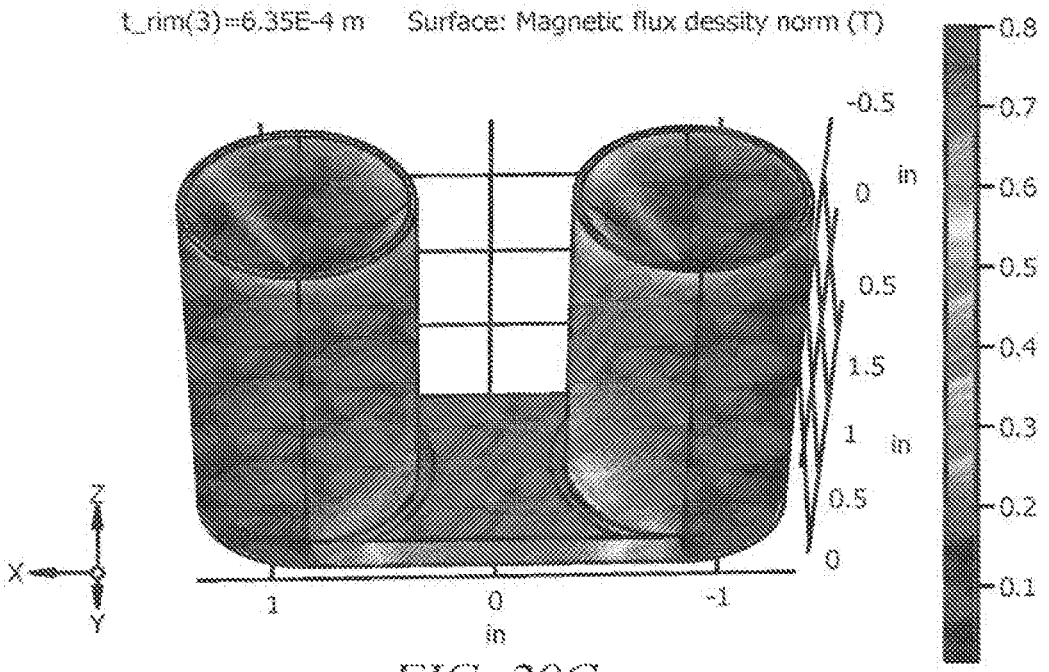
FIG. 29C is an illustration of an electromagnet formed by two straight cores, with concave conical tip cores and with a backplate, and the magnetic flux density generated by the electromagnet with a rim width of 0.635 mm and field limited to 0.8 T, in accordance with an embodiment of the present invention.
Figure 29D:
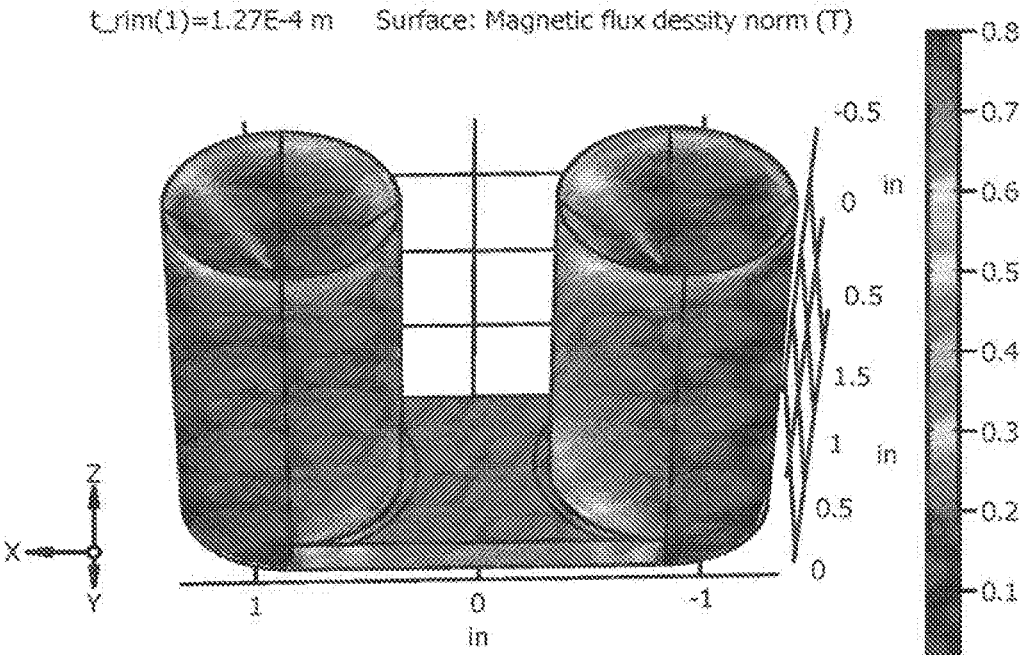
FIG. 29D is an illustration of an electromagnet formed by two straight cores, with concave conical tip cores and with a backplate, and the magnetic flux density generated by the electromagnet with a rim width of 0.127 mm and field limited to 0.8 T, in accordance with an embodiment of the present invention.
Figure 30:
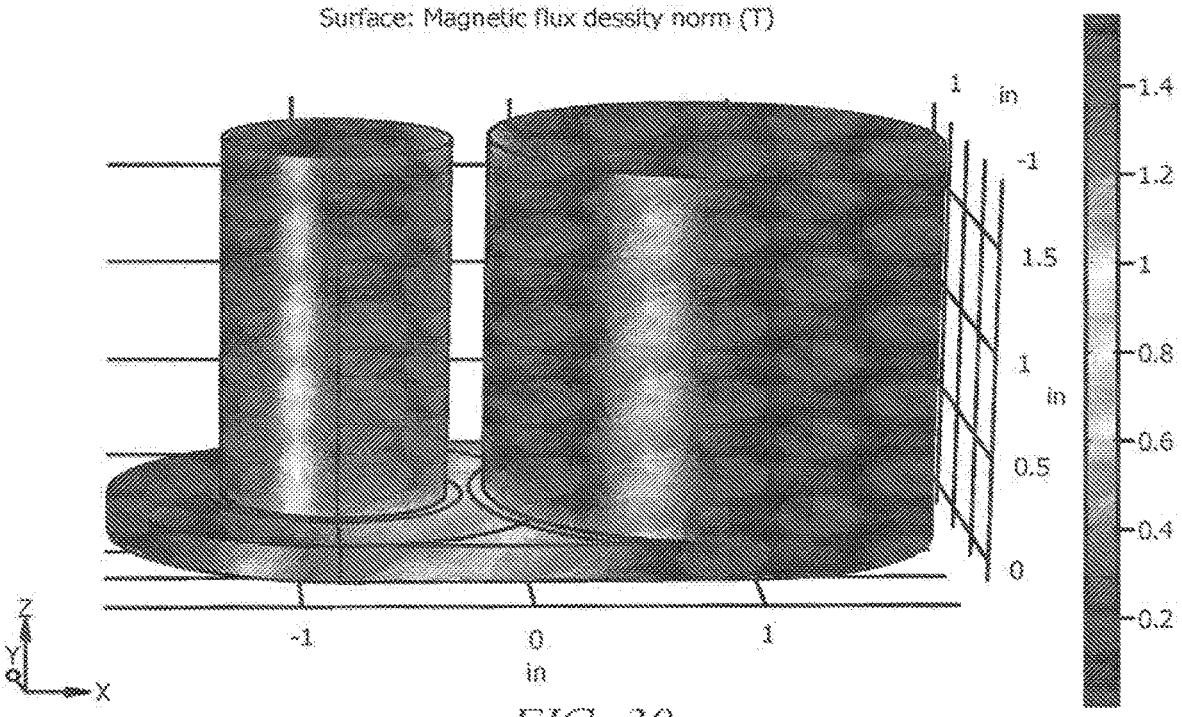
FIG. 30 is an illustration of an electromagnet formed by one 1" outside diameter and one 2" outside diameter asymmetrical cores and a backplate, and the magnetic flux density generated by the electromagnet, in accordance with an embodiment of the present invention.
Figure 31A:
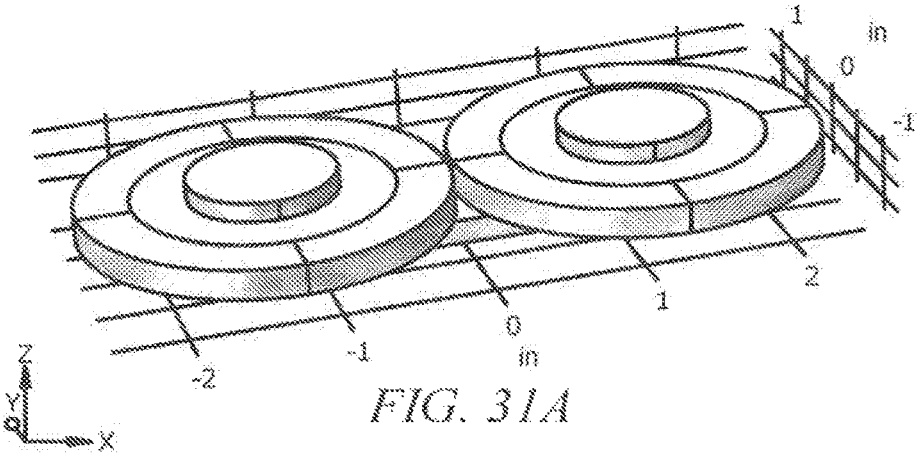
FIG. 31A is an illustration of an electromagnet formed by pancake coils with a 1" outside diameter and a backplate, in accordance with an embodiment of the present invention.
Figure 31B:
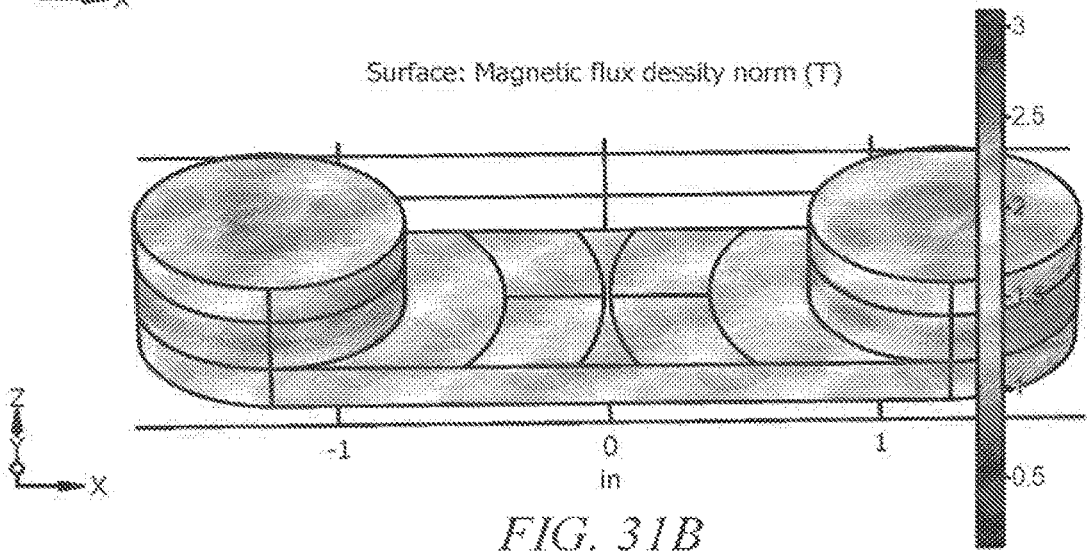
FIG. 31B is an illustration of an electromagnet formed by pancake coils with a 1" outside diameter and a backplate, and the magnetic flux density generated by the electromagnet with a 2.5 inch spacing between the cylinders, in accordance with an embodiment of the present invention.
Figure 31C:
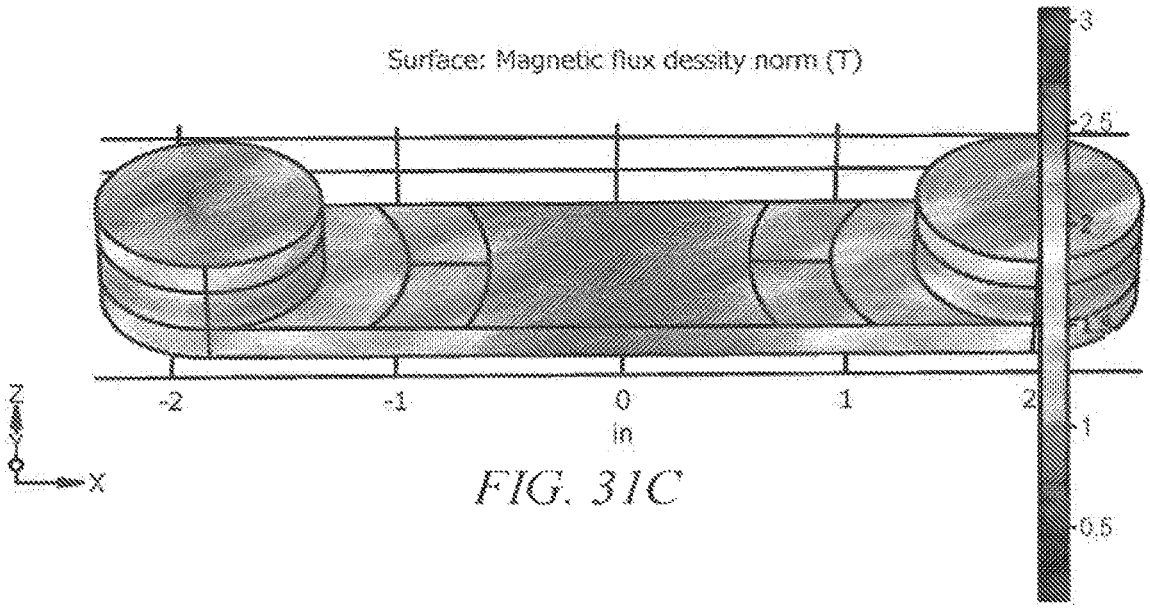
FIG. 31C is an illustration of an electromagnet formed by pancake coils with a 1" outside diameter and a backplate, and the magnetic flux density generated by the electromagnet with a 3.65 inch spacing between the cylinders, in accordance with an embodiment of the present invention.
Figure 34A:
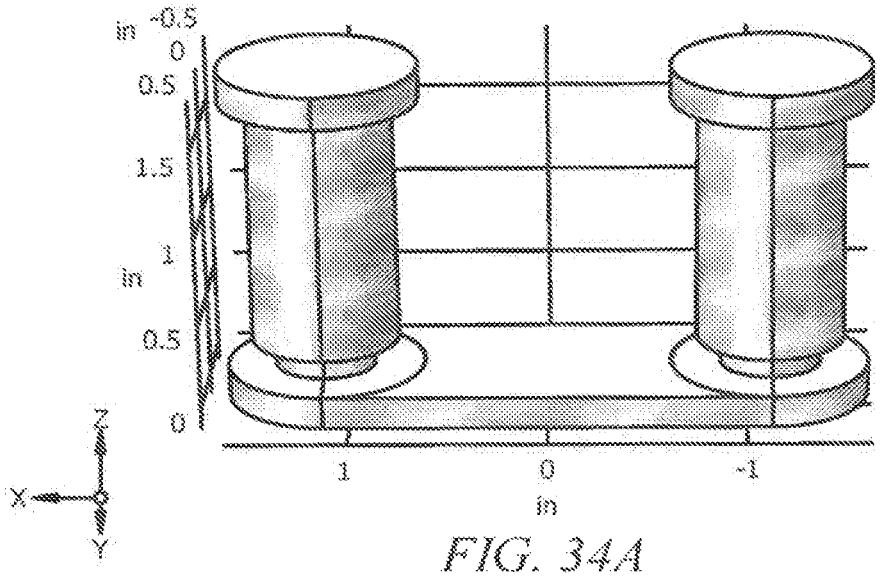
FIG. 34A is an illustration of an electromagnet formed by two one-inch outside diameter valve cores on a backplate with a width of 1 inch, in accordance with an embodiment of the present invention.
Figure 34B:
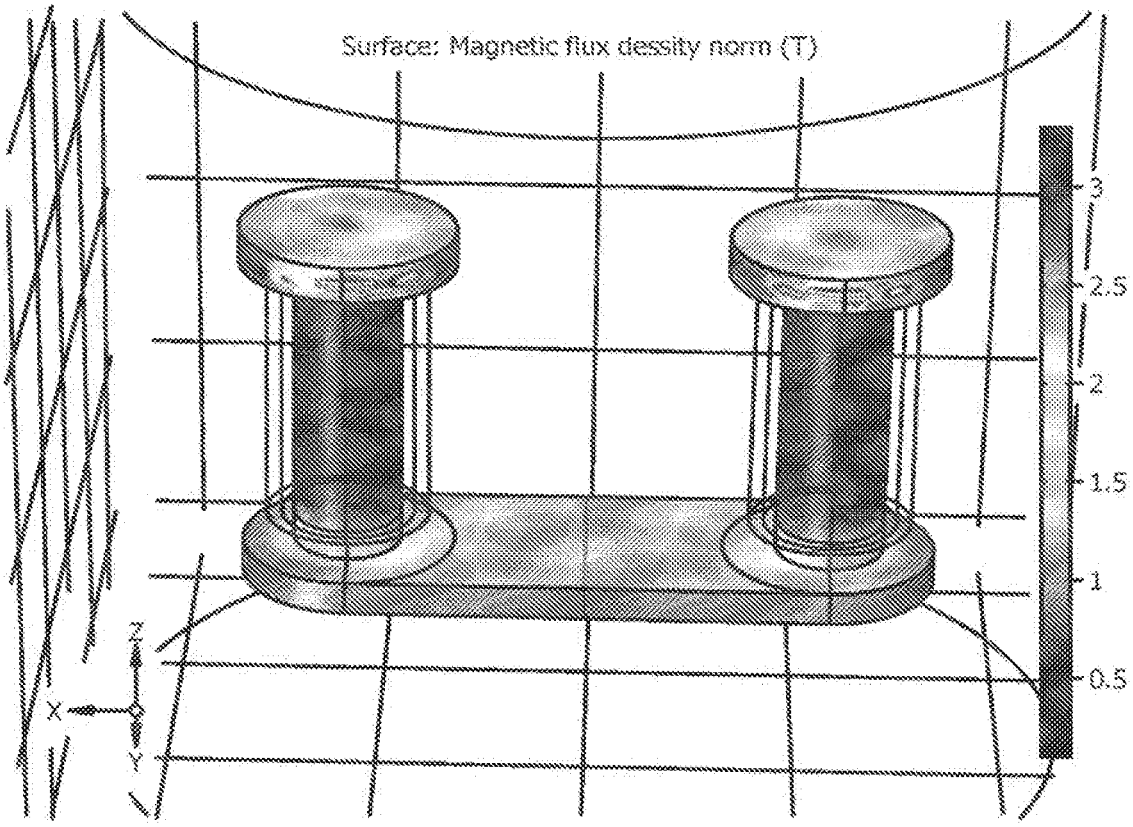
FIG. 34B is an illustration of the magnetic flux density generated by the electromagnet of FIG. 34A, in accordance with an embodiment of the present invention.
Figure 35A:
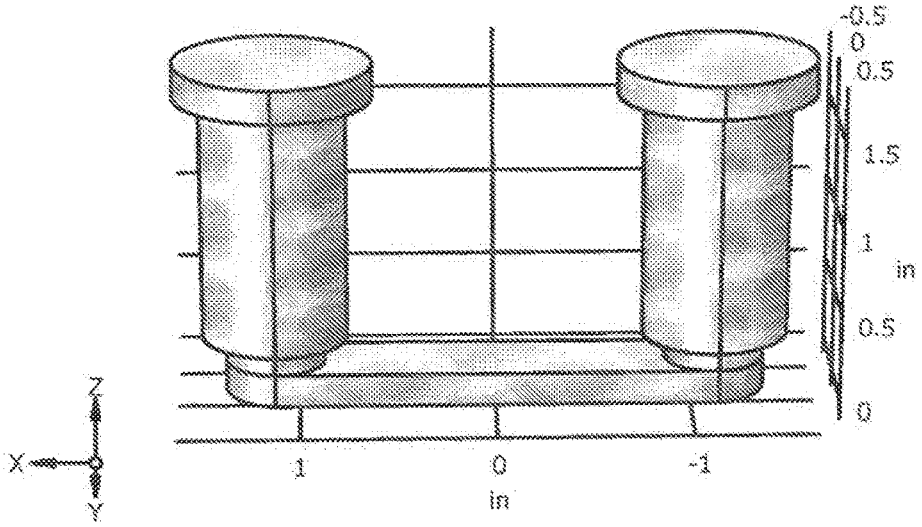
FIG. 35A is an illustration of an electromagnet formed by two one-inch outside diameter valve cores on a backplate with a width of 0.5 inch, in accordance with an embodiment of the present invention.
Figure 35B:
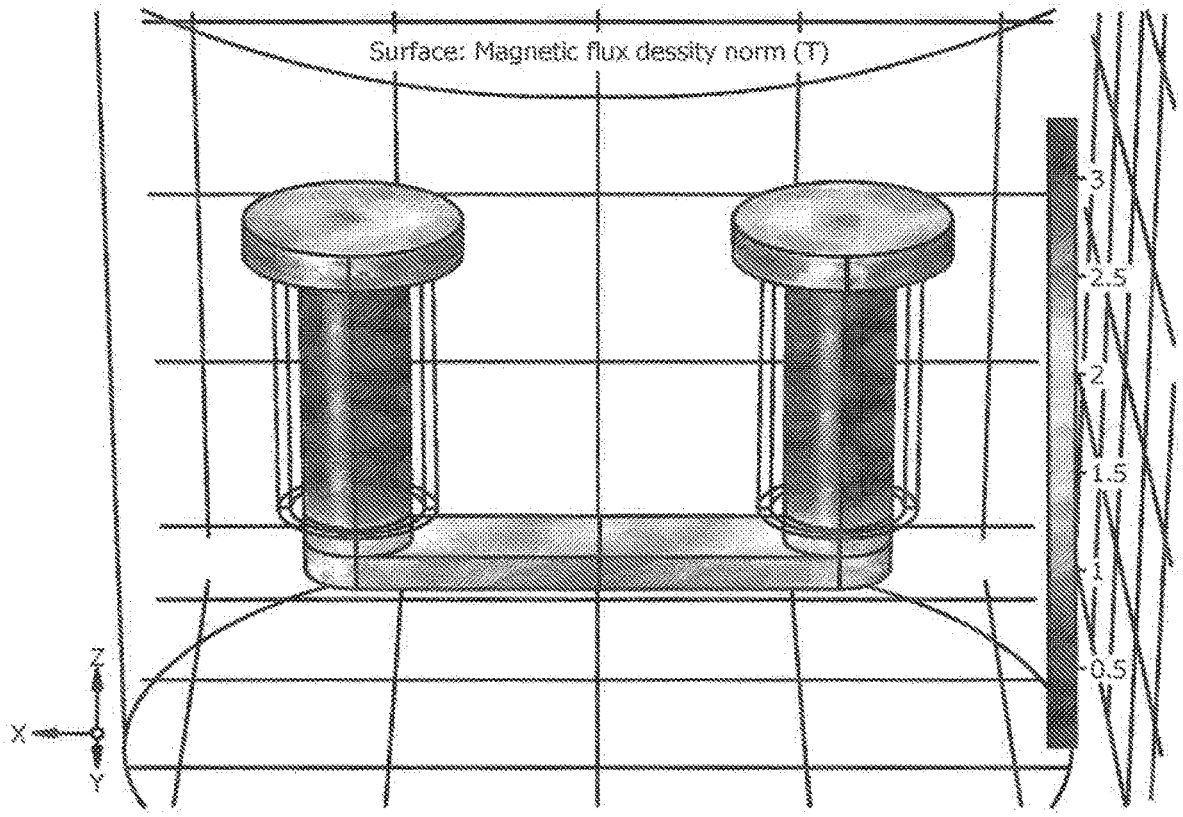
FIG. 35B is an illustration of the magnetic flux density generated by the electromagnet of FIG. 35A, in accordance with an embodiment of the present invention.
Figure 36A:
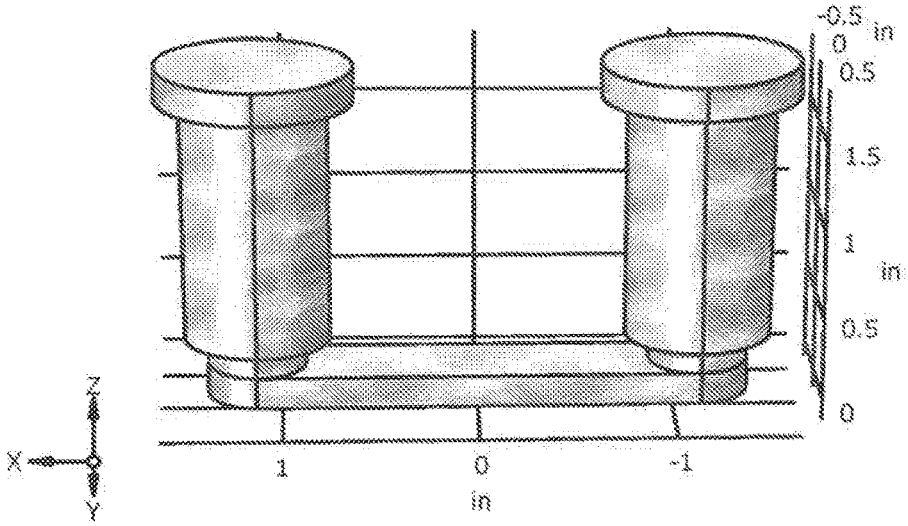
FIG. 36A is an illustration of an electromagnet formed by two two-inch outside diameter valve cores on a backplate with a width of the 2 inches, in accordance with an embodiment of the present invention.
Figure 36B:
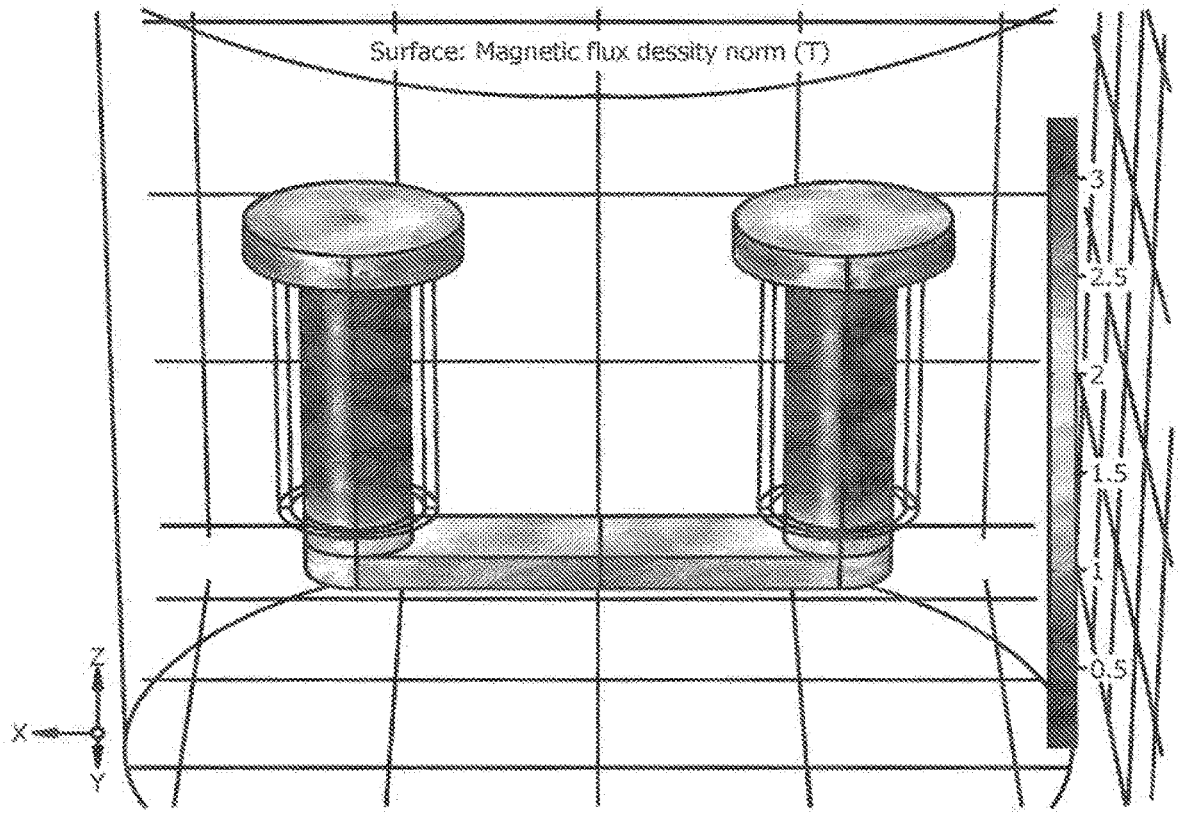
FIG. 36B is an illustration of the magnetic flux density generated by the electromagnet of FIG. 36A, in accordance with an embodiment of the present invention.
Figure 37A:
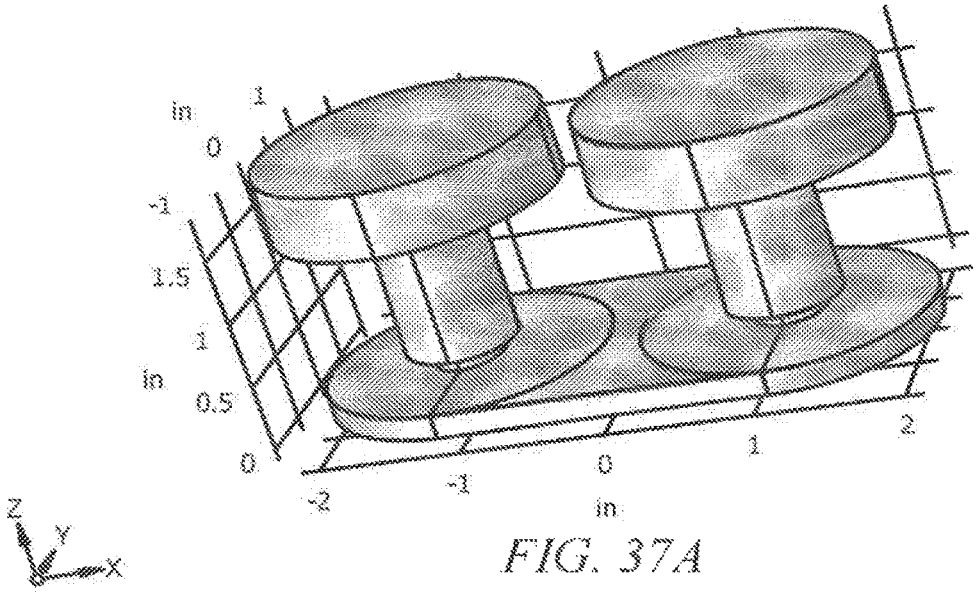
FIG. 37A is an illustration of an electromagnet formed by two two-inch outside diameter valve cores on a backplate with a width of 0.5 inches, in accordance with an embodiment of the present invention.
Figure 37B:
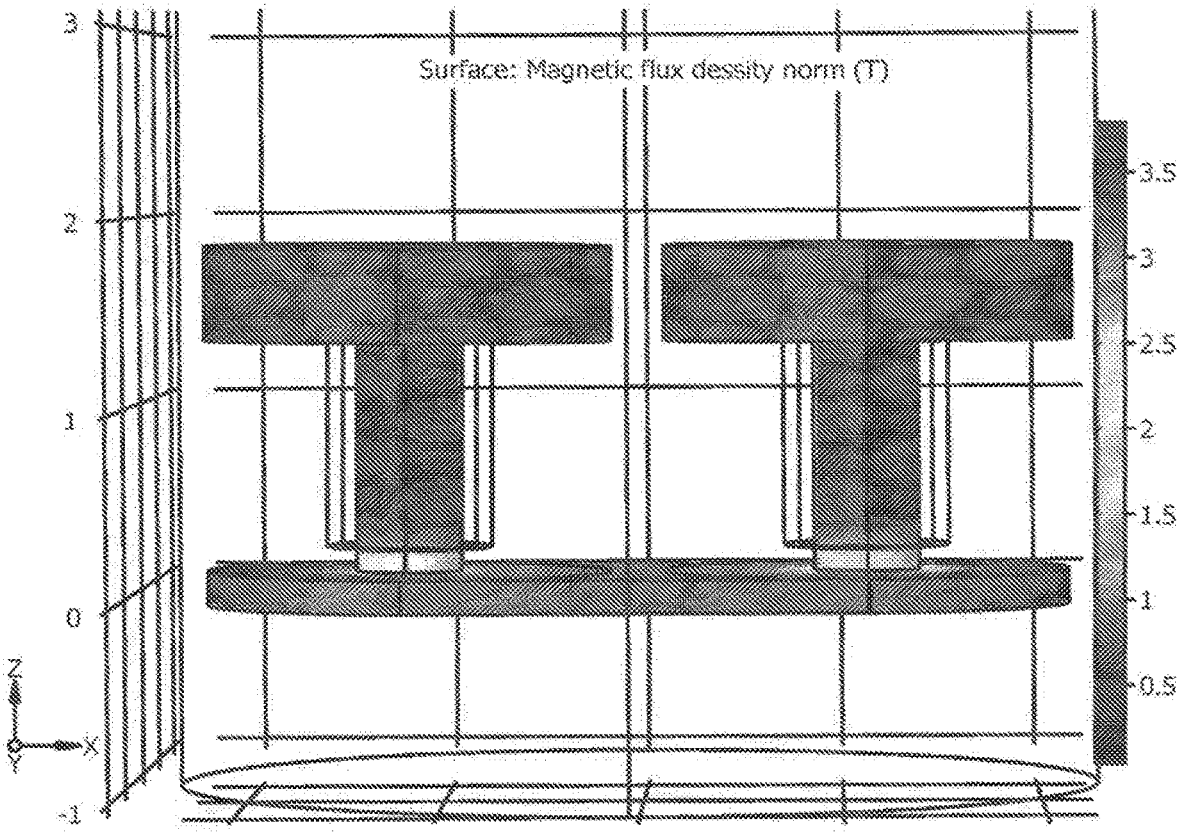
FIG. 37B is an illustration of the magnetic flux density generated by the electromagnet of FIG. 37A, in accordance with an embodiment of the present invention.
Figure 38A:
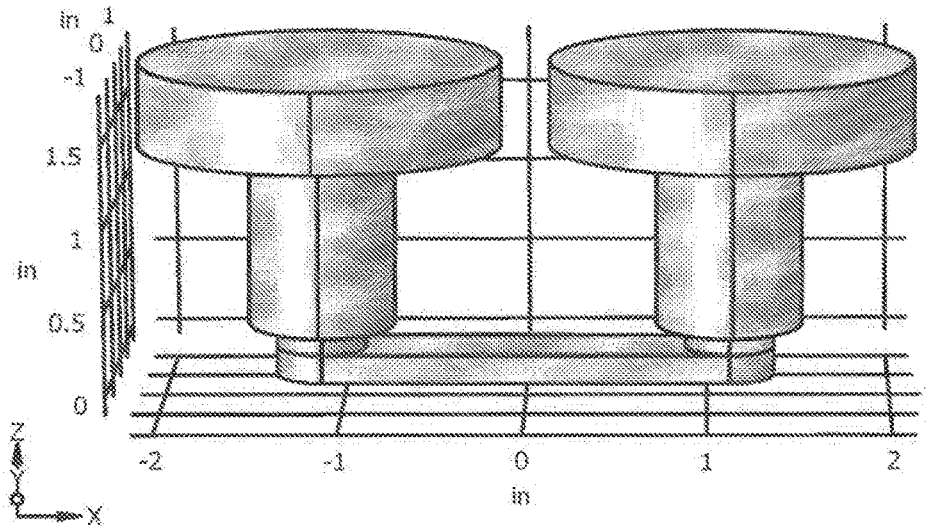
FIG. 38A is an illustration of an electromagnet formed by two two-inch outside diameter valve cores having a face thickness of 0.187 inches on a backplate with a width of 2 inches, in accordance with an embodiment of the present invention.
Figure 38B:
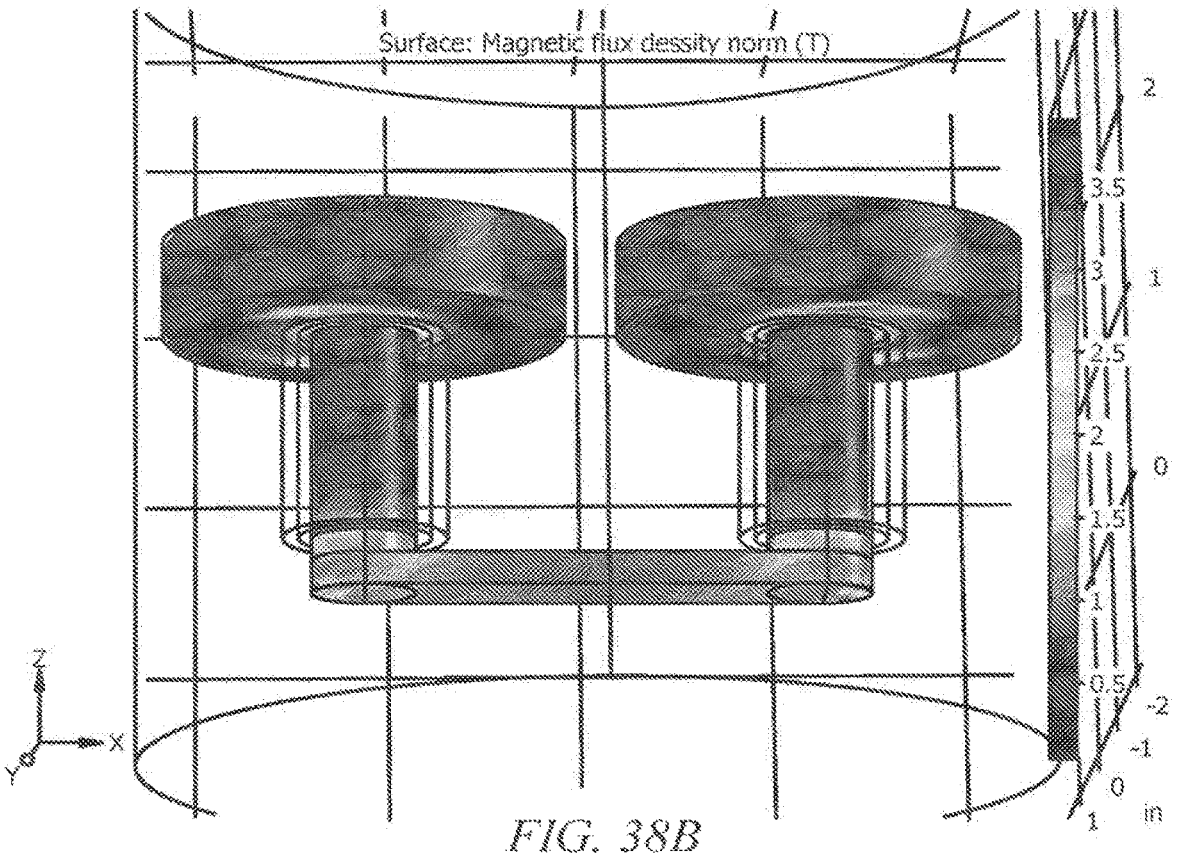
FIG. 38B is an illustration of the magnetic flux density generated by the electromagnet of FIG. 38A, in accordance with an embodiment of the present invention.
Figure 39A:
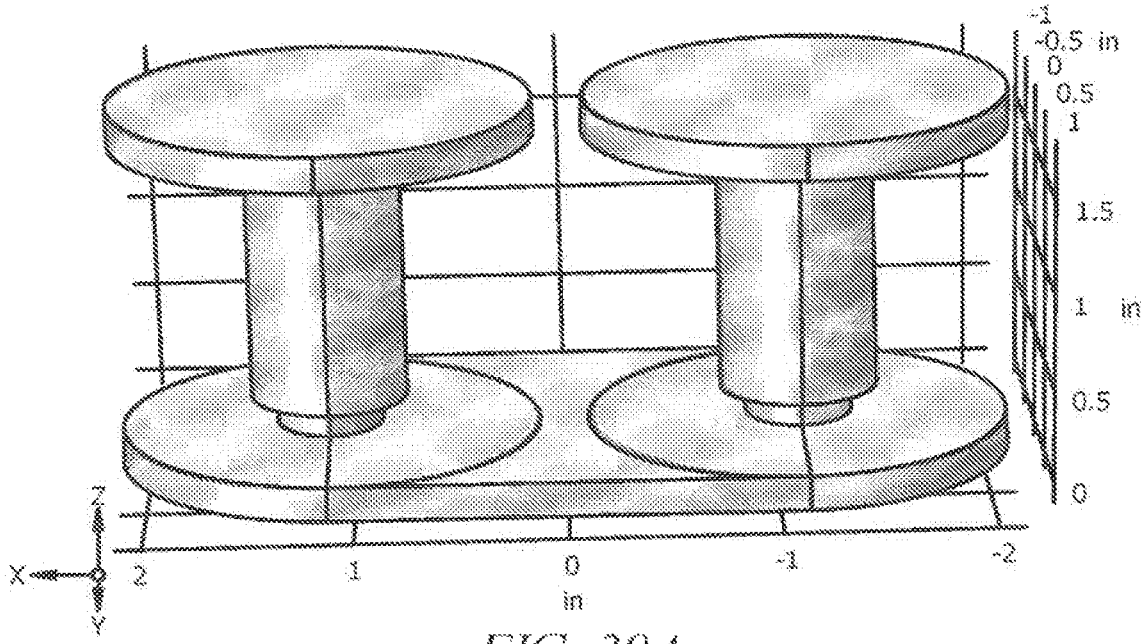
FIG. 39A is an illustration of an electromagnet formed by two two-inch outside diameter valve cores having a face thickness of 0.187 inches on a backplate with a width of 0.5 inches, in accordance with an embodiment of the present invention.
Figure 39B:
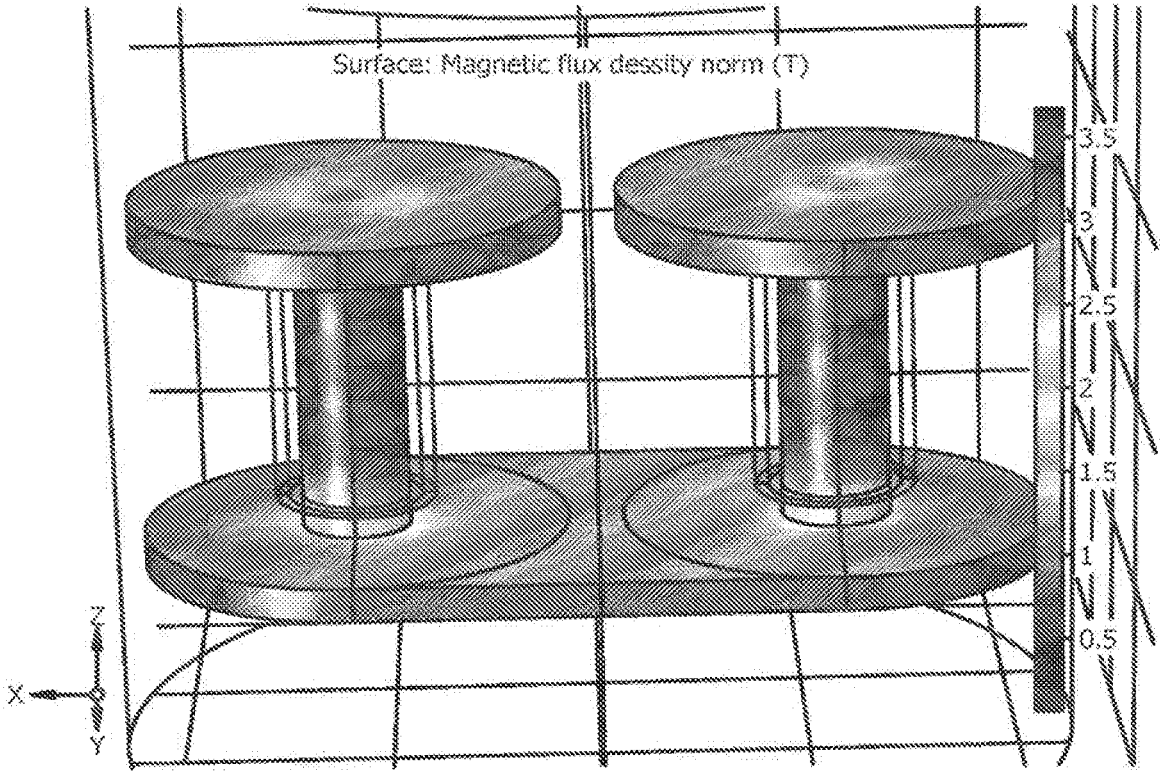
FIG. 39B is an illustration of the magnetic flux density generated by the electromagnet of FIG. 39A, in accordance with an embodiment of the present invention.
Figure 40A:
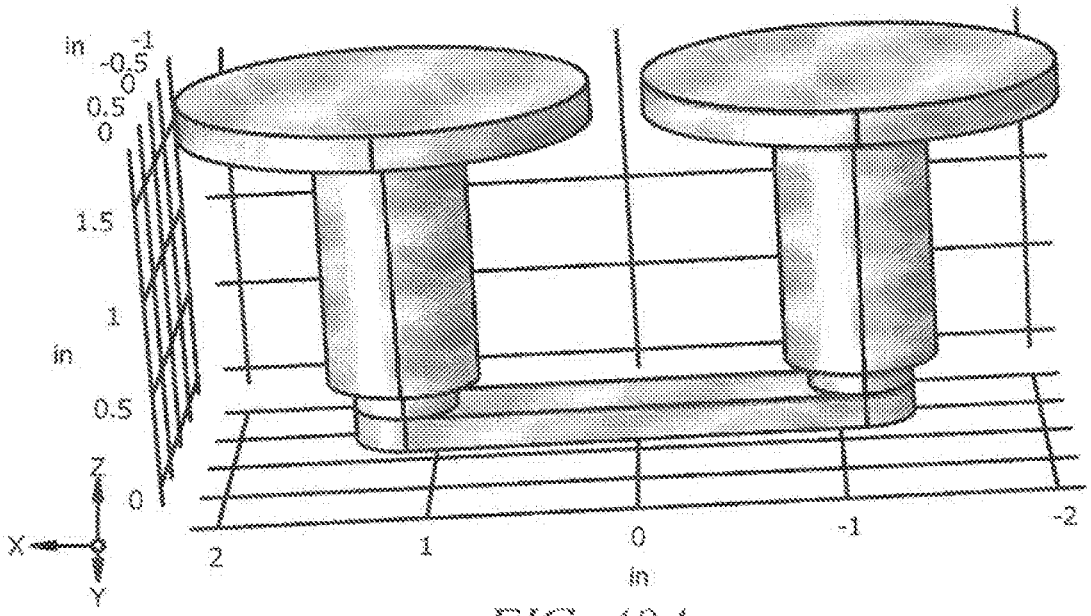
FIG. 40A is an illustration of an electromagnet formed by two two-inch outside diameter valve cores having a stem outside diameter of 1 inch on a backplate with a width of 2 inches, in accordance with an embodiment of the present invention.
Figure 40B:
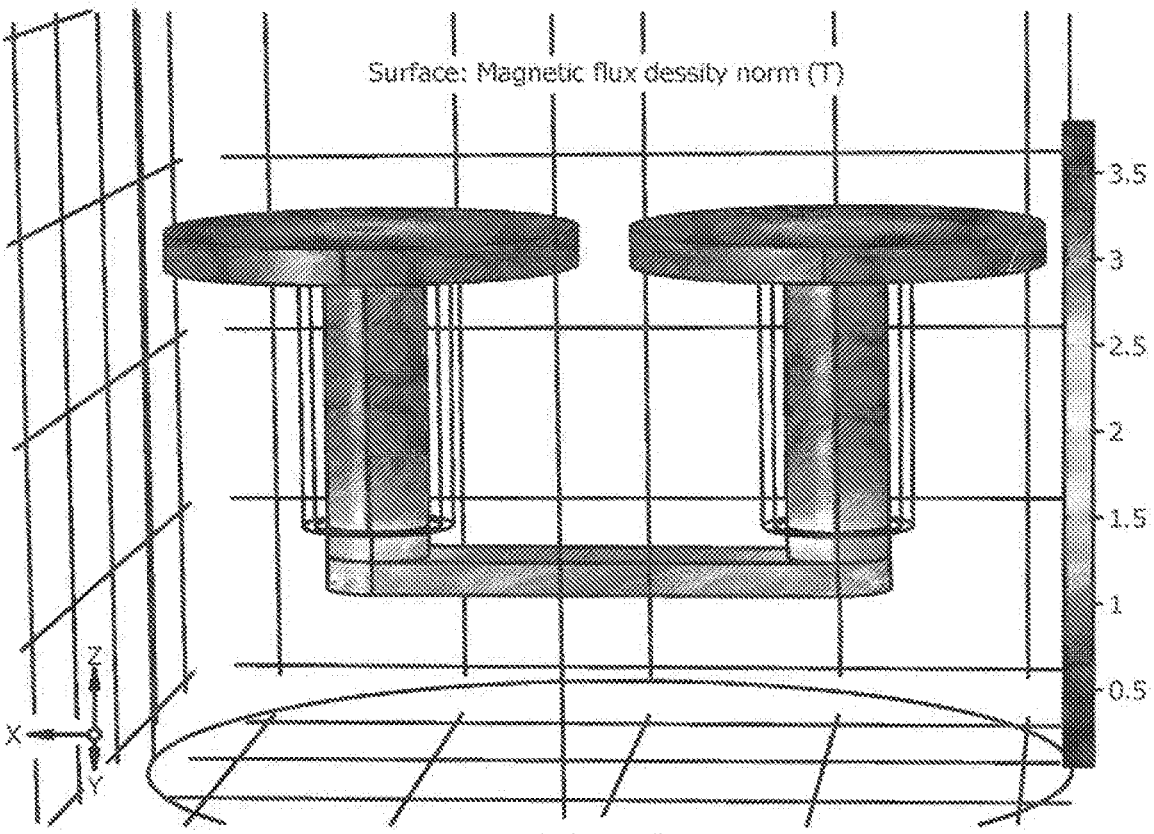
FIG. 40B is an illustration of the magnetic flux density generated by the electromagnet of FIG. 40A, in accordance with an embodiment of the present invention.
Figure 41A:
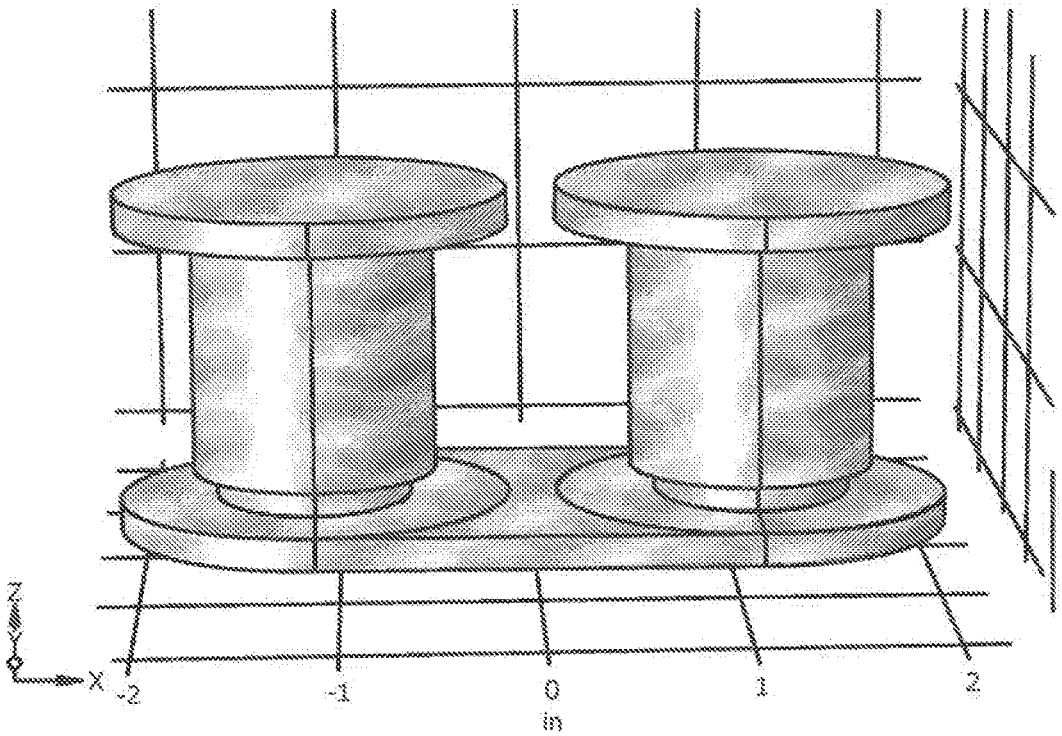
FIG. 41A is an illustration of an electromagnet formed by two two-inch outside diameter valve cores having a stem outside diameter of 1 inch on a backplate with a width of 0.05 inches, in accordance with an embodiment of the present invention.
Figure 41B:
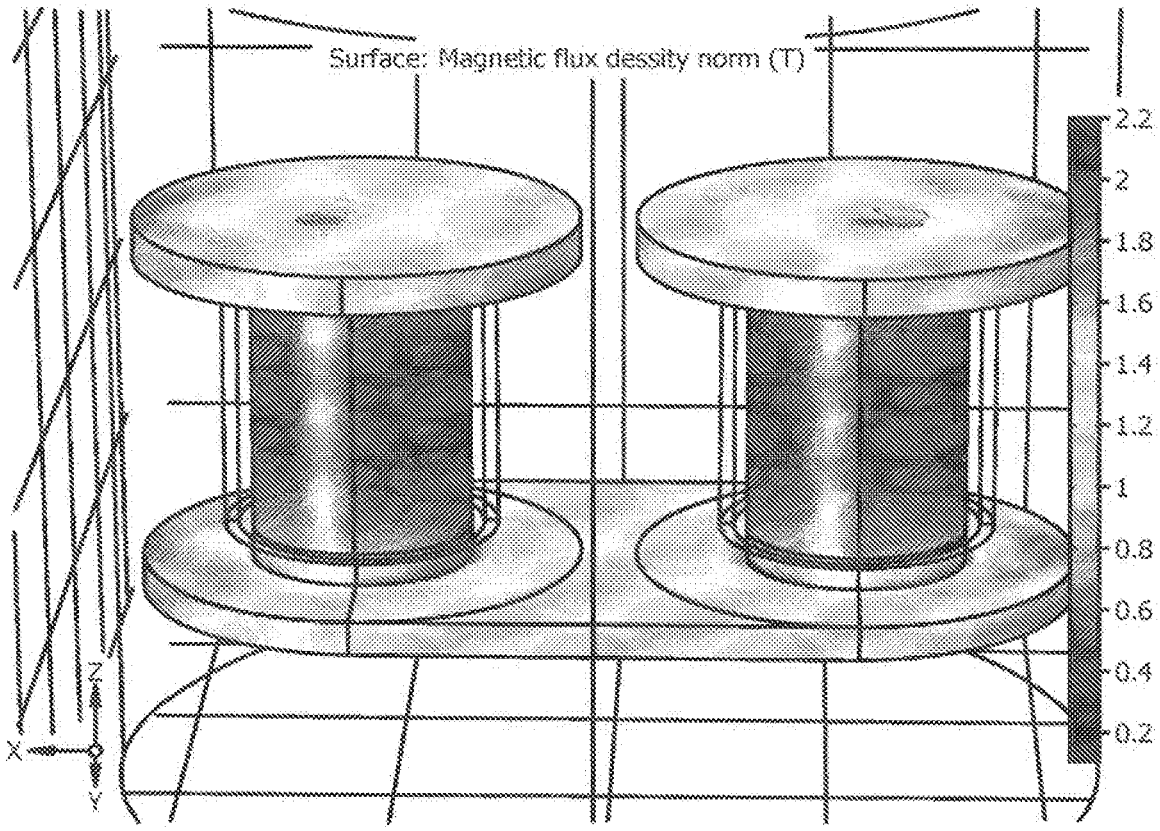
FIG. 41B is an illustration of the magnetic flux density generated by the electromagnet of FIG. 41A, in accordance with an embodiment of the present invention.

In another embodiment, the electromagnetic device may include two separate solenoids, such as in FIG. 14-FIG. 15, FIG. 23-FIG. 31 and FIG. 34-FIG. 41. As such, FIG. 14A illustrates an embodiment wherein two separate solenoids are positioned to have one end in close proximity to the other and FIG. 14B illustrates the magnetic flux density generated by the electromagnet of FIG. 14A. FIG. 15A illustrates an array of separate solenoids, wherein pairs of solenoids are positioned to have one end in close proximity to one other solenoid and FIG. 15B illustrates the magnetic flux density generated by the electromagnetics of FIG. 15A. FIG. 23A illustrates an electromagnet formed by two straight cores with no backplate the magnetic flux density generated by the electromagnet. FIG. 24A illustrates an electromagnet formed by two straight cores having a backplate and the magnetic flux density generated by the electromagnet with no field limitation. FIG. 24B illustrates an electromagnet formed by two straight cores with a backplate and the magnetic flux density generated by the electromagnet with a field limitation of 0.8 T. FIG. 25A illustrates a first perspective of an electromagnet formed by two straight cores, with convex conical tip cores and no backplate, and the magnetic flux density generated by the electromagnet with no field limitation. FIG. 25B illustrates a second perspective of an electromagnet formed by two straight cores with convex conical tip cores and no backplate and the magnetic flux density generated by the electromagnet with no field limitation. FIG. 26A illustrates a first perspective of an electromagnet formed by two straight cores, with convex conical tip cores and a backplate, and the magnetic flux density generated by the electromagnet with no field limitation. FIG. 26B is an illustration of a second perspective of an electromagnet formed by two straight cores, with convex conical tip cores and with a backplate, and the magnetic flux density generated by the electromagnet with no field limitation. FIG. 27A illustrates an electromagnet formed by two straight cores, with concave conical tip cores and no backplate, and the magnetic flux density generated by the electromagnet with a rim width of 2.54 mm. FIG. 27B is an illustration of an electromagnet formed by two straight cores, with concave conical tip cores and no backplate, and the magnetic flux density generated by the electromagnet with a rim width of 1.27 mm. FIG. 27C is an illustration of an electromagnet formed by two straight cores, with concave conical tip cores and no backplate, and the magnetic flux density generated by the electromagnet with a rim width of 0.635 mm. FIG. 27D illustrates an electromagnet formed by two straight cores, with concave conical tip cores and no backplate, and the magnetic flux density generated by the electromagnet with a rim width of 0.127 mm. FIG. 28A illustrates an electromagnet formed by two straight cores, with concave conical tip cores and with a backplate, and the magnetic flux density generated by the electromagnet with a rim width of 1.91 mm. FIG. 28B illustrates an electromagnet formed by two straight cores, with concave conical tip cores and with a backplate, and the magnetic flux density generated by the electromagnet with a rim width of 1.27 mm. FIG. 28C illustrates an electromagnet formed by two straight cores, with concave conical tip cores and with a backplate, and the magnetic flux density generated by the electromagnet with a rim width of 0.635 mm. FIG. 28D illustrates an electromagnet formed by two straight cores, with concave conical tip cores and with a backplate, and the magnetic flux density generated by the electromagnet with a rim width of 0.127 mm. FIG. 29A illustrates an electromagnet formed by two straight cores, with concave conical tip cores and with a backplate, and the magnetic flux density generated by the electromagnet with a rim width of 1.91 mm and field limited to 0.8 T. FIG. 29B illustrates an electromagnet formed by two straight cores, with concave conical tip cores and with a backplate, and the magnetic flux density generated by the electromagnet with a rim width of 1.27 mm and field limited to 0.8 T. FIG. 29C illustrates an electromagnet formed by two straight cores, with concave conical tip cores and with a backplate, and the magnetic flux density generated by the electromagnet with a rim width of 0.635 mm and field limited to 0.8 T. FIG. 29D illustrates an electromagnet formed by two straight cores, with concave conical tip cores and with a backplate, and the magnetic flux density generated by the electromagnet with a rim width of 0.127 mm and field limited to 0.8 T. FIG. 30 illustrates an electromagnet formed by one 1" outside diameter and one 2" outside diameter asymmetrical cores and a backplate, and the magnetic flux density generated by the electromagnet. FIG. 31A illustrates an electromagnet formed by pancake coils with a 1" outside diameter and a backplate. FIG. 31B illustrates an electromagnet formed by pancake coils with a 1" outside diameter and a backplate, and the magnetic flux density generated by the electromagnet with a 2.5 inch spacing between the cylinders. FIG. 31C illustrates an electromagnet formed by pancake coils with a 1" outside diameter and a backplate, and the magnetic flux density generated by the electromagnet with a 3.65 inch spacing between the cylinders. FIG. 34A illustrates an electromagnet formed by two one-inch outside diameter valve cores on a backplate with a width of 1 inch. FIG. 34B is an illustration of the magnetic flux density generated by the electromagnet of FIG. 34A. FIG. 35A is an illustration of an electromagnet formed by two one-inch outside diameter valve cores on a backplate with a width of 0.5 inch. FIG. 35B is an illustration of the magnetic flux density generated by the electromagnet of FIG. 35A. FIG. 36A is an illustration of an electromagnet formed by two two-inch outside diameter valve cores on a backplate with a width of 2 inches. FIG. 36B is an illustration of the magnetic flux density generated by the electromagnet of FIG. 36A. FIG. 37A is an illustration of an electromagnet formed by two two-inch outside diameter valve cores on a backplate with a width of 0.5 inches. FIG. 37B is an illustration of the magnetic flux density generated by the electromagnet of FIG. 37A. FIG. 38A is an illustration of an electromagnet formed by two two-inch outside diameter valve cores having a face thickness of 0.187 inches on a backplate with a width of 2 inches. FIG. 38B is an illustration of the magnetic flux density generated by the electromagnet of FIG. 38A. FIG. 39A is an illustration of an electromagnet formed by two two-inch outside diameter valve cores having a face thickness of 0.187 inches on a backplate with a width of 0.5 inches. FIG. 39B is an illustration of the magnetic flux density generated by the electromagnet of FIG. 39A. FIG. 40A is an illustration of an electromagnet formed by two two-inch outside diameter valve cores having a stem outside diameter of 1 inch on a backplate with a width of 2 inches. FIG. 40B is an illustration of the magnetic flux density generated by the electromagnet of FIG. 40A. FIG. 41A is an illustration of an electromagnet formed by two two-inch outside diameter valve cores having a stem outside diameter of 1 inch on a backplate with a width of 0.05 inches. FIG. 41B is an illustration of the magnetic flux density generated by the electromagnet of FIG. 41A.

FIG. 17 illustrates exemplary view of possible embodiments of various possible shapes of the magnetic core of the electromagnet in accordance with the present invention.

Figure 18:
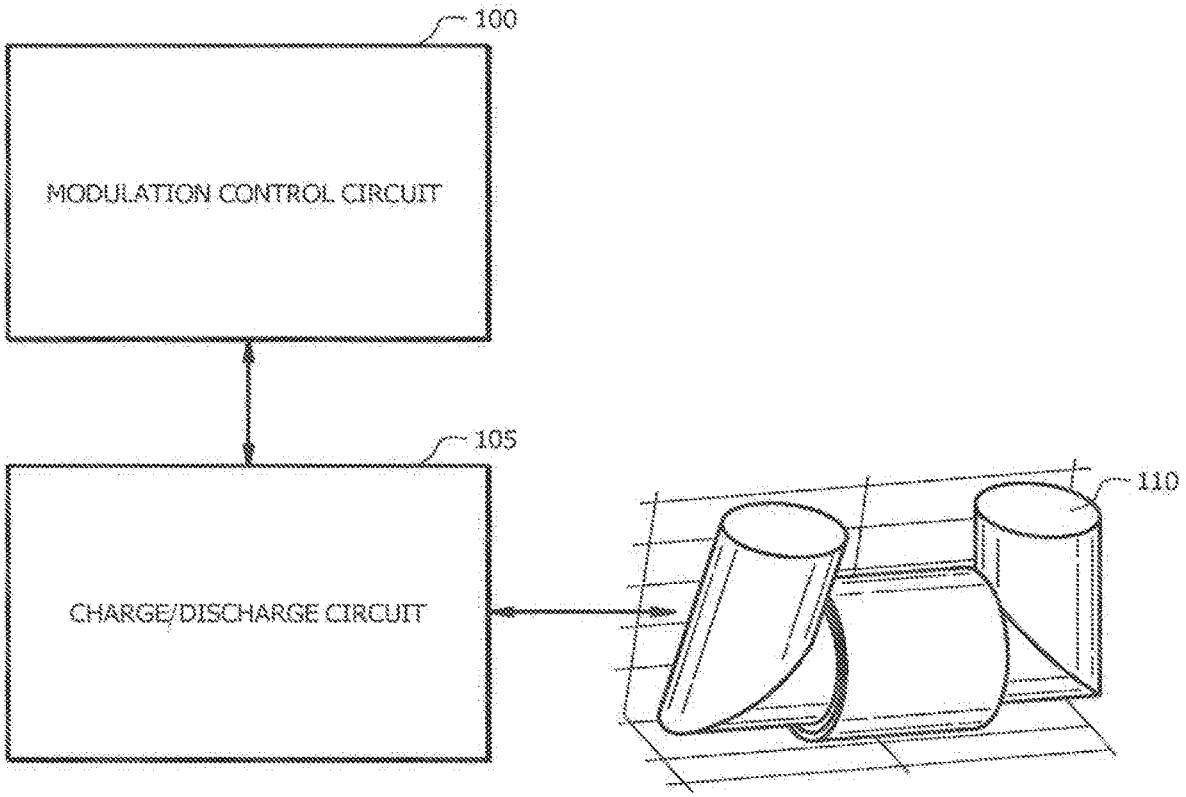
FIG. 18 is a block diagram illustrating the system of the present invention for modulation of an electromagnetic device, in accordance with an embodiment of the present invention.

FIG. 18 is an illustration of the charge/discharge circuit 105 and the modulation control circuit 100 of the present invention. The two main functions of the charge/discharge circuit 105 are to switch charging and discharging of the ultracapacitors used to energize the solenoid of the electromagnetic device(s) 110. Various embodiments are within the scope of the present invention to implement the charge/discharge circuit 105 and the modulation control circuit 100 and are commonly known in the art. In a particular embodiment, transistor-based charge and discharge signals are decoupled from the high current charging/discharging portion of the circuit using optical isolators. In operation, when the charge signal is high and the discharge signal is low, charging is enabled and the upper PNP transistor charges the ultracapacitors in parallel. The supply +Vcharge is voltage-limited to prevent overcharging. Additionally, when the charge signal is low and the discharge signal is high, discharging is enabled and the lower PNP transistor switches the SCR (silicon-controlled rectifier), allowing the ultracapacitors to discharge through the coil and the current limiting resistor. As such, the charge/discharge circuit 105 is controlled by a modulation control circuit 100 to establish the modulated magnetic field in the electromagnetic 110 that is effective in detaching a magnet from a metal surface, detaching two magnetically bound permanent magnets and moving a metal-containing object, as previously described.

Figure 19:
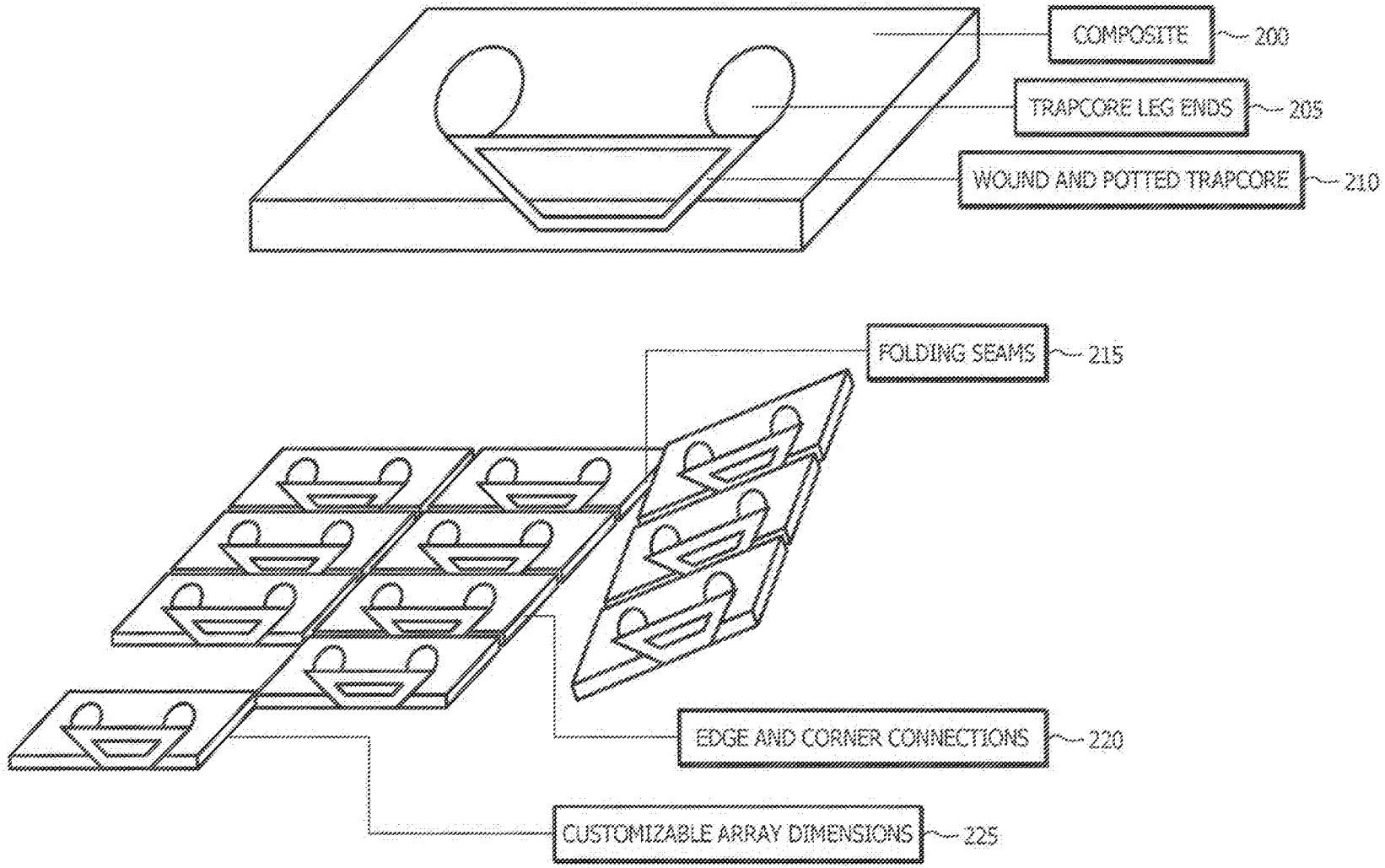
FIG. 19 is an illustration of an array of trapezoidal-shaped electromagnets positioned within a composite material, in accordance with an embodiment of the present invention.

In a particular embodiment, shown in FIG. 19, an array of trapezoidal-shaped (205, 210) electromagnets may be positioned or embedded within a composite material 200 to provide an improved electromagnetic device for the removal of magnets from metal surfaces or plates. The illustrated electromagnetic system comprises many integrated modules having edge and corner connections 220 that form an array or sheet of electromagnetic devices. The array may include folding seams 215 and customizable array dimensions 225. In this embodiment, the electromagnetic devices are trapezoidal-shaped solenoid electromagnetic devices. In operation, the active side of the module is positioned to be facing towards the attachment substrate where detachment is desired. The module may include terminals to provide electrical connection of the solenoids with the charge/discharge circuit 105. A plurality of charge/discharge circuits 105 may be employed in the electromagnetic device and may be controlled through an algorithm executed by a processor of the modulation control circuit 100. This algorithmic control may be delivered by either wire connections or wireless means, such as Wi-Fi or Bluetooth. The electrical connections to the charge/discharge circuits may be positioned at the edges and/or corners of the modules to allow for customization 105 of the array dimensions. Each module may include one or more trapezoidal-shaped core (or other shape) electromagnetic devices with solenoid(s) that have been fully wound with insulated copper wire and potted in composite material. The ends of the trapezoidal-shaped core may be flush with the surface of the composite material to allow for direct contact with the attachment substrate. The edges of the composite housing may be articulating to allow for interlocking of multiple modules in a manner that retains some degree of foldability along the seams between modules. Design iterations to this technology may include system miniaturization, materials choices, electrical layout and strategy, interlocking edge mechanisms and any additional needed supporting components, such as passive cooling or scratch/crack resistant coatings.

Figure 22:
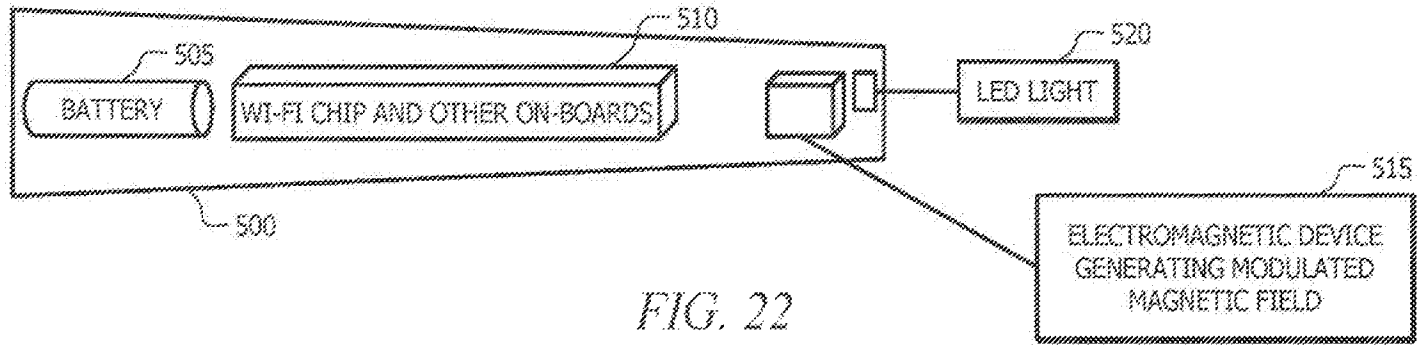
FIG. 22 is an illustration of an embodiment of a wand including an electromagnetic system in accordance with an embodiment of the present invention.

FIG. 22 illustrates a specific embodiment of the present invention where the electromagnetic device 515 and associated charge/discharge circuitry are implemented in the tip of a toy wand 500 that can be used to detach magnets and to effect the movement of plastic toy figures containing a small piece of iron. The wand 500 may additionally include a battery 505, a small LED light 520 and a Wi-Fi chip 510 to allow for internet-based actuation of the LED light during coordinated events.

Figure 20:
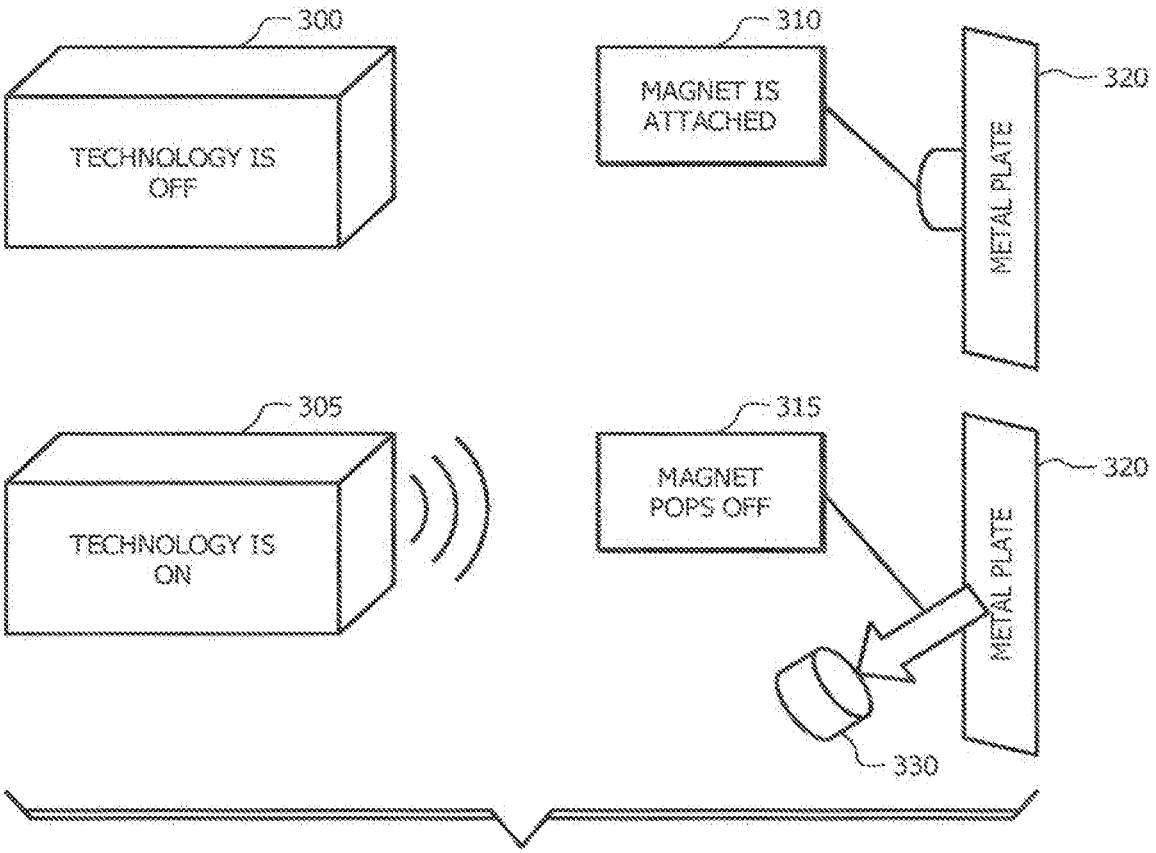
FIG. 20 is an illustration of the method of the present invention for detaching magnets from a metal surface.

FIG. 20 illustrates a method of the present invention wherein the technology is used to detach a magnet 330 from a metal surface 320. As shown in this embodiment, when the technology 300 comprising the electromagnetic, charge/discharge circuit and modulation control circuit is in close proximity to the magnet 330 and this attached to the metal surface 320 and is turned OFF, the magnet 330 remains attached 310 to the metal surface 320. When the technology 300 is turned ON, the modulation of the electromagnetic field in the electromagnetic device is effective in removing 315 the magnet 330 from the metal surface 320.

Figure 21:
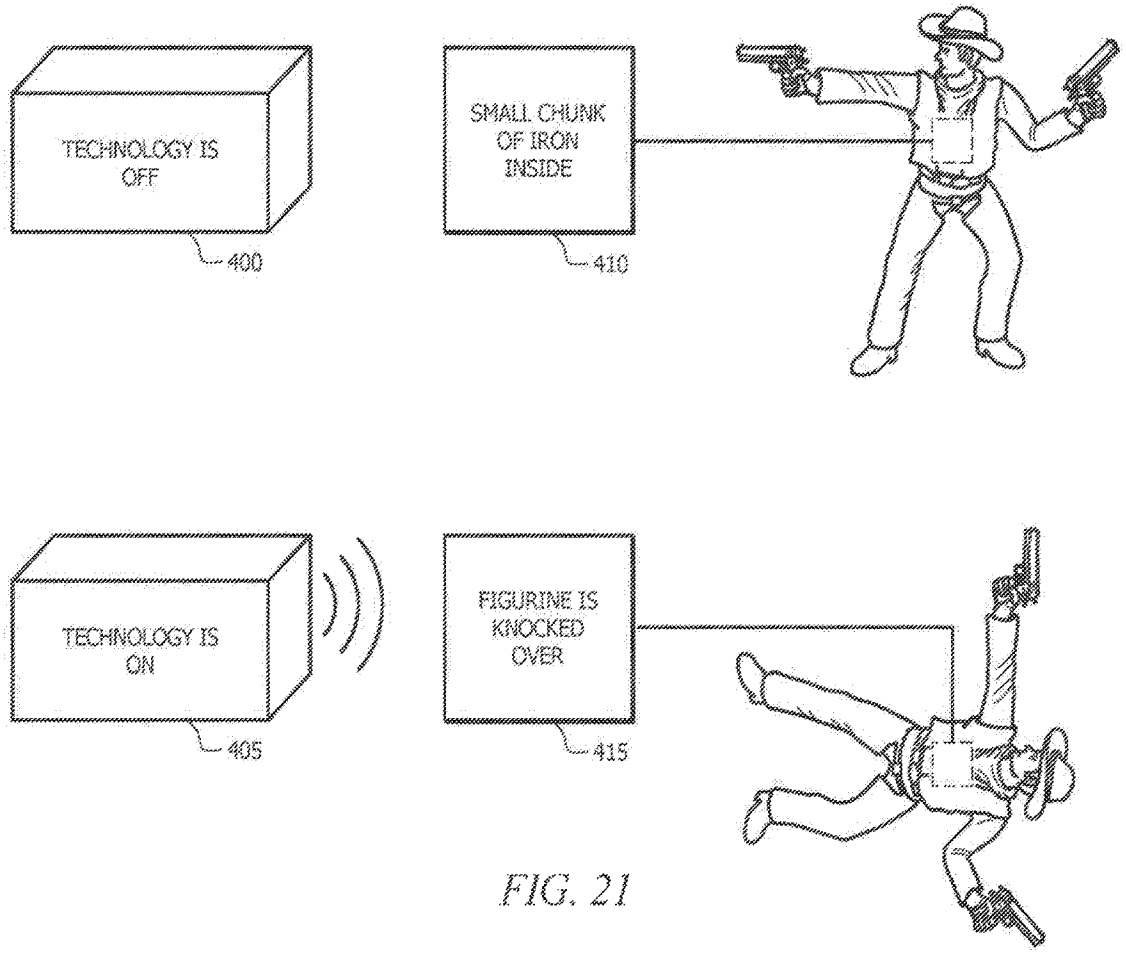
FIG. 21 is an illustration of the method of the present invention for effecting movement of an object containing a piece of metal.

FIG. 21 illustrates the method of the present invention wherein the technology is used to effect the movement of an object containing a metal element 410. In this embodiment, when the electromagnetic device, charge/discharge circuit and modulation control circuit are turned OFF 400 and positioned in close proximity to the object containing a metal element 410, the object remains upright. When the electromagnetic field of electromagnetic device is turned ON 405 and the field is modulated, the object is knocked over 415, as a result of gravity.

In various embodiments, portions of the system of the present invention may be implemented in a Field Programmable Gate Array (FPGA) or Application Specific Integrated Circuit (ASIC). As would be appreciated by one skilled in the art, various functions of circuit elements may also be implemented as processing steps in a software program. Such software may be employed in, for example, a digital signal processor, a network processor, a microcontroller or general-purpose computer.

Unless specifically stated otherwise as apparent from the discussion, it is appreciated that throughout the description, discussions utilizing terms such as "receiving", "determining", "generating", "limiting", "sending", "counting", "classifying", or the like, can refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

The present invention may be embodied on various computing platforms that perform actions responsive to software-based instructions. The following provides an antecedent basis for the information technology that may be utilized to enable the invention.

The computer readable medium described in the claims below may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any non-transitory, tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. However, as indicated above, due to circuit statutory subject matter restrictions, claims to this invention as a software product are those embodied in a non-transitory software medium such as a computer hard drive, flash-RAM, optical disk or the like.

Program code embodied on a computer readable medium may be transmitted using any appropriate medium, including but not limited to wireless, wire-line, optical fiber cable, radio frequency, etc., or any suitable combination of the foregoing. Computer program code for carrying out operations for aspects of the present invention may be written in any combination of one or more programming languages, including an object oriented programming language such as Java, C#, C++, Visual Basic or the like and conventional procedural programming languages, such as the "C" programming language or similar programming languages.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks. It is understood that the invention is not limited to the particular embodiment disclosed set forth herein as illustrative, but that the invention will include all embodiments falling within the scope of the appended claims.

The invention claimed is:

1. A system for generating a modulated magnetic field, the system comprising:

at least one electromagnetic device;

a charge/discharge circuit coupled to the electromagnetic device; and a modulation control circuit coupled to the charge/discharge circuit in close proximity to a permanent magnet to control charging and discharging of the electromagnetic device to generate a modulated magnetic field, wherein the modulated magnetic field is sufficient to detach the permanent magnet from a metal surface.

2. The system of claim 1, wherein the at least one electromagnetic device comprises at least one solenoid coil and wherein the charge/discharge circuit is coupled to the at least one solenoid coil.

3. The system of claim 1, wherein the at least one electromagnetic device is positioned on a backplate.

4. The system of claim 1, wherein the at least one electromagnetic device comprises at least one magnetic core at least partially surrounded by at least one solenoid coil.

5. The system of claim 1, wherein the at least one electromagnetic device comprising a plurality of magnetic cores, each of the plurality of magnetic cores at least partially surrounded by at least one solenoid coil.

6. The system of claim 1, wherein the at least one electromagnetic device comprises a magnetic core that is substantially straight.

7. The system of claim 1, wherein the at least one electromagnetic device comprises a magnetic core that is valve shaped.

8. The system of claim 1, wherein the at least one electromagnetic device comprises a magnetic core that is pancake shaped.

9. The system of claim 1, wherein the at least one electromagnetic device comprises a magnetic core at least partially surrounded by at least one solenoid coil, wherein the magnetic core comprises a first end and a second end and is shaped to position the first end in close proximity to the second end.

10. The system of claim 1, wherein the at least one electromagnetic device comprises a trapezoid shaped magnetic core at least partially surrounded by at least one solenoid coil.

11. The system of claim 1, wherein the at least one electromagnetic device comprises a trapezoid shaped magnetic core at least partially surrounded by at least one solenoid coil and wherein legs of a core of the electromagnetic device are positioned at about an 80° angle.

12. The system of claim 1, wherein the at least one electromagnetic device comprises a trapezoid shaped magnetic core at least partially surrounded by at least one solenoid coil and wherein legs of a core of the electromagnetic device are positioned at about an 100° angle.

13. The system of claim 1, wherein the at least one electromagnetic device comprises an array of electromagnetic devices.

14. A method for generating a modulated magnetic field, the method comprising:

controlling charging and discharging of at least one electromagnetic device to generate a modulated magnetic field, wherein the at least one electromagnetic device comprises at least one magnetic core at least partially surrounded by at least one solenoid coil.

15. A method for removing a permanent magnet from a metal surface the method comprising:

positioning an electromagnetic system comprising at least one electromagnetic device, a charge/discharge circuit coupled to the electromagnetic device and a modulation control circuit coupled to the charge/discharge circuit in close proximity to a permanent magnet; and activating the modulation control circuit to control the charging and discharging of the electromagnetic device to generate a modulated magnetic field, wherein the modulated electromagnetic field is sufficient to detach the permanent magnet from the metal surface.

* * * * *